US007520288B2

(12) United States Patent
Rhodes

(10) Patent No.: US 7,520,288 B2
(45) Date of Patent: Apr. 21, 2009

(54) CLEANING MACHINE

(76) Inventor: Laurence M. Rhodes, 11825 Grande Vista Dr., Whittier, CA (US) 90601

( * ) Notice: Subject to any disclaimer, the term of this patent is extended or adjusted under 35 U.S.C. 154(b) by 510 days.

(21) Appl. No.: 10/920,967

(22) Filed: Aug. 18, 2004

(65) Prior Publication Data

US 2006/0037635 A1 Feb. 23, 2006

(51) Int. Cl.
*B08B 3/02* (2006.01)

(52) U.S. Cl. ..... 134/200; 248/89; 211/117

(58) Field of Classification Search ..... 134/200
See application file for complete search history.

(56) References Cited

U.S. PATENT DOCUMENTS

| | | | | |
|---|---|---|---|---|
| 1,633,803 | A * | 6/1927 | Ballin | 134/138 |
| 2,069,985 | A * | 2/1937 | Walker | 134/103.1 |
| 2,471,506 | A * | 5/1949 | Wiswall | 134/98.1 |
| 3,624,750 | A | 11/1971 | Peterson | |
| 3,960,728 | A * | 6/1976 | Otzen | 210/167.01 |
| 4,056,114 | A | 11/1977 | Boutillette | |
| 4,744,379 | A * | 5/1988 | Goettel | 134/109 |
| 4,763,706 | A | 8/1988 | Rice et al. | |
| 4,995,411 | A | 2/1991 | Lowell et al. | |
| 5,205,306 | A | 4/1993 | Peterson | |
| 5,303,725 | A | 4/1994 | Hilgren | |
| 5,398,708 | A * | 3/1995 | Sheldon | 134/86 |
| 6,115,541 | A * | 9/2000 | Rhodes | 392/441 |

FOREIGN PATENT DOCUMENTS

CA 192472 * 8/1985

OTHER PUBLICATIONS

EMC Equipment Manufacturing Corporation, "Automatic Parts Washers", printed brochure, Sep. 1995.

(Continued)

*Primary Examiner*—Michael Barr
*Assistant Examiner*—Jason P Riggleman
(74) *Attorney, Agent, or Firm*—Christie, Parker & Hale, LLP

(57) ABSTRACT

An industrial washing machine for manufactured parts includes a cabinet with a support mounted in it to hold parts to be washed at any desired height to facilitate loading and unloading, and to permit the machine to hold parts of different sizes and shapes to increase its utility. A manifold in the cabinet sprays hot washing liquid on the parts, and includes a centrally located port so washing liquid can be sprayed longitudinally along the axis of rotation, and radially outwardly from the center of the cabinet. The load of parts being washed is supported by the manifold. A door with an adjustable latch seals the washer during the washing operation. A filtration system removes contaminants from the washing liquid, which is recycled for additional cleaning of parts. A pressure relief valve and a vent permit gas to flow from the cabinet when the pressure in the cabinet is at one value, and impedes flow of gas from the cabinet when the pressure is at a lower value. A coalescing and condensing chamber in the cabinet reduces the loss of washing liquid through the vent. A return drain collects washing liquid from around the cabinet door and returns it to a reservoir for the liquid in the cabinet. An improved thermally insulating shell around the cabinet conserves energy.

12 Claims, 60 Drawing Sheets

OTHER PUBLICATIONS

The Mart Corporation, "Tornado 40 High Profile", information regarding Power Blast Manifold (not dated), Maryland Heights, Missouri.

Walnut Grove Mfg. Inc., "Mini Jet Cleaner", printed specification page (not dated), Vancouver, Washington.

Precision Metal Works, "Power Spray Washer Model 110", printed specification and feature page, No. 003355, (not dated).

Better Engineering Mfg., Inc., "Jet Washing", printed information page (not dated), © 1992, Baltimore, Maryland.

JBI Industries, "Top Load Model PCS-TL2", printed specification, (not dated), Springfeld, Montana.

Equipment Manufacturing Corporation, "Automatic Parts Washers", catalog dated Apr. 1998, U.S.A.

* cited by examiner

FIG. 11
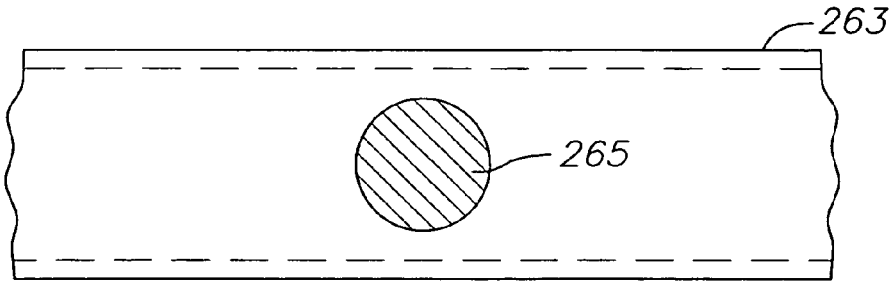
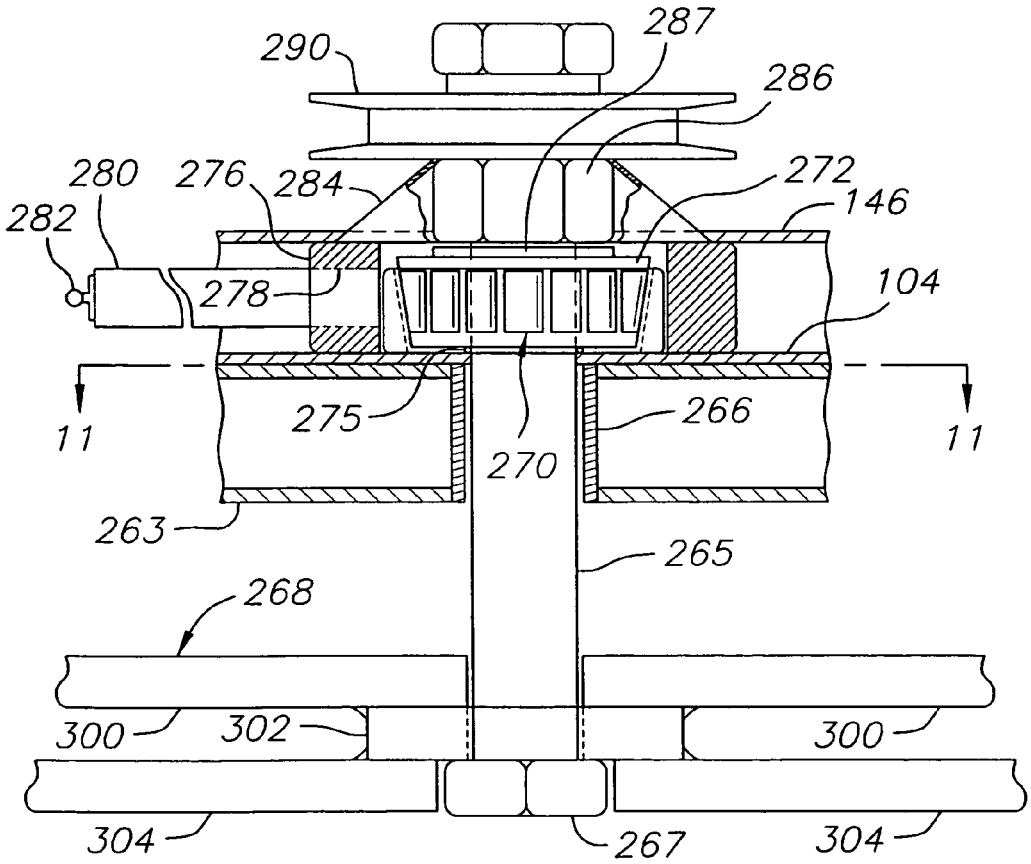
FIG. 10

FIG. 16
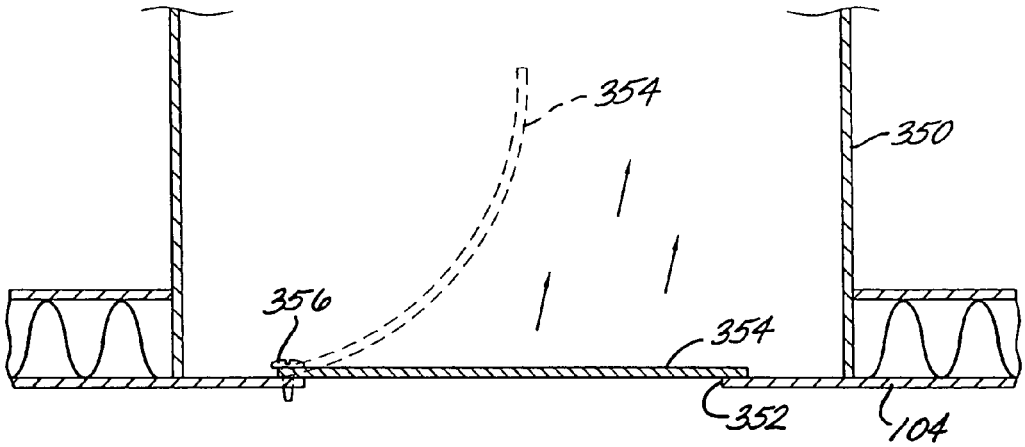
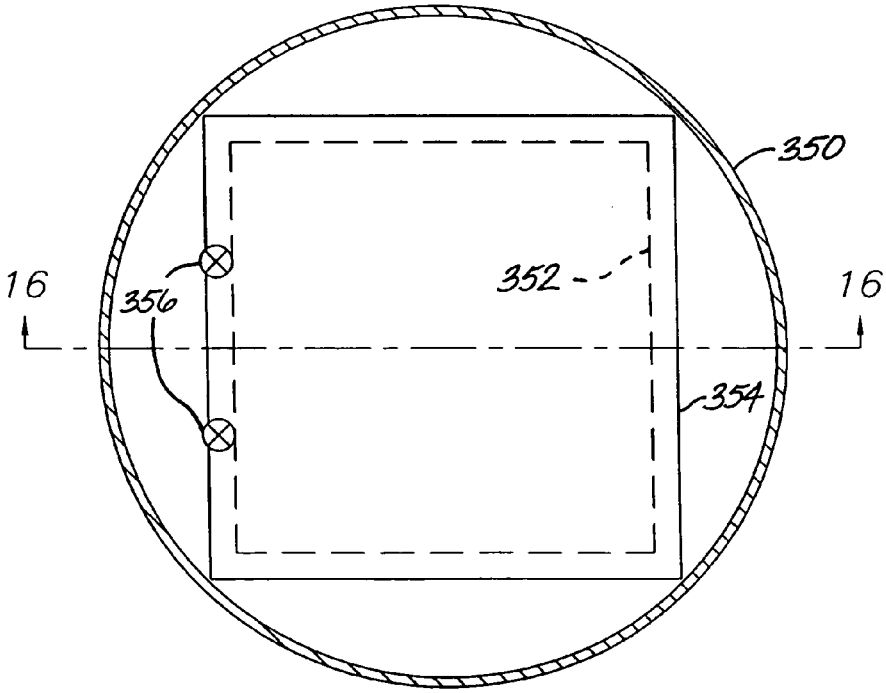
FIG. 15

FIG. 18
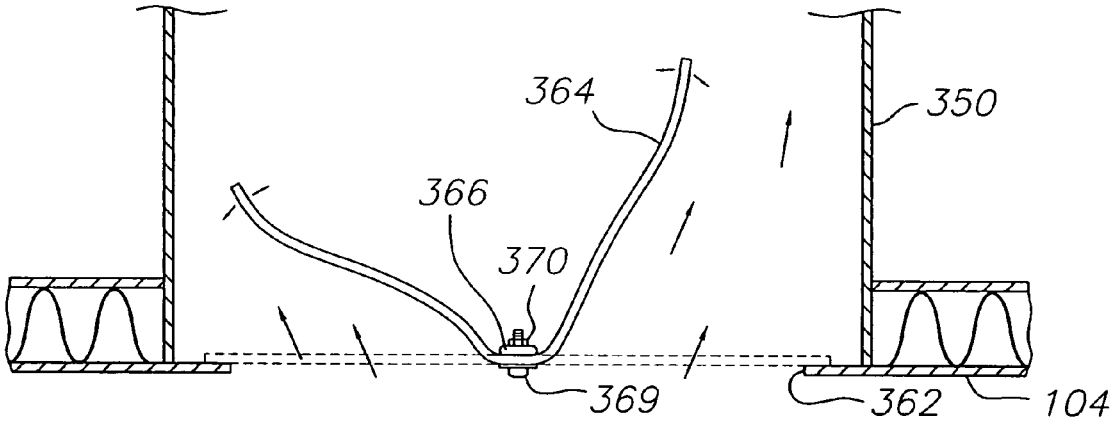
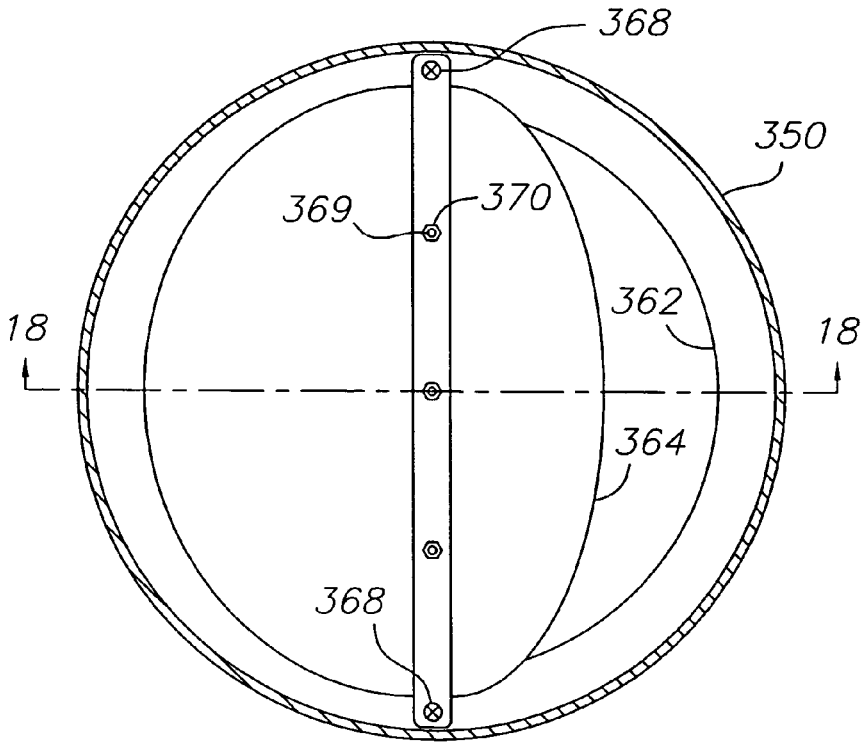
FIG. 17

FIG. 19
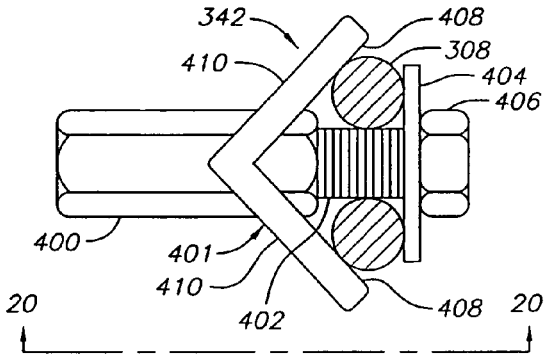
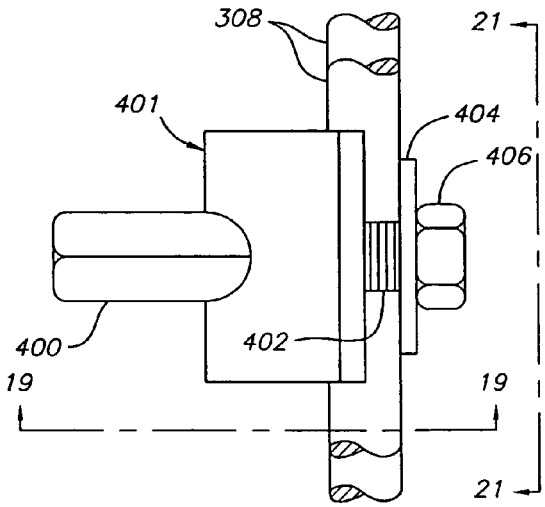
FIG. 20
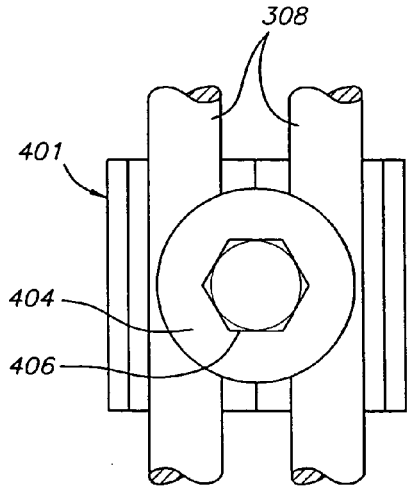
FIG. 21

FIG. 23
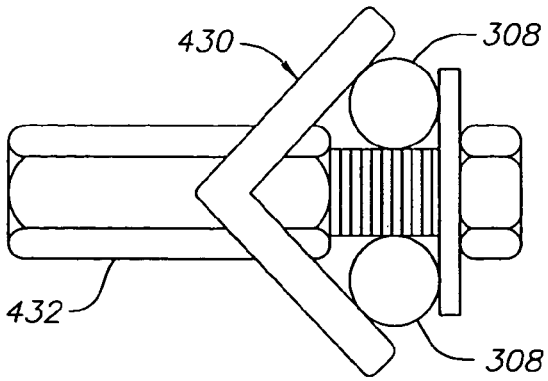
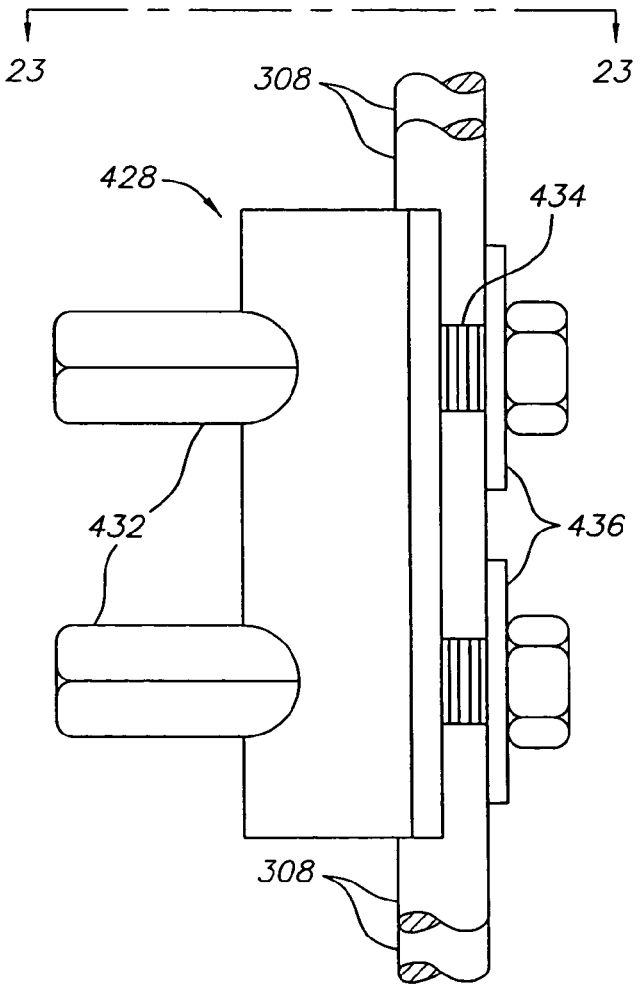
FIG. 22

FIG. 34
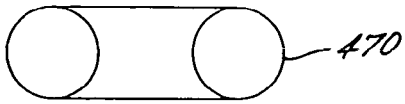
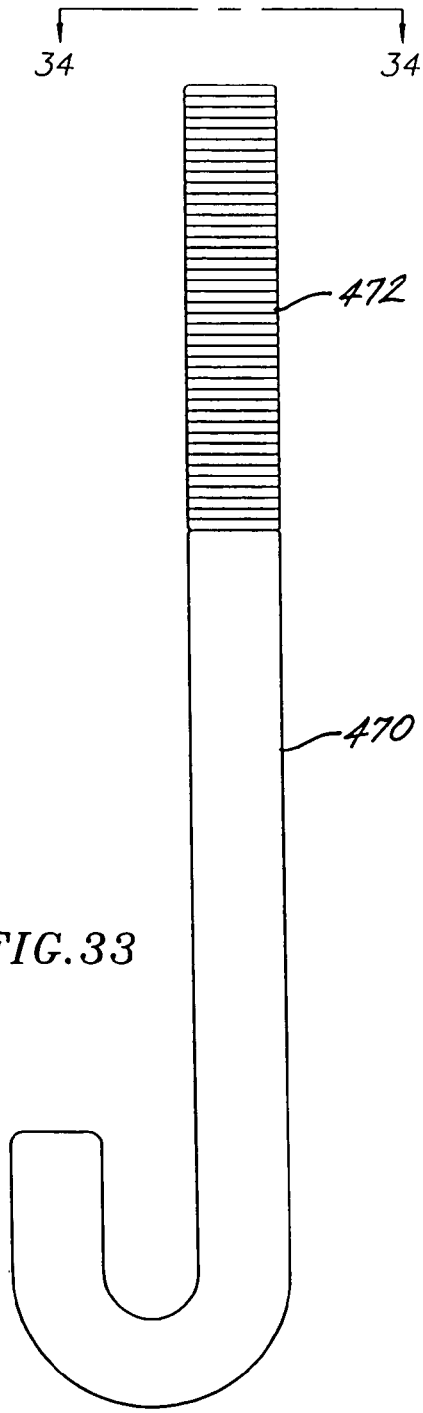
FIG. 33

CLEANING MACHINE

FIELD OF THE INVENTION

This invention relates to industrial cleaning machines used to wash various kinds of mechanical parts to remove oil, dirt, or other contaminants.

BACKGROUND OF THE INVENTION

Cleaning machines (parts washers) have been used for many years to clean various kinds of manufactured parts by spraying them with a heated washing liquid (usually a hot (150° F. to 175° F.) liquid of soap or other detergent and water) to remove oil, grease, grit, grime, or other contaminants. U.S. Pat. No. 6,115,541 discloses a parts washer, and is incorporated herein by reference. A typical parts washer has a turntable which holds parts and rotates about a vertical axis in an enclosed cabinet. A perforated manifold in the cabinet, and offset from the vertical axis, sprays washing liquid under high pressure against the parts to be washed. In some forms the manifold rotates about a vertical axis, and the parts remain stationary. These prior art machines do not do a good job in reaching the center of the axis of rotation. Consequently, there is a "dead" zone where little or inefficient washing action occurs. Moreover, the prior art machines cannot easily be modified to hold parts of different shapes and sizes. This often-requires a dedicated washer for each type of part to be washed. In addition, the turntable which holds parts to be washed is at a fixed height, which sometimes makes it difficult to load heavy or awkward parts into and out of a washing position. Another disadvantage of prior art industrial parts washers is that they emit a spray of hot washing liquid at the start of a cleaning cycle. This not only wastes heat and washing liquid, but often requires expensive installation of a duct to carry the spray outside the shop or building when the washer is operated.

SUMMARY OF THE INVENTION

This invention provides an improved cleaning machine which is less expensive to manufacture, more efficient and safer to operate, and easier to use than previous machines. In one preferred form, the invention includes a thermally insulated cabinet with a thermally insulated front door and an upright support in the cabinet. Preferably, the support includes a rotor having an upper end connected to a drive shaft supported by a thrust bearing from the top of the cabinet to be rotatable about vertical axis in the center of the cabinet. At least one vertically adjustable stop is secured to the support to hold parts to be washed at different vertically spaced locations in the cabinet. A manifold in the cabinet sprays a washing liquid on the parts, and a drive mechanism rotates the support and manifold relative to each other about a substantially vertical axis of rotation in the cabinet. In one arrangement, a plurality of vertically adjustable stops are secured to the support to hold platforms at different levels so a plurality of parts can be held in the washer at different vertical locations for simultaneous washing to increase the capacity of the machine. Alternatively, selected stops on the support are used to hold a heavy part at a convenient height for loading and unloading.

Preferably, a layer of thermal insulation is sandwiched between outside surfaces of the cabinet and interior surfaces of a shell disposed around and spaced from the cabinet. A frame secured to the washer holds the shell out of contact with the cabinet to minimize heat loss.

In a presently preferred embodiment of the invention a substantially horizontal lower section of the manifold passes through the axis of rotation, and a lateral conduit opens upwardly from the manifold in a direction substantially collinear with the axis of rotation, and toward the central part of the cabinet. A removable closure in the conduit permits the conduit to be used when desired for spraying washing liquid into the central part of the cabinet, thus eliminating the "dead" zone found in many prior art cleaning machines. Each end of a substantially horizontal upper section of the manifold is connected to a respective upper end of a separate upright side section of the manifold. The lower end of each side section is connected to a respective end of the horizontal lower section of the manifold. Manifold outlets deliver powerful streams of washing liquid directly at the axis of rotation of the support, or, more preferably, offset slightly from the axis so that spray from one side of the manifold strikes the parts being washed at a slightly different angle from that of the other side for better cleaning without losing impact power due to an excessively "glancing" blow as with previous washers.

Preferably, the support is suspended from the upper section of the manifold, which also passes through the axis of rotation. The manifold is secured to the interior of the cabinet to provide structural support as part of the cabinet framing. This simplifies construction of the machine, and reduces cost.

In one form of the invention, the support rotates within the cabinet. In another form, the manifold rotates around the support. In yet another form, the upright support includes a threaded section which carries a stop nut that can be rotated to move the nut up and down the threaded section to support a platform or table, or other fixture or attaching accessory for holding parts to be washed at a position in the cabinet determined by the location of the stop nut. In another preferred form of the invention, the support includes a rotor with vertical and horizontal bars, and the adjustable stop includes clamps releasably secured to the bars so the clamps can be moved up and down or horizontally to hold platforms or fixtures in desired positions. Various types of part-supporting fixtures are attached to the clamp for holding different kinds of parts to be washed.

One preferred type of fixture includes mutually transverse coupling nuts secured to each other and the clamp so various fixtures can be threaded into the coupling nuts to provide desired configurations for supporting different kinds of parts. For example, the clamps or coupling nuts can be connected to hanging fixtures, V-shaped and U-shaped propping fixtures, locating pins, hooks, and bolt-through lever arms with adjustable stops.

In another preferred version of the invention, a swing-out platform is mounted on the upright support to pivot about an upright axis to facilitate loading parts to be washed. In another form, a roller-topped table on the support is at the same height as a roller-top roll-on cart to facilitate transferring heavy parts into and out of the machine. In yet another form of the invention, a swivel pipe with an L-joint is connected to the lateral conduit of the manifold, and provided with jets for washing parts with blind cavities or other areas which are difficult to reach. In another form of the invention, a standpipe connected to the lateral conduit, and provided with perforations sprays liquid upwardly and outwardly onto a surrounding part, such as a greasy hub. An outwardly extending brush on the standpipe expedites cleaning by contacting the interior of the hub as the hub is rotated around the standpipe.

A swivel hose can also be connected at one end to the lateral conduit, and the other end of the swivel hose can be connected to the oil-feed galleries in a typical engine block so that the galleries are cleaned at the same time the exterior of the engine block is washed by spray from the surrounding manifold.

The invention also provides a unique adjustable door latch and door seal for confining washing liquid in the cabinet during the washing operation. A unique vent with a pressure relief valve is also provided for venting the machine and conserving heat. A coalescing chamber for condensing water vapor and collecting water droplets in the cabinet is connected to the vent to minimize loss of heat and water when the machine starts a wash cycle. This avoids the need for an expensive plumbing installation previously required to vent the water vapor and droplets to the atmosphere outside the building in which the parts washer operates. An improved filtration and circulating system and return drain for the hot washing liquid is also provided for greater operating efficiency and conservation of energy.

BRIEF DESCRIPTION OF THE DRAWINGS

FIG. 10 is a fragmentary sectional elevation of the support mounted in the cabinet and suspended from the upper section of the manifold;

FIG. 11 is a fragmentary view taken on line 11-11 of FIG. 10;

FIG. 15 is a view taken on line 15-15 of FIG. 1 showing a vent and pressure relief valve from the top of the parts washer;

FIG. 16 is a view taken on line 16-16 of FIG. 15;

FIG. 17 is a view similar to that of FIG. 15 showing an alternate embodiment of a vent and pressure relief valve from the top of the parts washer;

FIG. 18 is a view taken on line 18-18 of FIG. 17;

FIG. 19 is a view taken on line 19-19 of FIG. 20, showing a clamp secured to the rotor;

FIG. 20 is a view taken on line 20-20 of FIG. 19;

FIG. 21 is a view taken on line 21-21 of FIG. 20;

FIG. 22 is an elevation of an alternate embodiment of a clamp used on the rotor;

FIG. 23 is a view taken on line 23-23 of FIG. 22;

FIG. 33 is an elevation of a J-hook used to secure parts to be washed to the rotor;

FIG. 34 is a view taken on line 34-34 of FIG. 33;

DETAILED DESCRIPTION OF THE INVENTION

Figure 1:
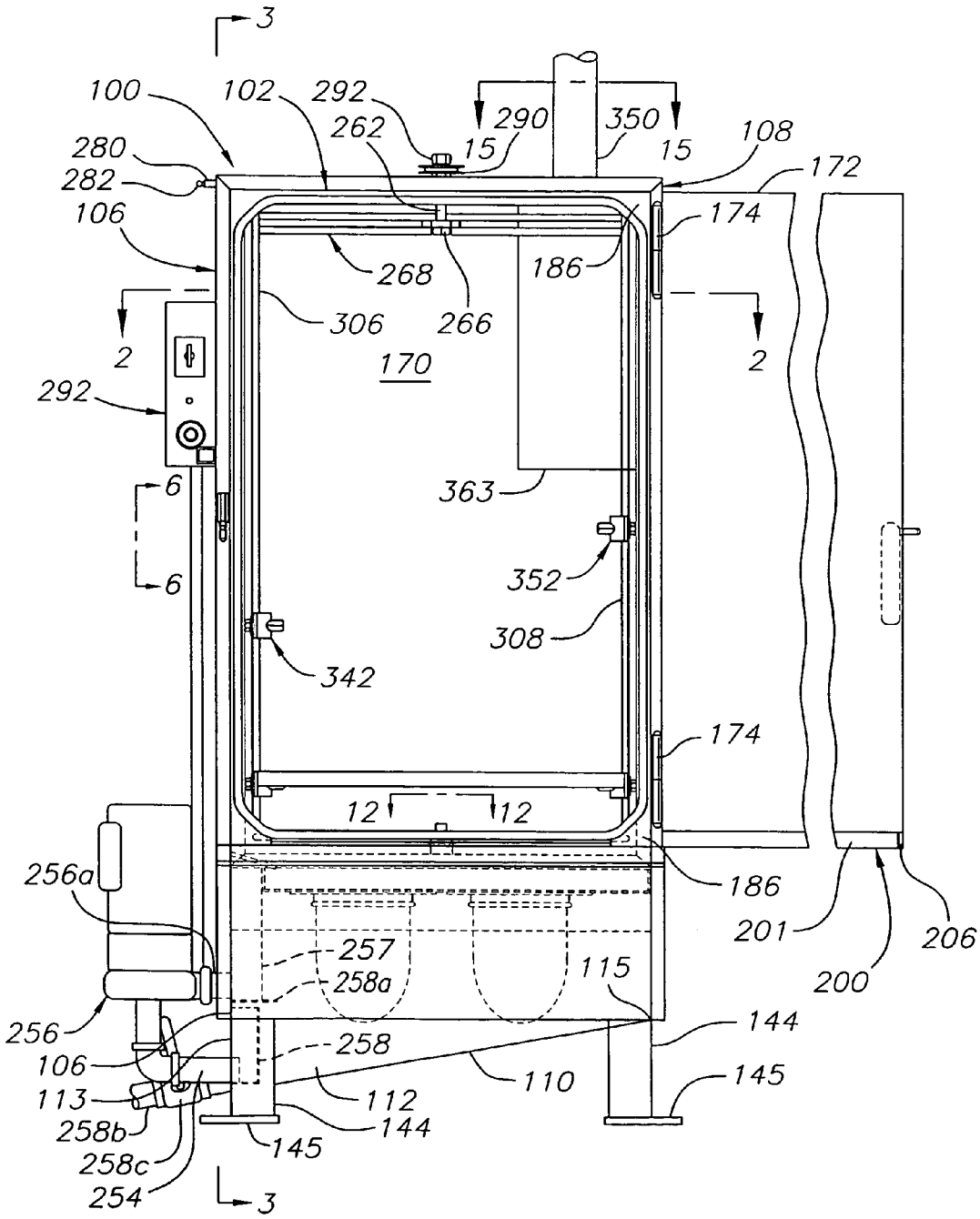
FIG. 1 is a front elevation of a parts washer made in accordance with this invention.
Figure 2:
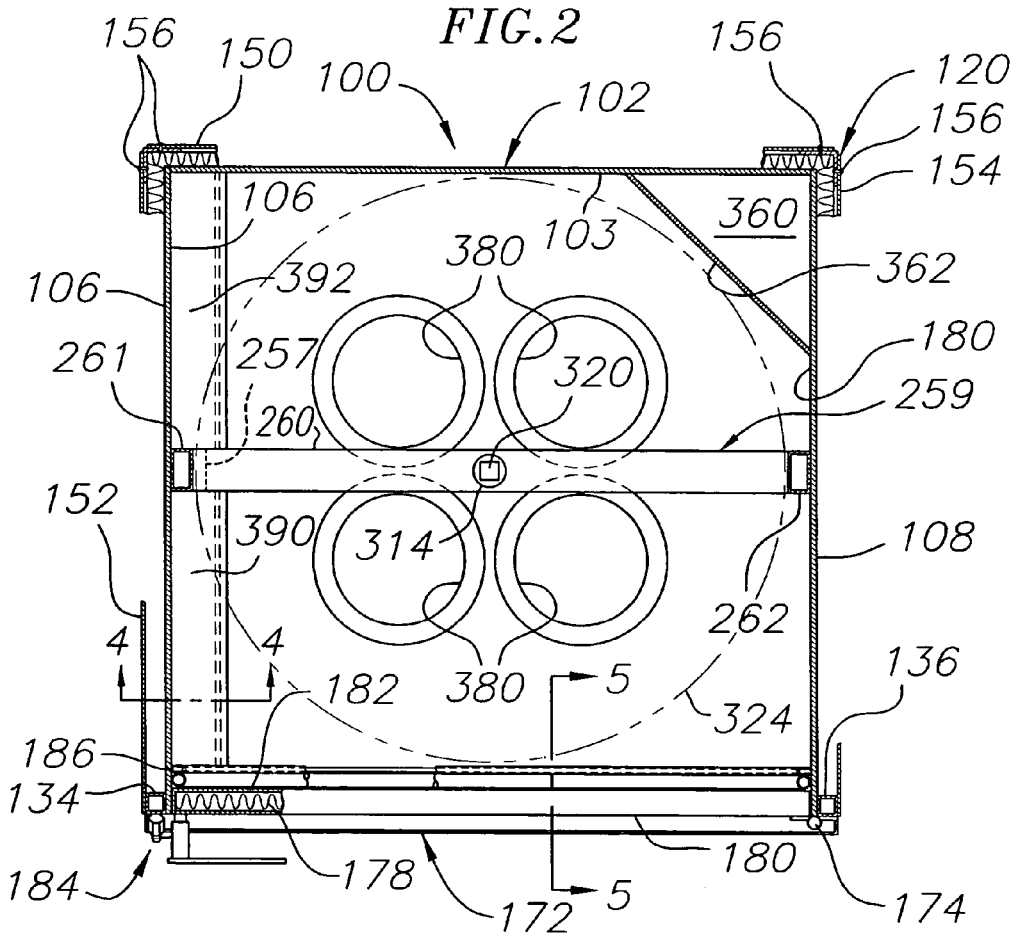
FIG. 2 is a view taken on line 2-2 of FIG. 1, omitting the rotor and components mounted on the exterior of the cabinet.
Figure 3:
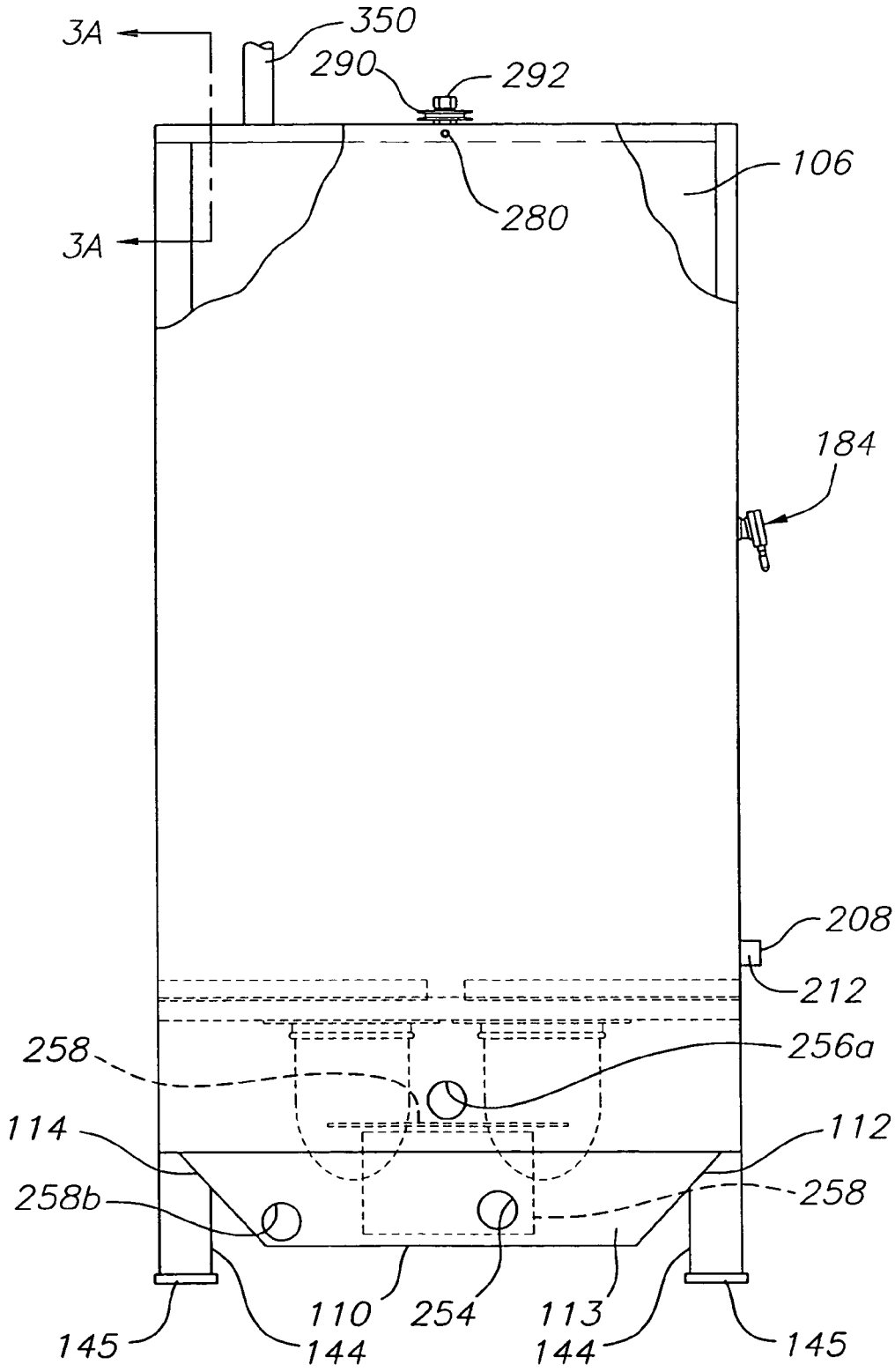
FIG. 3 is a view, partly broken away, taken on line 3-3 of FIG. 1.
Figure 5:
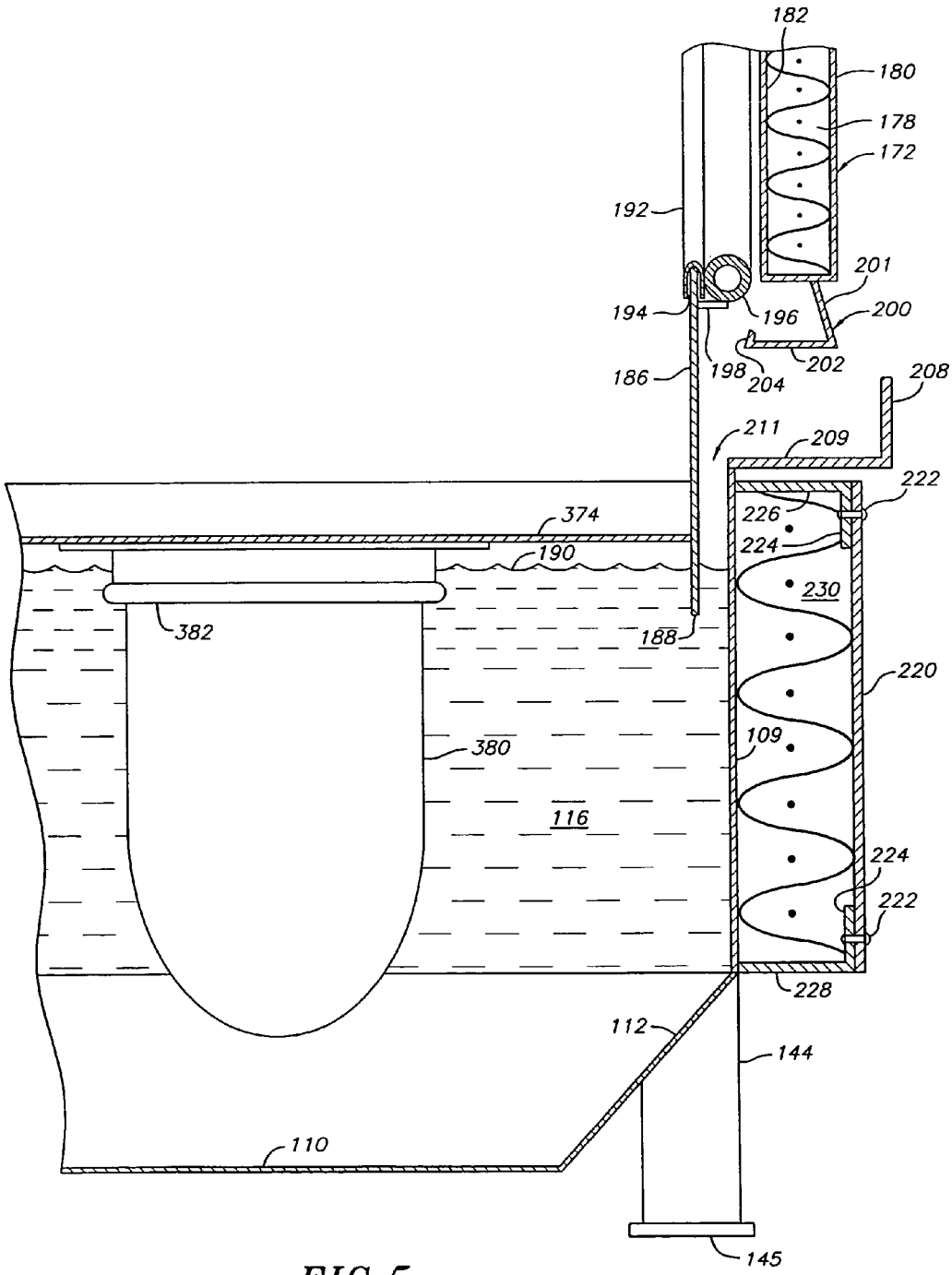
FIG. 5 is a fragmentary view taken on line 5-5 of FIG. 2.
Figure 6:
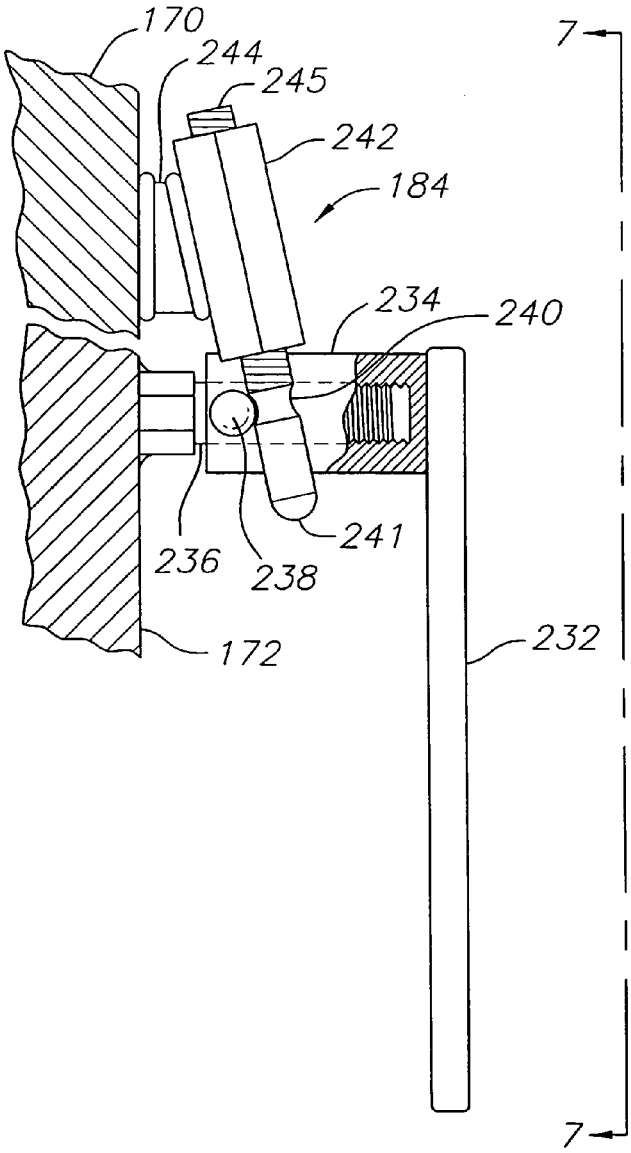
FIG. 6 is an enlarged view, partly in cross section, taken on line 6-6 of FIG. 1 showing an adjustable latch for securing the door in a closed position.
Figure 7:
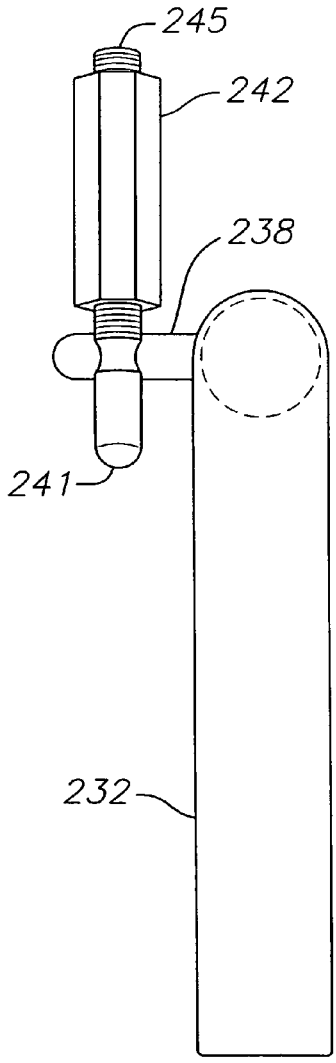
FIG. 7 is a view taken on line 7-7 of FIG. 6.

Referring to FIGS. 1, 2, 3, 3A, and 3B, a parts washing machine 100 made in accordance with this invention includes an upright rectangular cabinet 102 which has a back wall 103, a top wall 104, a left (as viewed in FIG. 3A) sidewall 106, and a right side wall 108. As shown in FIG. 5, the cabinet has a front wall 109, and a bottom wall 110 which slopes downwardly from right to left (as viewed in FIG. 1). As shown in FIG. 3, upwardly and outwardly extending front and back sections 112 and 114, respectively, of the bottom wall are bonded (preferably welded) to the respective lower edges of the front and back walls of the cabinet. The left (as viewed in FIG. 1) edge of bottom wall 110 includes a vertical section 113 welded to the lower edge of left side wall 106, and the right edge of the bottom wall is welded to the lower edge 115 of right side wall 108 to form a watertight reservoir 116 (FIG. 5) in the bottom of the cabinet.

Figure 1A:
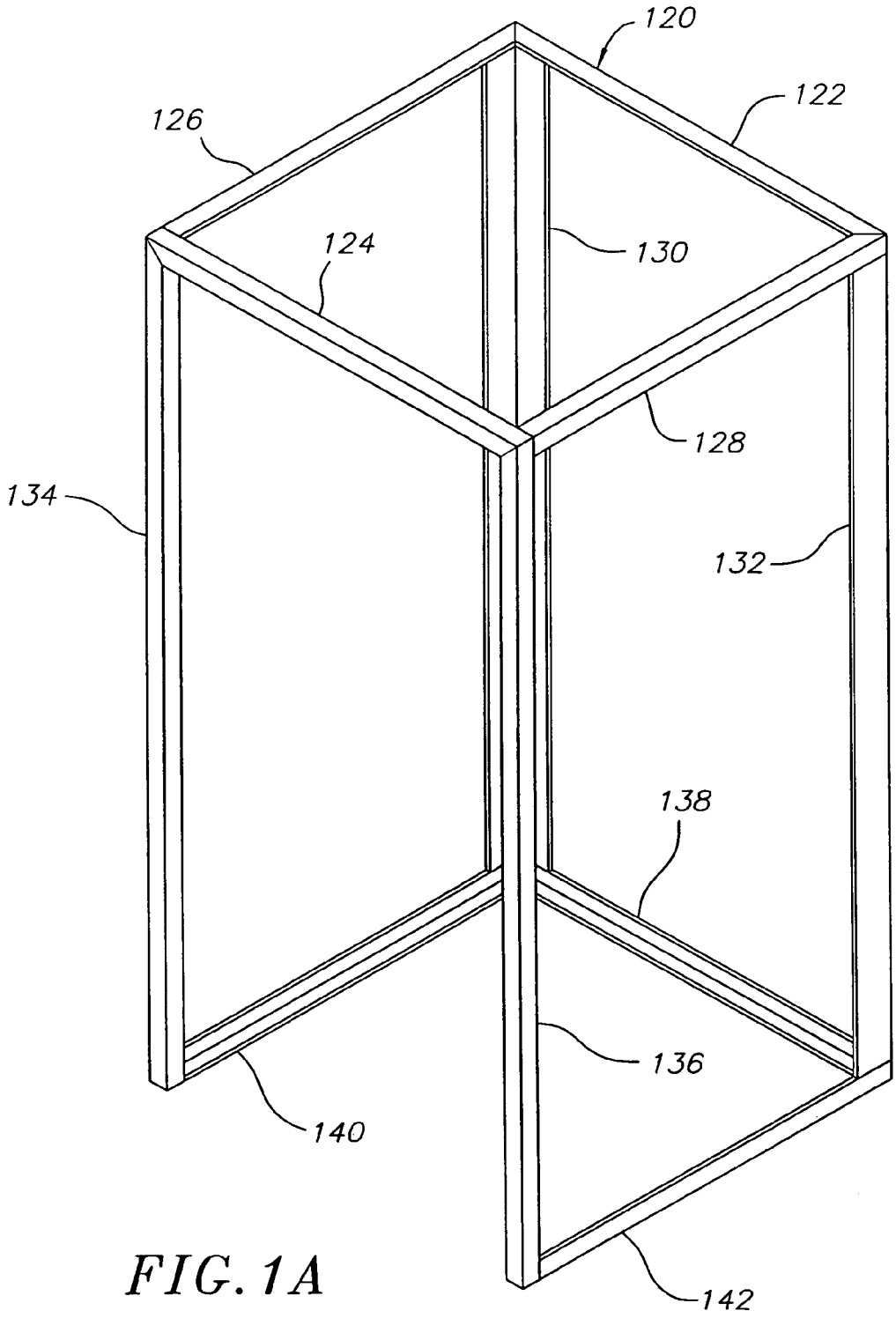
FIG. 1A is a fragmentary perspective view of the frame which supports the insulating shell surrounding the cabinet.

FIG. 1A shows a frame 120 which is disposed around and spaced from the upper portion of the cabinet, which is not shown in FIG. 1A for clarity. The frame includes an upper rear member 122, an upper front member 124, an upper left side member 126, and an upper right side member 128. The upper members are substantially the same length, and lie in a common horizontal plane. The upper ends of left and rear vertical members 130, 132, respectively are connected to the left and right rear corners of the upper end of the frame formed by upper members. The upper ends of left and right front vertical members 134, 136 are each respectively bonded to the respective left and right front corners of the upper end of the frame formed by upper members. The left and right ends of a lower horizontal rear member 138 are respectively bonded to the lower ends of the left and right vertical members 130 and 132. The rear ends of lower left and lower right horizontal members 140, 142, are respectively bonded to the lower ends of the left and right rear vertical members. The front ends of members 140 and 142 are bonded to the rear faces of front vertical members 134, 136, respectively. The lower ends of the vertical members 134 and 136, and the lower surfaces of members 138, 140 and 142 all lie in a common horizontal plane. The lower members are substantially the same length as the upper members so the frame is substantially square in cross-section as viewed from above, and as shown in FIG. 2.

Figure 3A:
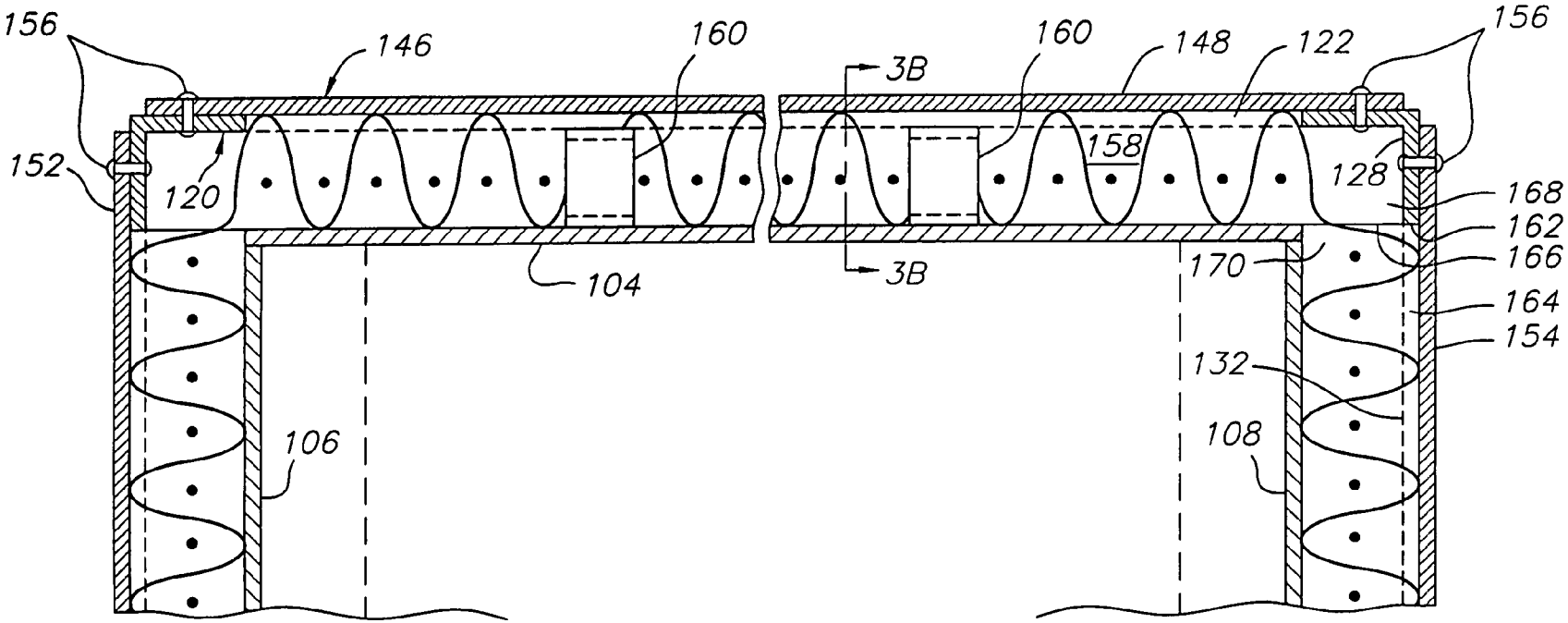
FIG. 3A is a view taken on line 3A-3A of FIG. 3.
Figure 3B:
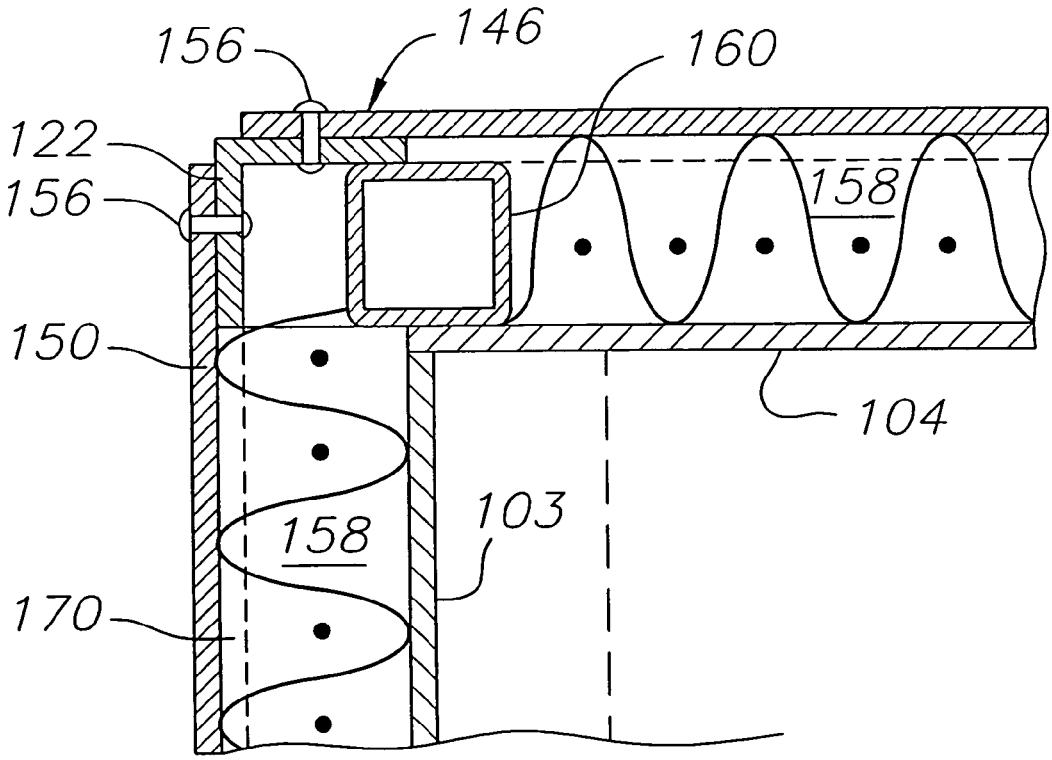
FIG. 3B is a fragmentary view taken on line 3B-3B of FIG. 3A.

The lower edges of the front, back and side walls are each bonded to the upper end of a respective vertical leg 144 (FIGS. 1 and 3). Each leg is a section of box tube with vertical walls disposed so each leg has a wall coplanar with a respective wall of the cabinet, each of which rests on, and is welded to, the upper edge of a respective flange. A separate horizontal, outwardly extending pad 145 is welded to the lower end of each leg for increased stability and to spread the load of the parts washer over a suitable area of the floor (not shown) on which the washer rests. As shown in FIGS. 2, 3A, and 3B, the frame 120 is spaced from the outer walls of the upper, front, and side walls of the cabinet. A shell 146 includes top, back, and left and right side walls 148, 150, 152, and 154, respectively, attached to adjacent frame numbers with blind rivets 156. A layer of thermal insulation 158 is disposed in the space between adjacent faces of the walls of the cabinet and the surrounding shell. Upper edges of the cabinet are fastened to adjacent portions of the frame by spacing brackets 160 to stabilize the position of the cabinet within the shell. Conveniently, the brackets 160 are made of short pieces of box steel tubing. The cabinet, shell, and frame can be of any suitable material. For example, the walls of the cabinet are made of 12 gauge steel sheet metal, and the walls of the shell are made of 16 gauge sheets of the same material. The frame is also preferably made of steel. For example, the rear vertical members are each sections of 2"×2" angle iron, the upper rear, left and right, and lower rear, left and right horizontal members are each 1"×1" angle iron. The upper front horizontal member, and left and right front vertical members are each 1"×1" box tubing.

Referring to FIGS. 1A, 3A, and 3B, the lower edge 162 of the upper right side member 128 of the frame rests on, and is welded to the upper edge of the forward extending part 164 of the right rear vertical member 132. In a similar arrangement, the lower edge 166 of the downwardly extending flange 168 of the upper rear member 122 is welded to the upper edge of the inwardly extending flange 170 of the right rear vertical member 132. As shown in FIG. 1A, the adjacent ends of the upper rear and upper right side members 122, 128 are mitered to accommodate the structure just described. The rear end of the upper left member and the left end of the upper rear member are mitered and bonded together on the upper end of the left rear vertical member 130, in the same manner as just described for the right rear vertical member. The front ends of the upper left and right members 126, 128 are each respectively welded to the inner face of the left and right ends of the upper front member 124 so the upper surfaces of the upper rear, left, right and front members all lie in a common horizontal plane.

The upper ends of the left and right front vertical members 134, 136 are each mitered to make a smooth fit with the mitered left and right ends, respectively, of the upper front member 124, all of which are welded together so the front faces of the left and right front vertical members and the upper front member lie in a common vertical plane, and so the faces of the members parallel to the right and left sides of the frame members lie in respective common left and right vertical planes.

As shown in FIG. 2, the front edges of the left and right side walls 106, 108 of the cabinet are welded to the respective inner faces of the left and right front vertical members 134, 136 so the front edge of the side walls lie in the same vertical plane as the front faces of those vertical members. The front edge of the top wall 104 (FIG. 3A) of the cabinet is welded to the lower face of the upper front member 124 (FIG. 1A, which shows only upper front member 124, but not top wall 104) so the front edge of the top wall is flush with the front vertical face of upper front member 124. Adjacent edges of the top, back, side, front and bottom walls are welded together to form watertight joints along their entire respective lengths.

Front wall 109 is welded to the inner faces of the left and right sidewalls 106 and 108, respectively. The upper edge of the front wall 109 (FIG. 5) of the cabinet is horizontal and terminates at a height about one fourth that of the parts washing machine, leaving substantially all of the rest of the front of the cabinet open as a doorway 170 (FIG. 1), which can be opened and closed by a door 172 secured at its right (as viewed in FIG. 1) edge by a pair of vertically spaced hinges 174 to the right front vertical member 136. As shown in FIGS. 2 and 5, the door has a layer of thermal insulation 178 secured between a pair of front and rear panels 180, 182, respectively. A door handle and latch mechanism 184 at the left side of the door facilitates sealing the door in a closed position as described in more detail below.

An inwardly extending annular flange 186 lies in a vertical plane slightly to the rear of front wall 109 (FIGS. 1 and 5), and is welded around its top and side edges to the interior surfaces of the top and side walls. The inner periphery of the annular flange defines the doorway 170. A horizontal lower edge 188 of the flange lies below a normal operating level 190 for hot washing liquid in the reservoir 116, and acts as a return drain baffle.

As shown in FIGS. 1, 2 and 5, a single-piece annular gasket 192 includes an outwardly opening slot 194 which makes a snug fit over the inner edge of the annular flange 186, and carries an outwardly facing tubular section 196, which rests on an outwardly extending annular shelf 198 welded to the front face of the flange. As shown in FIG. 1, the inner edge of the flange at the corners of the doorway is rounded to present a smooth curved surface so the single-piece gasket fits smoothly around the entire periphery of the annular flange without creating any wrinkles or kinks.

As shown best in FIGS. 1 and 5, an upwardly opening horizontal gutter 200 includes a front wall 201, the upper edge of which is welded to the lower edge of the door. A horizontal section 202 extends from the lower edge of wall 201 and terminates at its rear edge in an upwardly extending short wall 204. The end of the gutter 200 remote from the hinged edge of the door is closed by a vertical wall 206 (FIG. 1). The other end of the gutter is open so that liquid collected in it drains toward the hinged edge of the door and into an L-shaped trough 208 having a horizontal section 209 welded to the upper edge of front wall 109 so that liquid collected in the trough drains into a vertical space 211 formed between the rear face of front wall 109 in the forward face of flange 186. Each end of the trough is closed by a separate respective plate 212 (FIG. 3). The vertical space 211 forms a drain for returning liquid from the exterior of the cabinet to the location below the normal operating level 190 of the washing liquid in the reservoir 116. The lower edge 188 of the flange extends a sufficient distance (say at least several inches) below the normal operating level of washing liquid in the reservoir to provide a water seal which prevents a draft of cold air through the cabinet.

A shown in FIG. 5, a shell front wall 220 is fastened by blind rivets 222 to vertical flanges 224 of upper and lower horizontal L-shaped steel strips 226, 228, respectively, welded to the front face of the front wall 109 so the flanges 224 are spaced from the front wall, and extend toward each other. A layer 230 of thermal insulating material is disposed in the space between front wall 109 of the cabinet and front wall 220 of the shell.

Referring to FIGS. 1, 2, 6 and 7, the door handle and latch assembly 184 includes a flat handle 232 which lies in a substantially vertical plane, and carries a horizontally extending internally threaded collar 234 at one end. A forwardly extending horizontal threaded bolt 236 is welded at its rear end to the front face of the cabinet door 172. A laterally extending cylindrical locking pin 238 is welded at one end to the rear end of the internally threaded collar, which is threaded on to the bolt 236 so that the locking pin 238 makes a snug fit in an annular external groove 240 in a retaining screw 241 which extends upwardly and inwardly into an internally threaded coupling nut 242 welded to a mounting bracket 244, which is welded to the front face of the cabinet adjacent the doorway 170. With the door in the latched position shown in FIGS. 6 and 7, the inner face of the door makes a snug fit against the annular bulb 196 (FIG. 5) of the gasket, and compresses the gasket into a sealing position so that no liquid can flow through the door when the door is in the closed and latched position. The amount of compression exerted by the door latch is easily adjustable by unlatching the door, swinging it partially open, and then rotating the handle strap and internally threaded collar to adjust the position of the laterally extending latching pin 238 to the desired distance from the front of the door. Moreover, the exact position of the annular detent groove 240 on the retaining screw 241 can be precisely adjusted by rotating the screw into and out of the coupling nut 242. An allen screw 245 in the end of threaded coupling nut 242 remote from the retaining screw 241 locks the retaining screw in the desired position in coupling nut 242. An alternate preferred embodiment of a door latch assembly is described below with respect to FIGS. 69 and 70.

Washing liquid in the reservoir 116 is heated by an immersion heater (not shown), which may be of the type disclosed in U.S. Pat. No. 6,115,541. Hot washing liquid is circulated from the reservoir through an L-shaped inlet pipe 254 (FIG. 1) sealed through vertical section 113 at the left side of the reservoir, and connected to the inlet of a centrifugal pump 256 mounted on the exterior of the lower left side of the cabinet. A discharge pipe 256*a* connected to the pump outlet is sealed through the lower left side of the cabinet, and delivers hot washing liquid under pressure to the lower end of a vertical riser 257 welded to the inside face of the cabinet left side wall. The inlet end of inlet pipe 254 is connected to the bottom of a sump box 258 mounted on the inner face of vertical section 113 at the left end of the reservoir. As shown in FIG. 3, the sump box is in the center of section 113, with the bottom of the box adjacent the lower edge of section 113. As shown in FIG. 1, the sump box is open at its top so that washing solution can flow into the box and down into inlet pipe 254. A horizontal sump baffle 258*a* is welded at its left (as viewed in FIG. 1) edge to the inner face of left side wall 106 a slight distance above the open upper end of the sump box. The sump baffle projects slightly beyond the upper edges of the sump box to prevent particles from inadvertently entering the sump box, such as when filter bags (described in detail below) are removed for cleaning or replacement. A drain line 258 behind the sump box extends from the bottom of the left end of the reservoir through the vertical section 113 at the left edge of the bottom wall 110. A ball valve 258*c* in the drain line is opened when the reservoir is to be cleaned.

Figure 8:
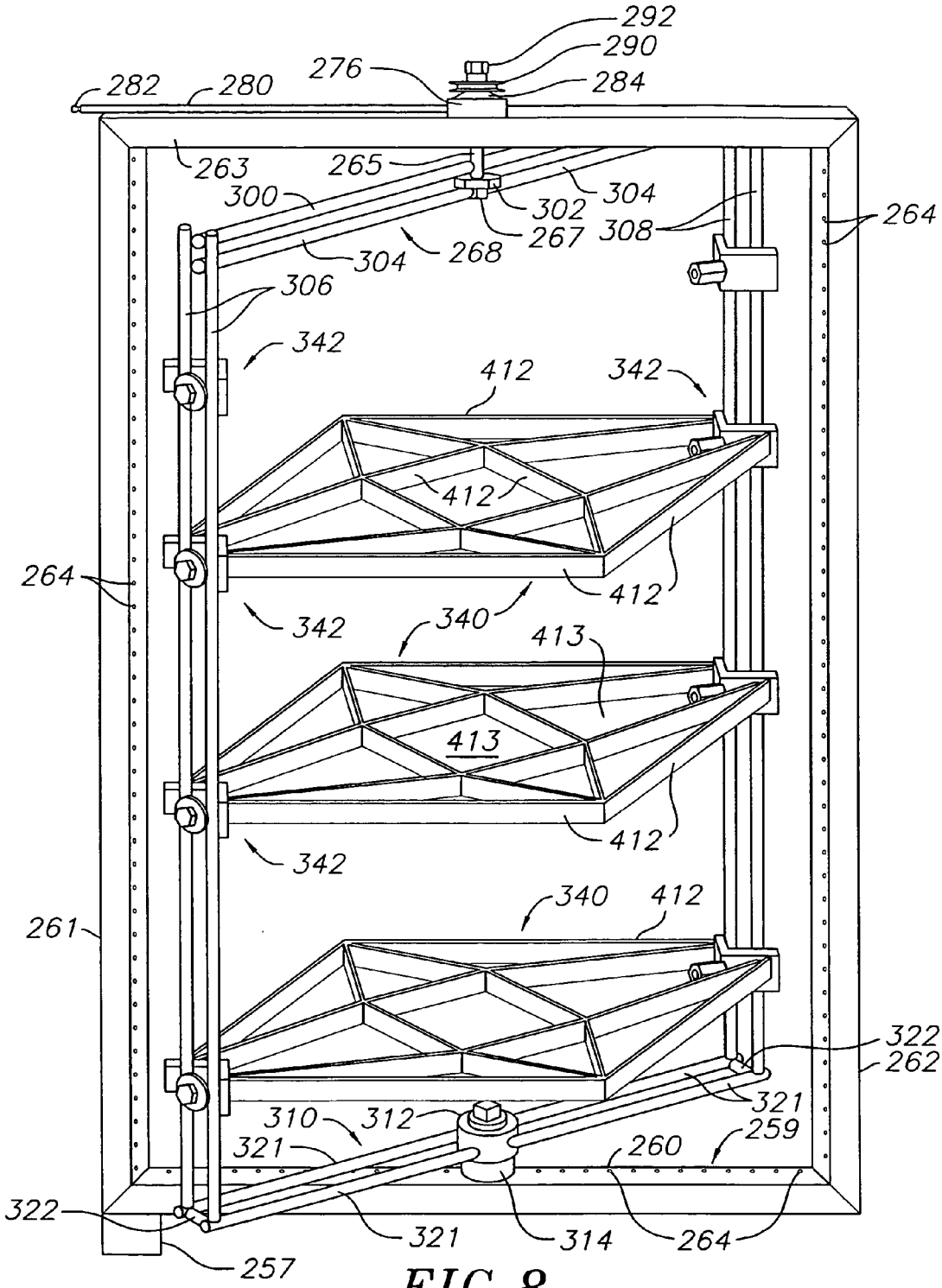
FIG. 8 is a perspective view of the support (rotor and drive shaft), suspended by a bearing from the manifold to be rotatable about a vertical axis within the parts washer cabinet (not shown in FIG. 8 for clarity)
Figure 12:
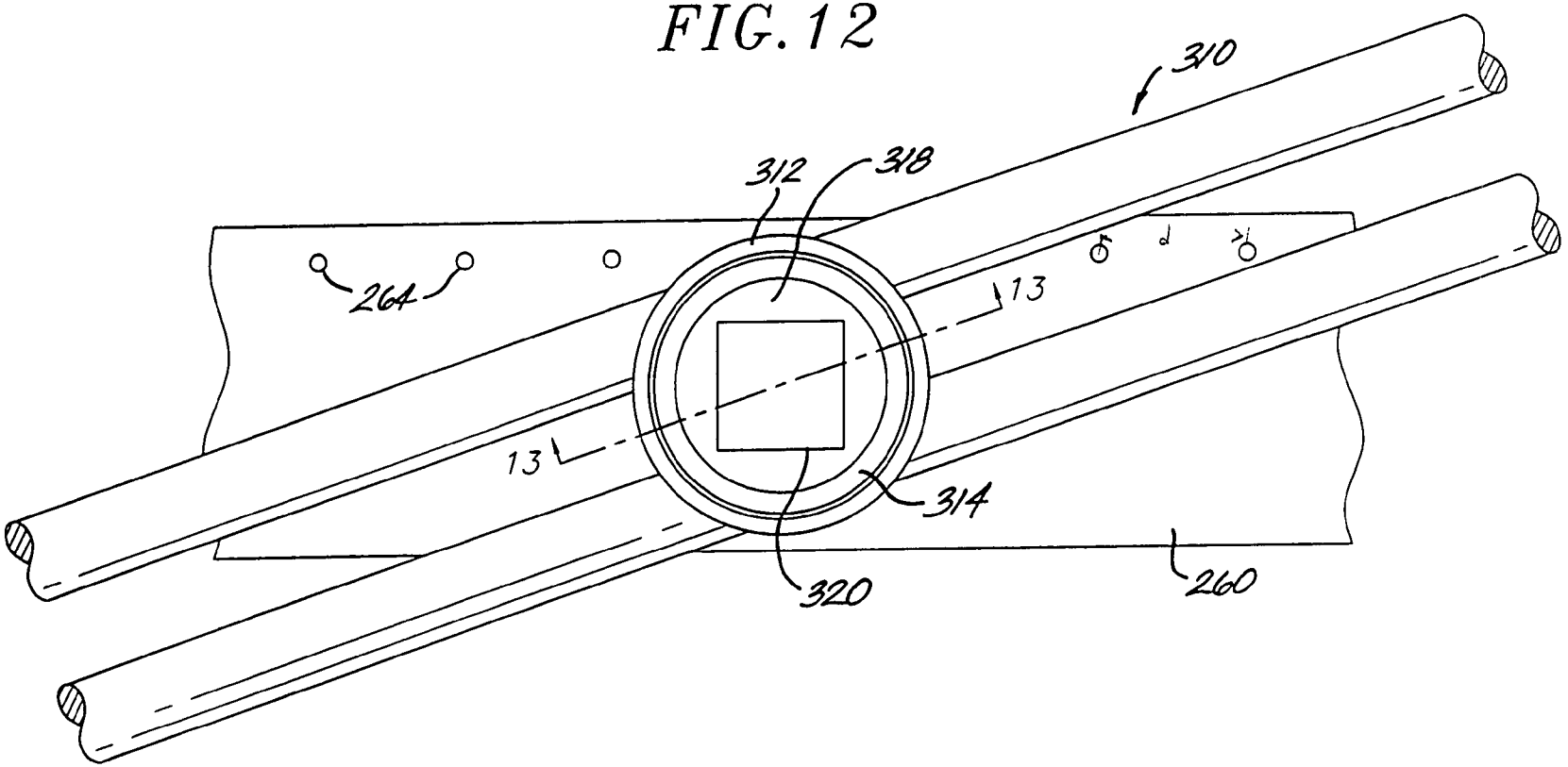
FIG. 12 is a fragmentary view taken on line 12-12 of FIG. 1, showing the central portion of the lower section of the manifold.
Figure 14:
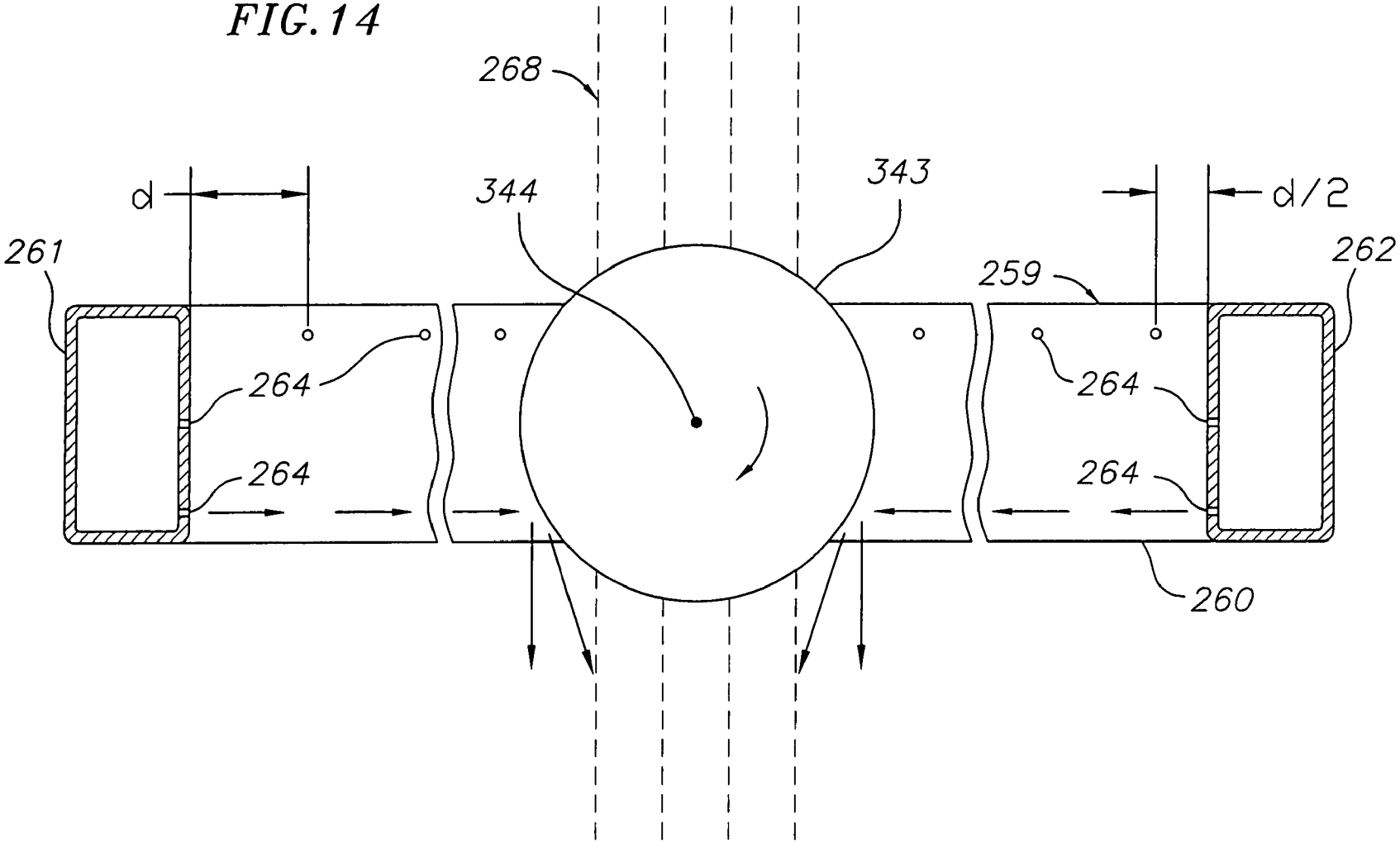
FIG. 14 is a view similar to that of FIG. 12 showing a dirty part mounted in the parts washer for washing with streams aimed slightly off the axis of rotor rotation so streams from the left side strike the dirty part at an angle different from those streams from the right side.

As shown in FIG. 2, the cabinet in plan view is approximately square, but for reasons explained below, the vertical riser 257 is located slightly to the rear of midpoint of the left side wall. The upper end of the riser is connected (as best shown in FIG. 8) to the lower left corner of a manifold 259 laid out in the shape of a vertically disposed rectangle, and having a horizontal lower section 260 connected at each end to a respective lower end of a vertical left and right side sections 261 and 262, respectively. The left and right side sections of the manifold are respectively welded to the interior surface of the left and right sidewalls 106 and 108 (see FIG. 2). The upper end of each of the left and right side sections of the manifold are respectively welded to the left and right ends of a horizontal upper section 263 of the manifold. The riser 257 and manifold sections can be of any suitable material or size. I presently prefer that they be made of steel rectangular tubing. For example, the riser in a presently preferred form is 2"×2", and each of the manifold sections is 1"×2". As shown in FIG. 8, the ends of the manifold sections are beveled so they fit smoothly together. As shown in FIGS. 8, 12 and 14, the manifold sections include a series of longitudinally spaced apertures 264 for directing powerful streams of washing liquid into the center of the cabinet.

Referring to FIGS. 8-11, a vertical rotatable support shaft 265 makes a loose sliding fit through a vertical sleeve 266 (FIG. 10) which extends through the center of the upper section 263 of the manifold. As shown in FIG. 11, the outer diameter of sleeve 266 is less than the interior transverse dimension of upper section 263 of the manifold, and is welded to the upper and lower walls of the upper section 263 of the manifold to provide a watertight connection which permits washing liquid to flow in either direction through the upper section of the manifold and around the sleeve. The lower end of the rotatable support shaft 265 includes a bolt head 267 from which is suspended a rotor 268 described in more detail below. The support shaft 265 extends up through collinear openings in the cabinet top wall 104 and the shell top wall 146, and makes a close sliding fit in the opening in the cabinet top wall. A thrust bearing 270 disposed around the support shaft 265 includes an inner race 272 and an outer race 274 which rests on the upper surface of the top wall 104 of the cabinet. An O-ring 275 seals around the rotatable support shaft, and against the cabinet top wall and the thrust bearing. An annular shaft collar 276 surrounds the thrust bearing, and includes a horizontal threaded bore 278 which receives the threaded inner end of a horizontal pipe 280 disposed between the top walls of the cabinet and shell. The pipe 280 extends out through the left side wall of the shell, and carries a fitting 282 which permits grease to be injected into the thrust bearing as needed.

An annular lubricant and dust seal 284 of elastomeric material, such as neoprene or butyl rubber, includes an inner periphery 285 (FIG. 9A) which makes a tight stretch fit around a hexagonal load nut 286 threaded on to the support shaft 265 to bear against the upper surface of an annular hub 287 on the inner race 272 of the thrust bearing. The seal 284 includes an outer periphery 288 which is pressed against the upper surface of the shaft collar to provide a lubricant and dust seal for the thrust bearing. The seal 284 is conveniently made from a sheet of elastic material in the shape of an annular disk shown in FIG. 9A. For a hexagonal nut having an interior diameter of about ¾", and a maximum exterior dimension of about 1¼", the inner periphery 285 of the seal 284 is about ⅝" and the outer periphery 288 is about 2½". The thickness of the sheet which forms the seal is about 1/16". When the seal is stretched to force it to fit over the exterior of the load nut, the seal takes the frusto-conical shape shown in FIGS. 9 and 10.

A pulley 290 bears against the top surface of the load nut, and is held firmly in place by a lock nut 292 threaded on the upper end of the support shaft 265. A drive belt (not shown) disposed around the pulley 290 is connected to a drive pulley (not shown) on an electric motor (not shown) mounted on top of the washing machine. As shown best in FIG. 10, the vertical load on the support shaft 265 is transferred from the load nut to the thrust bearing and against the upper surface of cabinet top wall 104, which bears against the top surface of the horizontal upper section 263 of the manifold, which transfers the load to the manifold left and right side sections 261 and 262, respectively, which are welded to the inner faces of the left and right side walls, respectively, of the cabinet. Some of the load is also carried by the back wall of the cabinet, which is welded to the cabinet side walls. As previously stated, the lower edges of the cabinet back and side walls are welded to the upper ends of the machine legs 144, which carry the entire load of the washer and the parts in it. This construction provides maximum support for the load with minimum material and manufacturing cost. Moreover, the pulley 290 can easily be changed by simply removing the lock nut. This facilitates driving the rotor 268 at different speeds for various types of washing operations. For example, it is often useful to turn the rotor at a slow speed, say less than 1 rpm, to "peel" heavy dirt loads off exceptionally dirty parts.

A conventional electrical control panel 292 mounted on the exterior of the left (as viewed in FIG. 1) side of the washing machine provides switches for the pump and rotor motors, as well as a timer to control the wash cycle, and a thermostat to control the temperature of the washing liquid.

Figure 13:
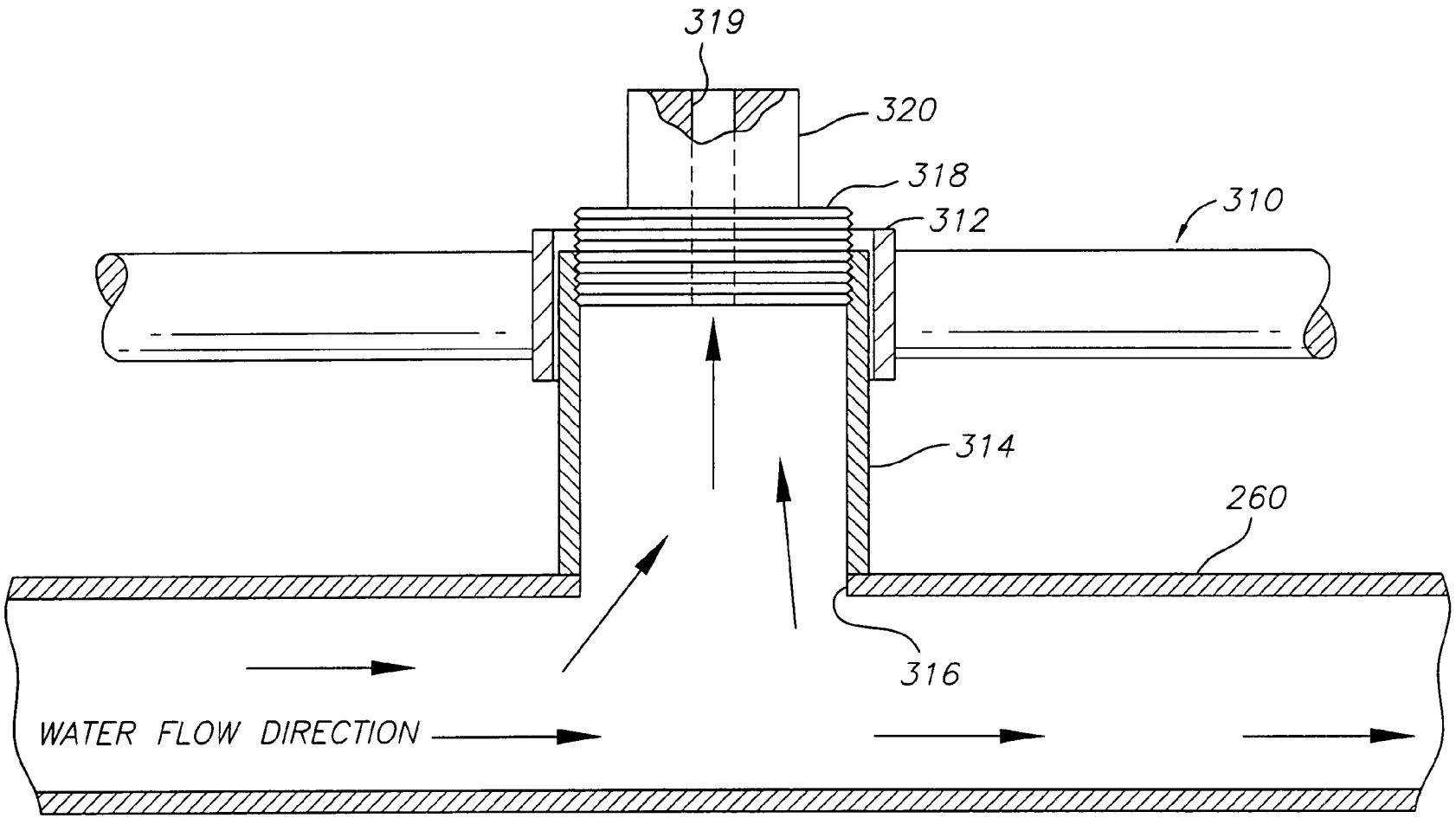
FIG. 13 is a view taken on line 13-13 of FIG. 12.

Referring to FIGS. 8, 12 and 13, the rotor 268 includes a pair of horizontal collinear upper top cross bars 300. The inner end of each upper top cross bar is welded to the opposite sides of the top surface of a rotor drive plate 302 disposed around the support shaft 265 to rest on bolt head 267 (FIG. 10). A pair of horizontal, collinear lower top cross bars 304 are welded at their respective inner ends to the bottom surface of the opposite sides of the drive plate 302. With the drive assembled as shown in FIG. 10, the bolt head 267 on support shaft 265 makes a snug fit between the inner ends of the lower top crossbars 304 so when the support shaft is rotated, the rotor 268 is forced to rotate about a vertical axis in the center of the cabinet.

A first pair of vertical rotor rods 306 are welded at their respective upper ends to opposite sides of the outer ends of one set of upper and lower top cross bars 300 and 304, respectively. A second pair of vertical rotor rods 308 are welded at their upper ends to opposite sides of the outer ends of the other set of upper and lower top cross bars 300 and 304.

A pair of horizontal and parallel lower cross bars 310 are welded at their central portions to opposite sides of a vertical collar 312 which makes a sliding fit around a vertical lateral conduit 314 welded to a lateral opening 316 (FIG. 13) in the bottom horizontal section 260 of the manifold. The lateral conduit 314 is internally threaded at its upper end to receive a plug 318 having a square fitting. 320 to facilitate moving the plug 318 into and out of a sealing position in the lateral conduit 314. Preferably, the plug has a vertical bore 319 through it so that even with the plug in the sealing position shown in FIG. 13, a stream of washing liquid is directed upwardly collinear with the axis of rotor rotation during the washing cycle.

As shown best in FIGS. 8 and 12, each of the lower cross bars 310 is made up of two collinear sections 321. The inner ends of the sections of one of the lower cross bars are welded to one side of the collar 312, and the inner ends of the other sections of the other lower cross bar are welded to the opposite side of the collar. The outer ends of each cross bar are connected together by a separate respective short stub 322 welded to the bars. The lower ends of the vertical rotor rods 306 and 308 are each welded to a respective outer end of a lower cross bar. Thus, as the driven pulley turns, the support shaft rotates the rotor about the vertical axis in the center of the cabinet. The upper and lower cross bars and the vertical supports rods of the rotor are dimensioned so the rotor makes a close fit within the rectangular manifold as the rotor rotates through a circular path 324 shown in phantom line in FIG. 2. As shown in FIG. 2, the vertical left and right side sections 261, 262 of the manifold project into the cabinet. Therefore for efficient use of space, the cabinet is wider than it is deep by an amount about equal to the sum of the horizontal exterior dimensions of the two side sections. To simplify manufacturing and inventory control, the left and right side walls 106 and 108 are identical in shape and dimension with back wall 103. The forward edges of side walls 106 and 108 project forward of the inner face of the door when it is in the closed position shown in FIG. 2 by an amount about equal to twice the maximum horizontal dimension of one of the manifold vertical sections. Thus, even though side walls 106 and 108 and back wall 103 are identical in size and shape for efficient manufacturing and inventory control, they are assembled so that the cabinet interior is slightly wider than it is deep.

A plurality of horizontal platforms 340 are secured by vertically adjustable clamps 342 to the vertical rotor rods 306 and 308. Thus the platforms 340 can be adjusted to any convenient height to receive parts to be washed.

FIGS. 8, 12 and 14 show a preferred arrangement of the apertures 264 in the manifold 259 for washing a dirty part 343 (shown only in FIG. 14) resting on a platform 340 (not shown in FIG. 14) mounted on the rotor 268, which turns about a vertical axis 344 (FIG. 14) in the center of the cabinet (not shown in FIGS. 8, 12 or 14) of the parts washer. Each aperture 264 is spaced a uniform distance "d" from an adjacent aperture. The set of apertures in the left section 261 (FIG. 8) of the manifold begin at a distance "d"/2 from the lower face of the upper horizontal section 263 of the manifold. The set of apertures 264 in the right section 262 of the manifold began at a distance "d" below the lower face of the horizontal section 263 of the manifold. Thus, each aperture in the left section 261 is offset a vertical distance of "d"/2 from a corresponding aperture in the set in the right section 262 of the manifold. This provides efficient coverage of dirty parts with streams of washing liquid as the parts revolve in the cabinet.

As shown best in FIG. 14, the aperture in the left and right sections 261, 262 of the manifold are located in a plane closer to the forward edge of the manifold than to a vertical plane passing through the center of the manifold and the axis of rotation. This arrangement aims the streams of washing liquid from the right and left sections 261, 262 of the manifold slightly offset from the axis of rotation 344 so the streams from the left side strike the dirty part at an angle different from that of the streams from the right side. This provides more efficient scrubbing of dirty parts which are difficult to clean. The arrangement is especially effective when it provides a "glancing" blow against the dirty part so that the stream of washing liquid does not bounce back against itself from the part.

The apertures 264 in the lower section 260 of the manifold are arranged so that those on the right side of the cabinet begin at a distance "d"/2 from the inside face of the right section 262 of the manifold. The apertures on the left side of the manifold are disposed so they begin at a distance "d" from the inner face of left section 261 of the manifold. Thus, the streams of washing liquid from the apertures on the right side of the lower section of the manifold concentrate on different area of a dirty part (not shown) on a platform (not shown) rotated about the axis 344 from the areas concentrated on the streams from the apertures 264 on the left side of the lower horizontal section 260. The apertures 264 in the lower section 260 of the manifold are preferably located along a line adjacent the rear face of the manifold 260 to avoid interference with streams of washing liquid emitted from the apertures in the right and left vertical sections 261, 262, respectively, of the manifold. The apertures 264 in the upper section 263 of the manifold are not shown in FIGS. 8, 12 or 14, but they are disposed in a manner similar to that of the apertures in the lower horizontal section 260 so that the streams of washing liquid from the apertures on the left side of the upper section 263 cover areas different from those covered by the streams of washing liquid from the apertures on the right side of section 263.

As shown in FIGS. 1, 3, 15, and 16, a vertical cylindrical vent pipe 350 at the right rear corner of the upper end of the machine is welded at its lower end to the upper surface of cabinet top wall 104 around a square opening 352 extending through the top wall. A square flexible flap 354 is secured by screws 356 to one edge of the square opening so the flap normally rests on the upper surface of the top wall 104 to cover opening 352. The flap 354 is made of any suitable flexible material which permits it to act as a pressure relief valve when the washing machine is turned on to start a washing cycle. At that time, relatively cool air in the machine is rapidly heated by the streams of hot washing liquid emitted from the apertures of the manifold. This pressure could be dangerous or at least destructive to the machine if not properly vented. To minimize loss of washing liquid droplets and moist hot air from the cabinet at the start of a washing cycle, a coalescing and condensing chamber 360 is formed in the upper right rear corner of the cabinet (FIGS. 1 and 2) by a vertical baffle 362 welded at its vertical edges to the inner faces of the rear and right side walls 103, 108, respectively, of the cabinet. The lower edge 363 of the baffle terminates just above the midpoint of the cabinet, and the upper edge of the baffle is welded to the inner surface of the top wall 104 of the cabinet so that vapor rushing from the cabinet toward the vent opening 352 must flow under the baffle and up through the coalescing chamber 360. This flow promotes coalescing of droplets and condensation of water vapor to minimize loss of heat and liquid from the cabinet. The coalescing chamber eliminates the need to provide an expensive vent to carry vapor from the machine to a point outside the building in which the machine is operated.

The flap 354 normally lies in the horizontal closed position shown in FIGS. 15 and 16. When the machine is turned on, causing rapid heating and expansion of relatively cool air in the cabinet, the flap is momentarily lifted to the phantom line position shown in FIG. 16 to relieve pressure within the cabinet. The flap then quickly closes to minimize heat and moisture loss from the cabinet. This operation of the pressure relief valve cooperates with the coalescing and condensing chamber, and the water seal created by the lower edge 188 of the return drain baffle (FIG. 5) to conserve heat and washing liquid. Thus, although the return drain 211 collects liquid from trough 209 and returns liquid from exterior of the cabinet to the reservoir, there is no open draft for allowing warm vapor to flow through and out of the machine.

FIGS. 17 and 18 show an alternate embodiment for a pressure relief valve for handling larger volumes of vapor flow than that provided in the embodiment shown in FIGS. 15 and 16. Referring to FIG. 17, the lower end of the vertical vent pipe 350 is welded to the upper surface of the top wall 104 of the cabinet around a circular vent hole 362 extending through the top wall 104. A circular flap 364 having a diameter slightly greater than that of the vent opening 362 is disposed on the upper surface of the top wall of the cabinet to cover the vent opening 362. A horizontal restraining strip 366 extends across the center of the flap and is secured to the top wall 104 by screws 368. The flap is secured to the underside of the restraining strip by screws 369 and nuts 370. The operation of the pressure relief valve shown in FIGS. 17 and 18 is similar to that described for the embodiment shown in FIGS. 15 and 16. The circular flap, which opens on both sides of the strip, provides a more fully open position for handling larger volumes of vapor.

Figure 4:
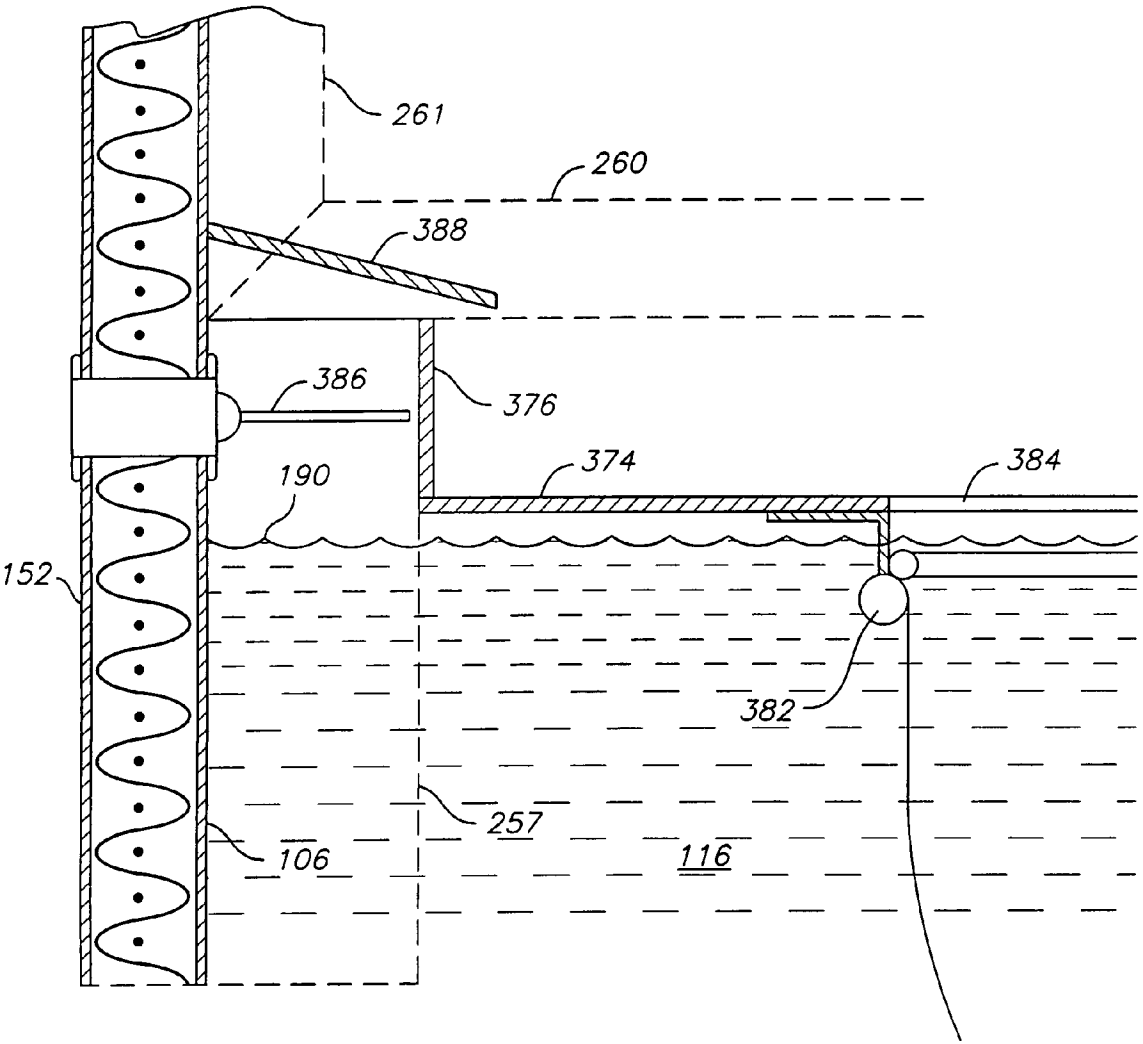
FIG. 4 is an enlarged fragmentary view taken on line 4-4 of FIG. 2 showing an overflow drain located in the lower left (as viewed in FIG. 1) side of the parts washer.

After hot washing liquid strikes parts being washed in the cabinet, the liquid drains down on to a horizontal filter plate 374 located just above the normal operating level 190 of washing liquid in the reservoir 116. The forward edge (FIG. 5) of the filter plate is welded to the rear face of the drain baffle, which is formed by the lower part of flange 186 extending down into the reservoir. The right and rear edges (as viewed in FIGS. 1 and 2) of the filter plate are welded to the interfaces of the right and back walls 108, 103, respectively of the cabinet. The left (as viewed in FIGS. 1 and 2) edge of the filter plate includes a vertical dam 376 (FIG. 4) welded to the riser 257, and having an upper edge which terminates just below the lower horizontal section of the manifold, which bisects the dam.

Referring to FIGS. 1, 2, 4 and 5, four bag filters 380 are each mounted in a separate respective filter bag retaining ring 382 suspended in a respective filter hole 384 extending through the filter plate 374. Thus, used washing liquid falling from washed parts collects on the filter plate and flows down through the filter bags to return to the pump inlet for recirculation. If the filter bags become plugged, excess washing liquid collected on the filter plate 374 overflows the dam 376 and returns to the reservoir 116. A bypass overflow sensor 386 is mounted on the left side walls of the cabinet and shell to provide an alarm signal when liquid flows over dam 376. An elongated deflection panel 388 is disposed over the space between the dam 376 and the left side wall 106 of the cabinet to prevent washing liquid from flowing directly into the space between the dam and the side wall. The left edge of the deflection plate is welded to the inner face of the left side wall 106. The deflection plate is also bisected by the lower horizontal section 260 of the manifold, and therefore includes a front section 390 and a collinear rear section 392. The front edge of the front section 390 is welded to the inner face of drain baffle 186, and the rear edge of the front section of the deflection panel is welded to the front face of the lower horizontal section 260 of the manifold. The forward edge of the rear section 392 of the deflection panel 388 is welded to the rear face of section 260, and the rear edge of the rear section 392 is welded to the inner face of rear wall 103. As shown best in FIG. 4, the deflection panel extends downwardly from left to right, and the inner edge of the panel terminates just inwardly of the dam 376, and at about the same elevation as the upper edge of the dam. The deflection panel prevents sprayed washing liquid from flowing directly to the reservoir without first passing through a bag filter.

FIG. 19 is a plan view of one of the clamps 342 shown in FIG. 8 for supporting the platforms 340 in the washing machine cabinet. The clamp includes a horizontal internally threaded coupling nut 400 which extends through, and is welded to, an L-shaped bracket 401 so the longitudinal axis of the coupling bisects the interior angle of the L-Shaped bracket. A bolt 402 is threaded into the end of the coupling lying within the interior angle of the L-shaped bracket. A clamp washer 404 is disposed around the bolt to be between a bolt head 406 and the interior faces 408 of the L-shaped bracket. The pair of right vertical rods 308 are disposed on opposite sides of the bolt and between the inner face of the clamp washer 404 and the inner faces 408 of the L-shaped bracket. Thus, as the bolt head 406 is tightened in the coupling nut 400, the vertical support rods are firmly gripped between the washer in the L-shaped bracket. Each platform 340 is welded to the exterior faces 410 of the L-shaped bracket of the clamp to provide firm support for the platform within the confines of the rotor. The platforms can be of any desirable shape. For example, as shown in FIG. 8, each platform is a web of intersecting flat metal strips 412 with the major plane of each strip 412 being substantially vertical. This gives the platform a grid structure with vertical openings 413 of different shapes and sizes at different locations. A major advantage of the arrangement shown in FIG. 8 is that the platforms (or any other attaching accessory (some of which are described below) can be positioned to any desired height (for example, to match the height of pre-existing material handling equipment on the shop floor reduce back strain of an operator loading and unloading heavy parts to be washed). Another advantage as described in more detail below is that accessories can easily be added, removed, or installed in various multiple or mixed combinations. For example, three platforms instead of only one wash three times the load of only one platform. An important aspect of the rotor, clamps, and accessories (described below) is that the same rotor clamp can be used with many different accessories. The clamp is easily installed by inserting the clamp bolt through two vertical rods and into the coupling nut. The rotor clamps are either welded to an accessory (described below) or bolted through the exposed end of the coupling nut. In some instances dirty parts are supported by bolting them directly to the rotor clamp. Customers can easily create their own customized parts-holding devices by using the rotor clamps as a starting point.

The adjustable platforms hold dirty parts for washing in the cabinet, and are easily removed when the cabinet needs to be cleaned. Large objects are placed directly on top of the platforms. Small parts are placed in mesh baskets (not shown) to prevent the small parts from falling through. When two or more platforms are used, the grid shape of an upper platform serves as a guide to support tall and skinny objects which are first inserted through the grid of the upper platform to support the object horizontally, and then lowered onto a lower platform for vertical support. The grids of adjacent platforms can also be spaced and staggered to accommodate the insertion of various parts. Moreover, the platforms can be designed with notches or cutouts so that tall objects on a complete lower platform bypasses notched or cutout upper platforms. Baskets (not shown) which sit on a platform to hold small parts may also have a notch or cutout to prevent interference with bypassing tall objects. A basket can also have an upwardly hinging or removable trap door in its bottom to allow occasional protrusion of tall parts from below.

FIGS. 22 and 23 show an alternate embodiment of a clamp 428 similar to that shown in FIGS. 19-21. In the embodiment shown in FIGS. 22 and 23, an L-shaped bracket 430 is long enough to accommodate two coupling nuts 432, each of which has a clamp bolt 434 and a clamp washer 436. The advantage of the clamp shown in FIGS. 22 and 23 is that it grips the rods 308 over a wider span to provide increased rigidity and support for heavy parts (not shown) carried on the platform (not shown).

Figure 24:
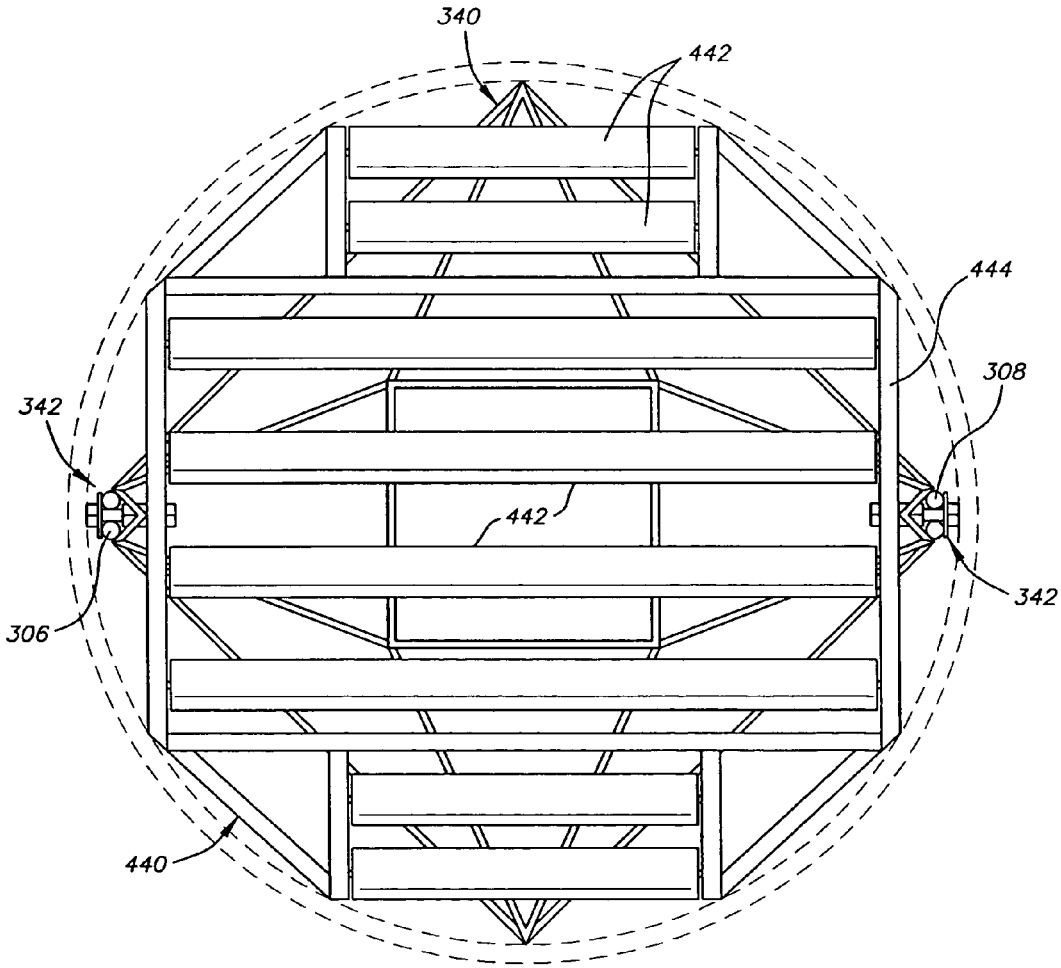
FIG. 24 is a plan view of a platform secured to the rotor by clamps, and with a roller table on the platform to facilitate moving heavy parts to and from a washing position in the cabinet.

FIG. 24 is a plan view of a table 440 with horizontal rollers 442. The table includes a horizontal frame 444 which projects below the lower level of the rollers 442 to rest directly on a supporting platform so the rollers are free to turn while the table 440 remains stationary on the platform, which is supported by clamps 342 secured to vertical rods 306 and 308 of the rotor 268 (not shown in FIG. 24). The rollers project above the upper level of the frame so they can support a load out of contact with the frame to facilitate rolling the load onto and off the platform.

Figure 25:
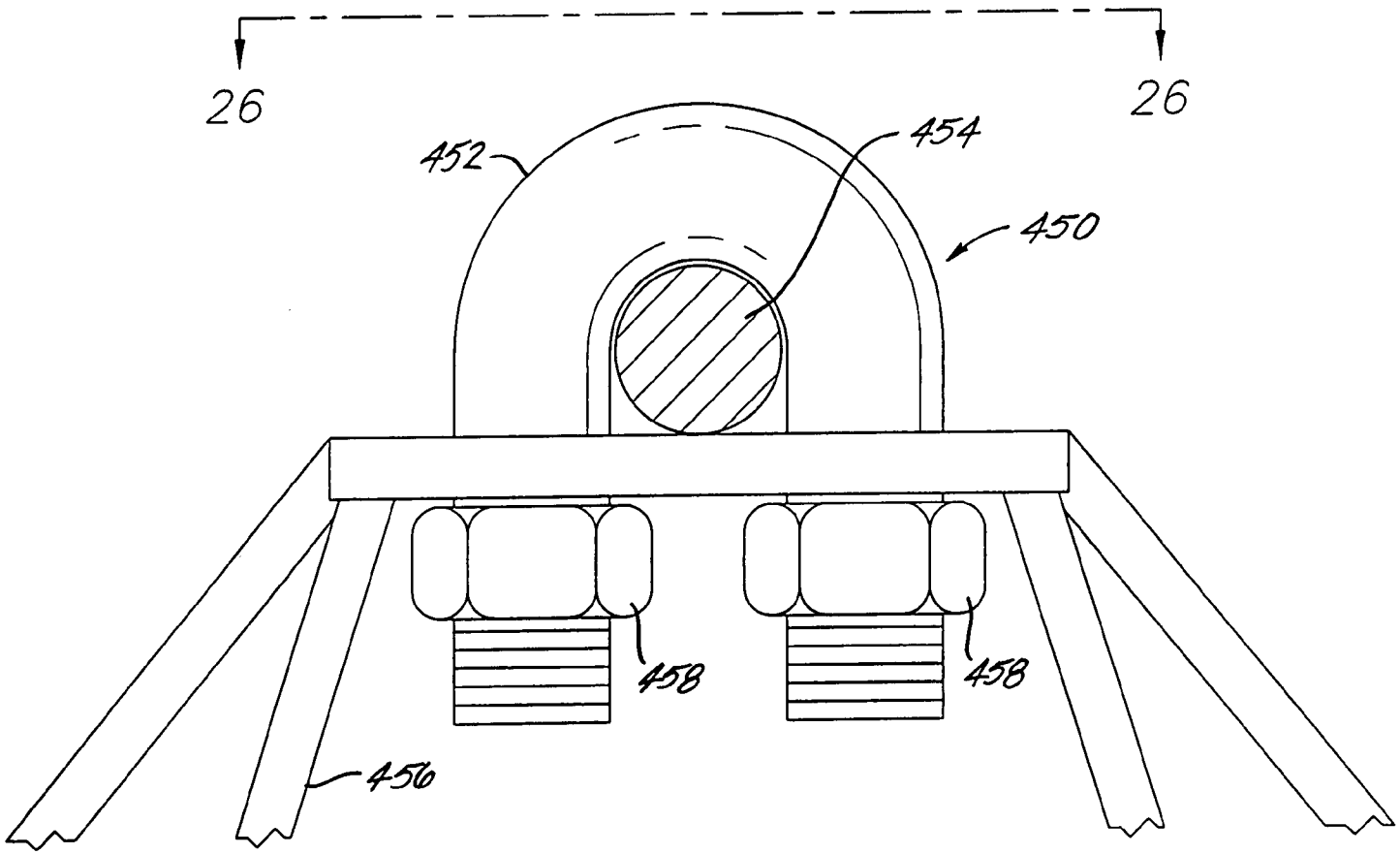
FIG. 25 is a fragmentary plan view of an alternate clamp for securing the platform to the rotor.
Figure 26:
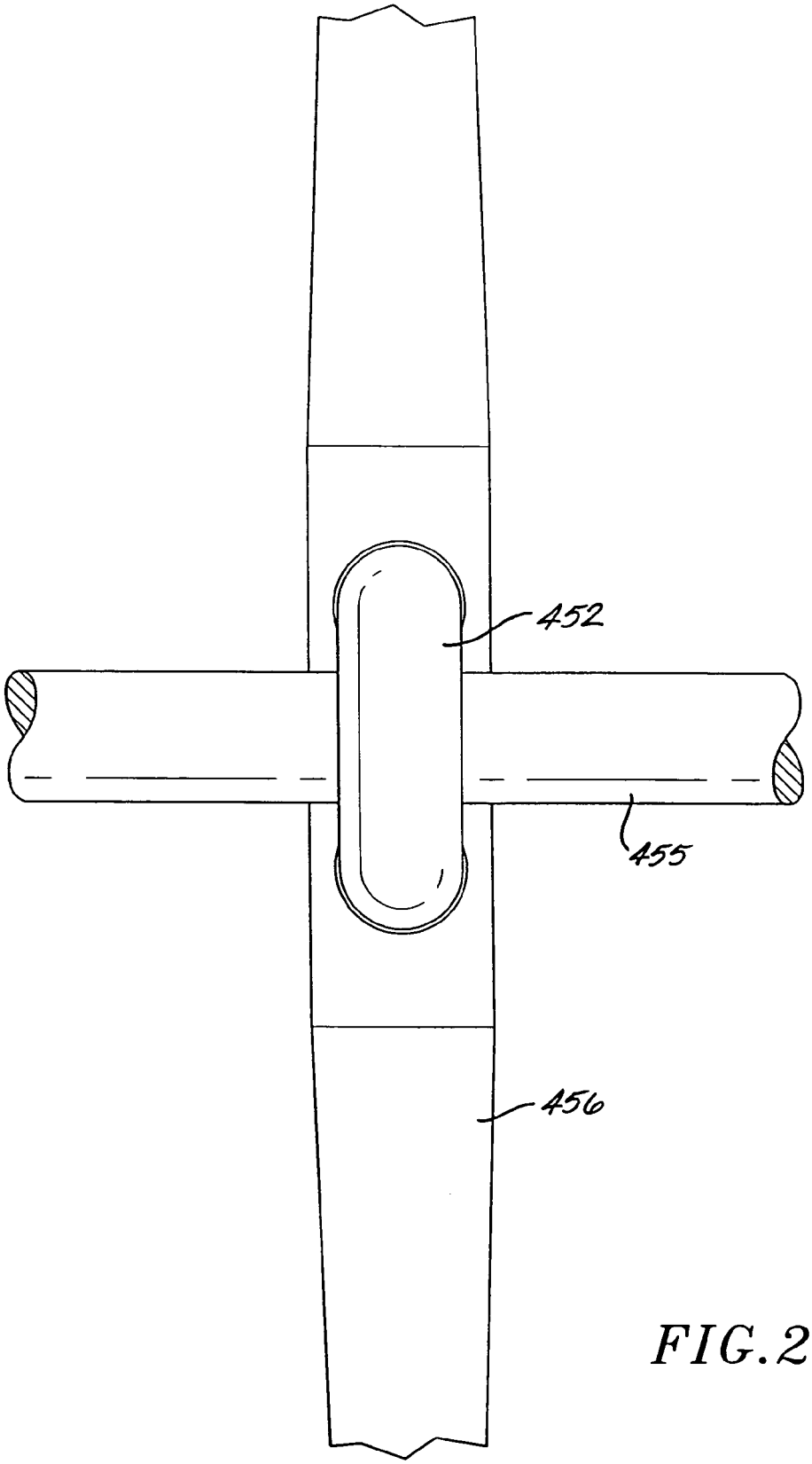
FIG. 26 is a view taken on line 26-26 of FIG. 25.

FIGS. 25 and 26 show an alternate embodiment of a clamp 450, which includes a U-bolt 452 disposed around a vertical rod 454 of a rotor (not shown in FIGS. 25 and 26). Threaded ends of the U-bolt extend through openings in the side of a platform 456, and nuts 458 screwed onto the threaded ends of the U-bolt to hold the platform in the desired position.

Figure 29:
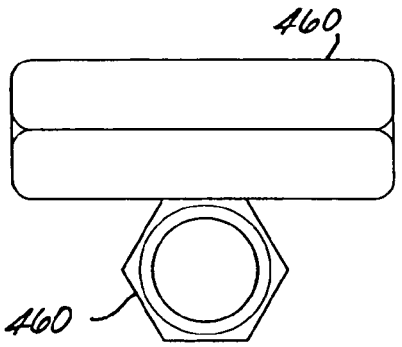
FIG. 29 is a view taken on line 29-29 of FIG. 28.
Figure 28:
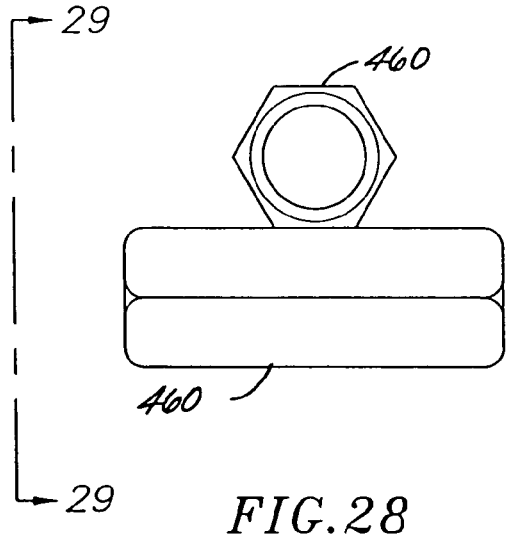
FIG. 28 is a view taken on line 28-28 of FIG. 27.
Figure 27:
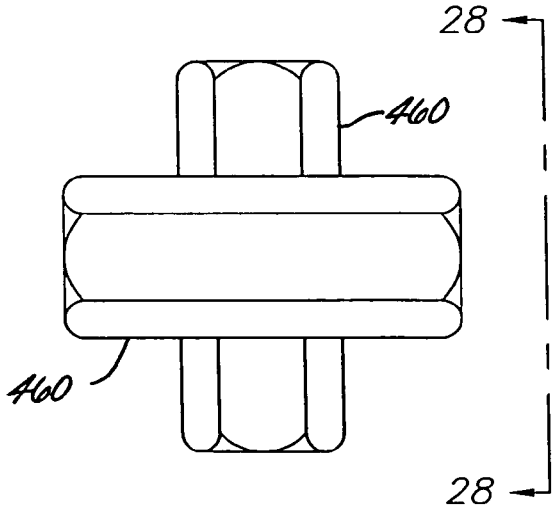
FIG. 27 is an elevation of a fixture used to secure parts to be washed to the rotor.

Referring to FIGS. 27, 28 and 29, a pair of mutually perpendicular coupling nuts 460 are welded together at their respective midpoints in a "cross" shape (FIG. 27) to form a fitting which can be used in combination with threaded rods and bolts (not shown) to provide an unlimited combination of connections supported by the clamps 342 on the rotor 268 (FIG. 8).

Figure 32:
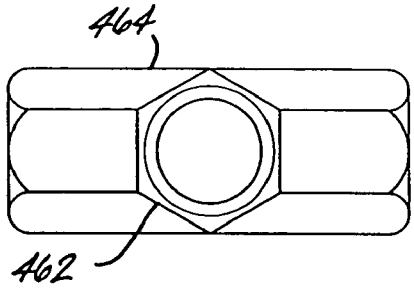
FIG. 32 is a view taken on line 32-32 of FIG. 30.
Figure 31:
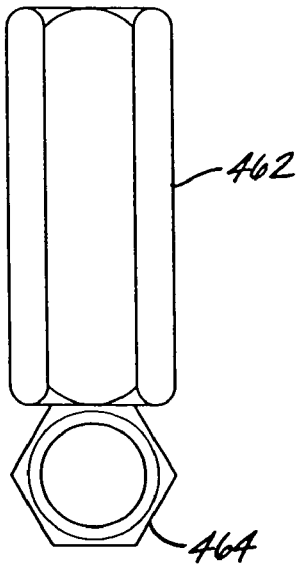
FIG. 31 is a view taken on line 31-31 of FIG. 30.
Figure 30:
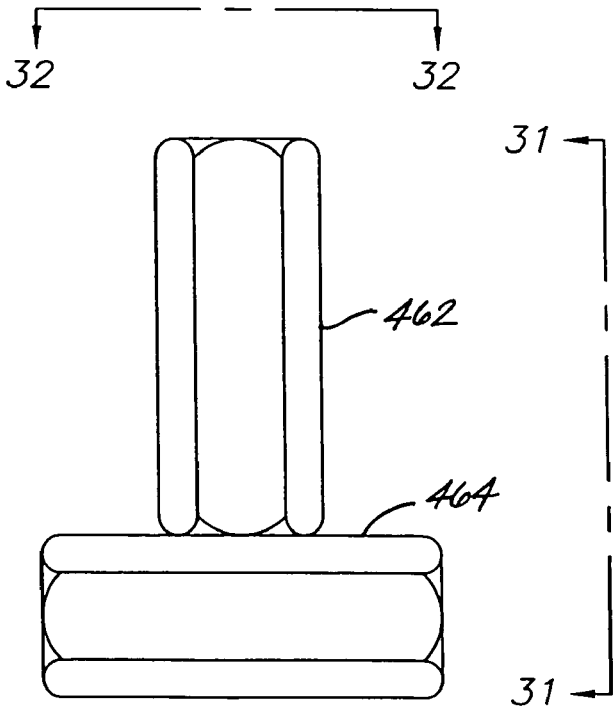
FIG. 30 is an elevation of a fixture used to secure parts to be washed to the rotor.

FIGS. 30, 31 and 32 show a first coupling nut 462 welded at one end to the midpoint of a second coupling nut 464 so the two nuts are mutually perpendicular and form a T-shaped fitting which can be used as just described for providing various connections for supporting parts to be washed.

FIGS. 33 and 34 show a J-hook 470 having a threaded section 472 which can be screwed into one of the previously described fittings to provide a hook upon which to hang parts being washed.

Figure 35:
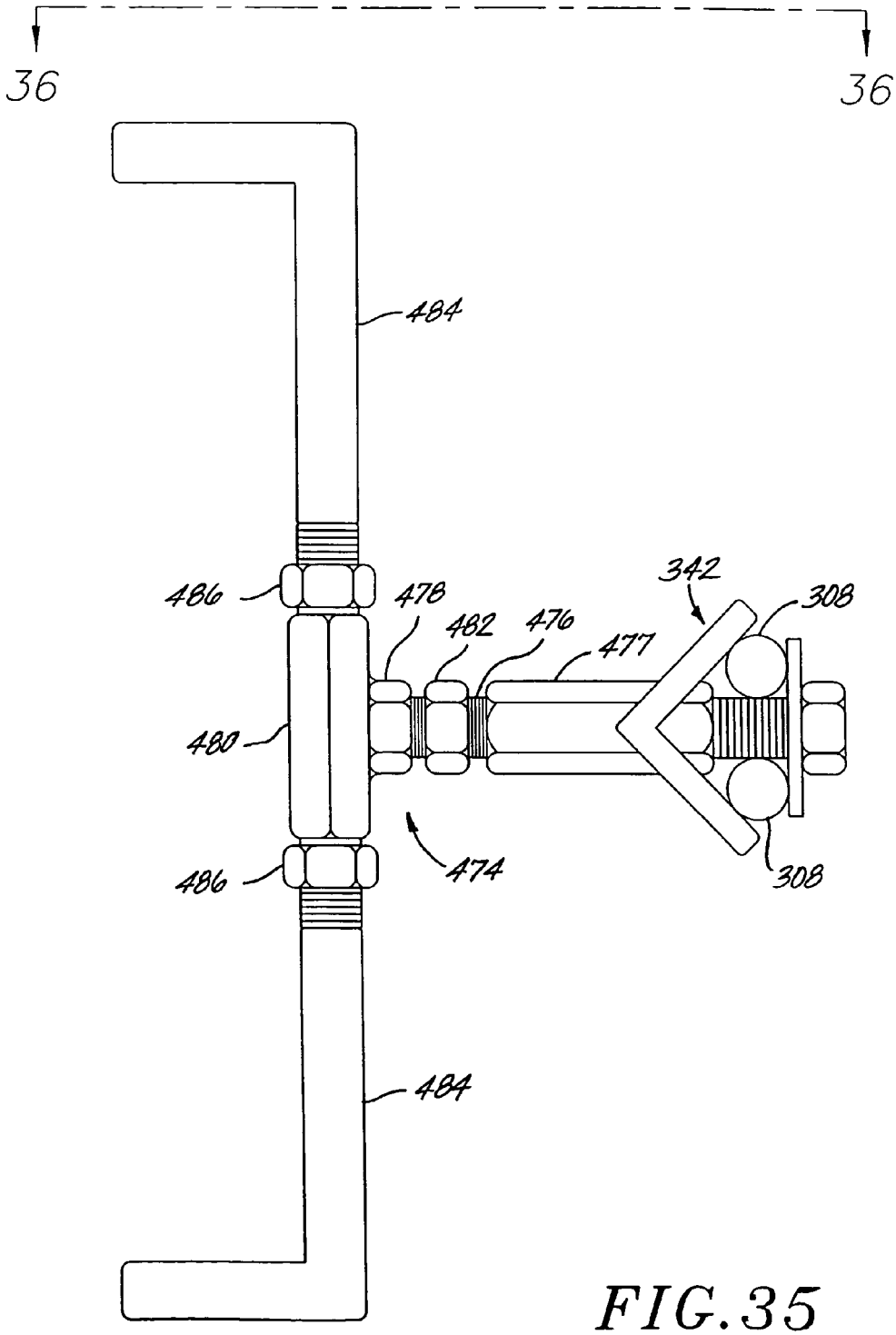
FIG. 35 is an elevation of a U-shaped propping fixture for securing parts to be washed to the rotor.
Figure 36:
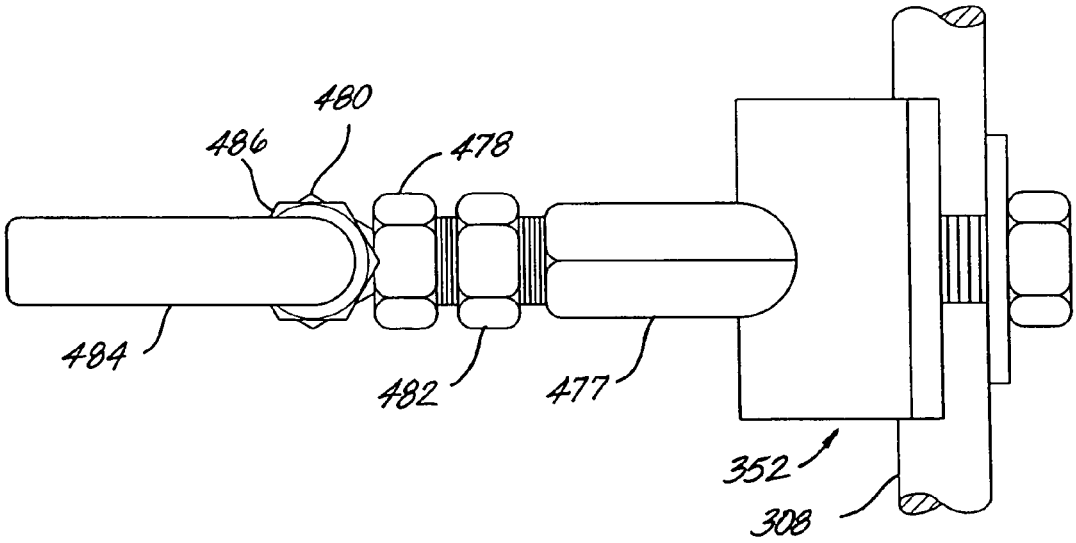
FIG. 36 is a view taken on line 36-36 of FIG. 35.

FIGS. 35 and 36 show a U-shaped propping fixture 474 which includes one of the clamps 342 mounted on a pair of vertical rods 308 as described above. A bolt 476 is screwed into the free end of a first coupling nut 477 on a clamp 342. The head 478 of bolt 476 is welded to the exterior of the midpoint of a second coupling nut 480. A locking nut 482 on bolt 476 is used to lock the shaft 476 in a desired position in the first coupling nut 477. For example, the locking nut 482 permits the bolt 476 to be adjusted longitudinally with respect to the first coupling nut 477, and also permits the position of second coupling nut 480 to be set and locked in any position between vertical and horizontal. A pair of L-shaped rods 484 each have a threaded end screwed into a respective end of the second coupling nut 480. A separate respective locking nut 486 on each of the threaded ends of the L-shaped rods permit the rods to be set and locked in various desired positions with respect to the second coupling nut. One use of the propping fixture shown in FIGS. 35 and 36 is to mount it on the rotor above a platform to prop up a part (not shown) resting on the platform.

Figure 37:
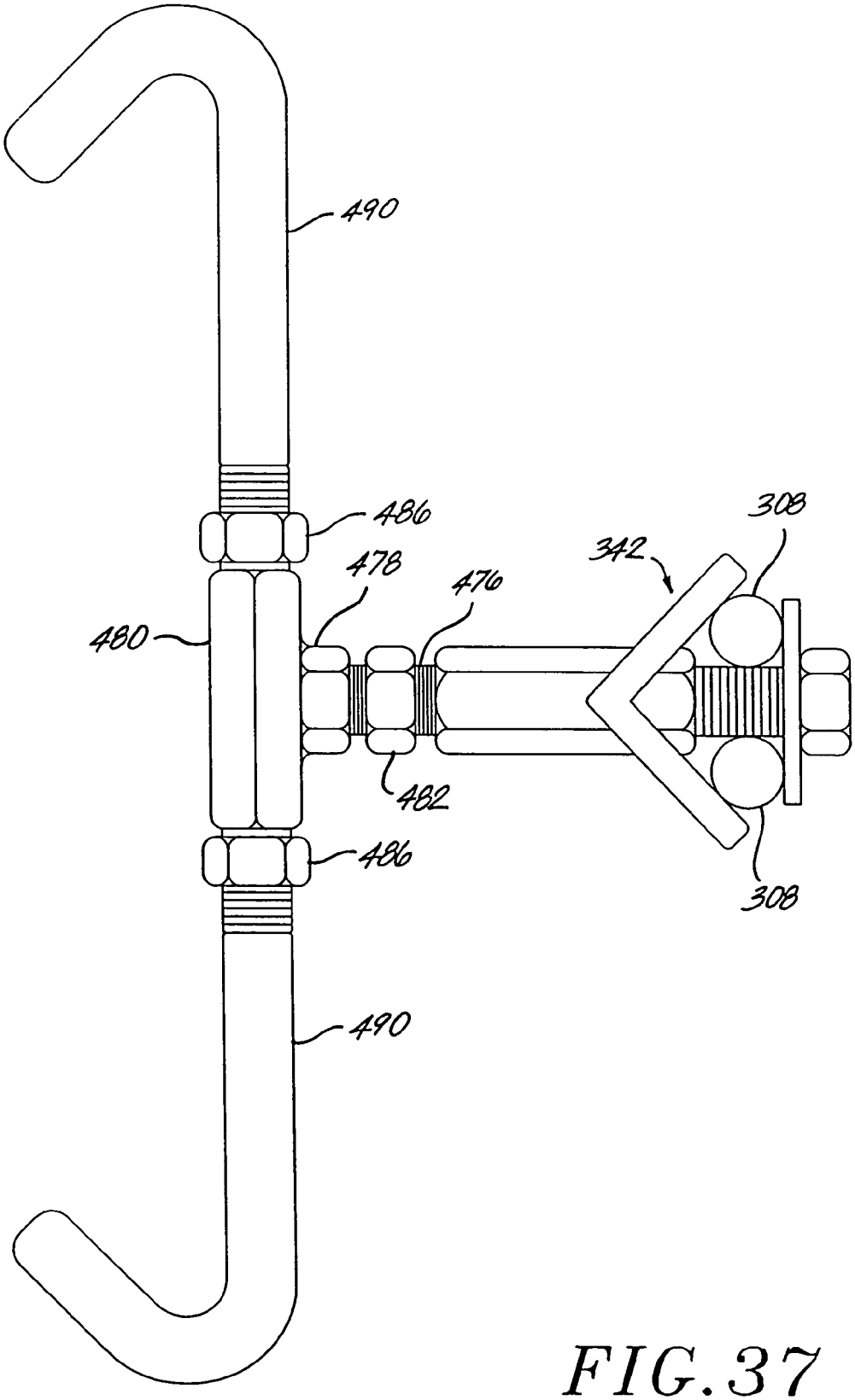
FIGS. 37, 38 and 39 are elevations similar to that of FIG. 36 showing alternate embodiments of propping fixtures.
Figure 38:
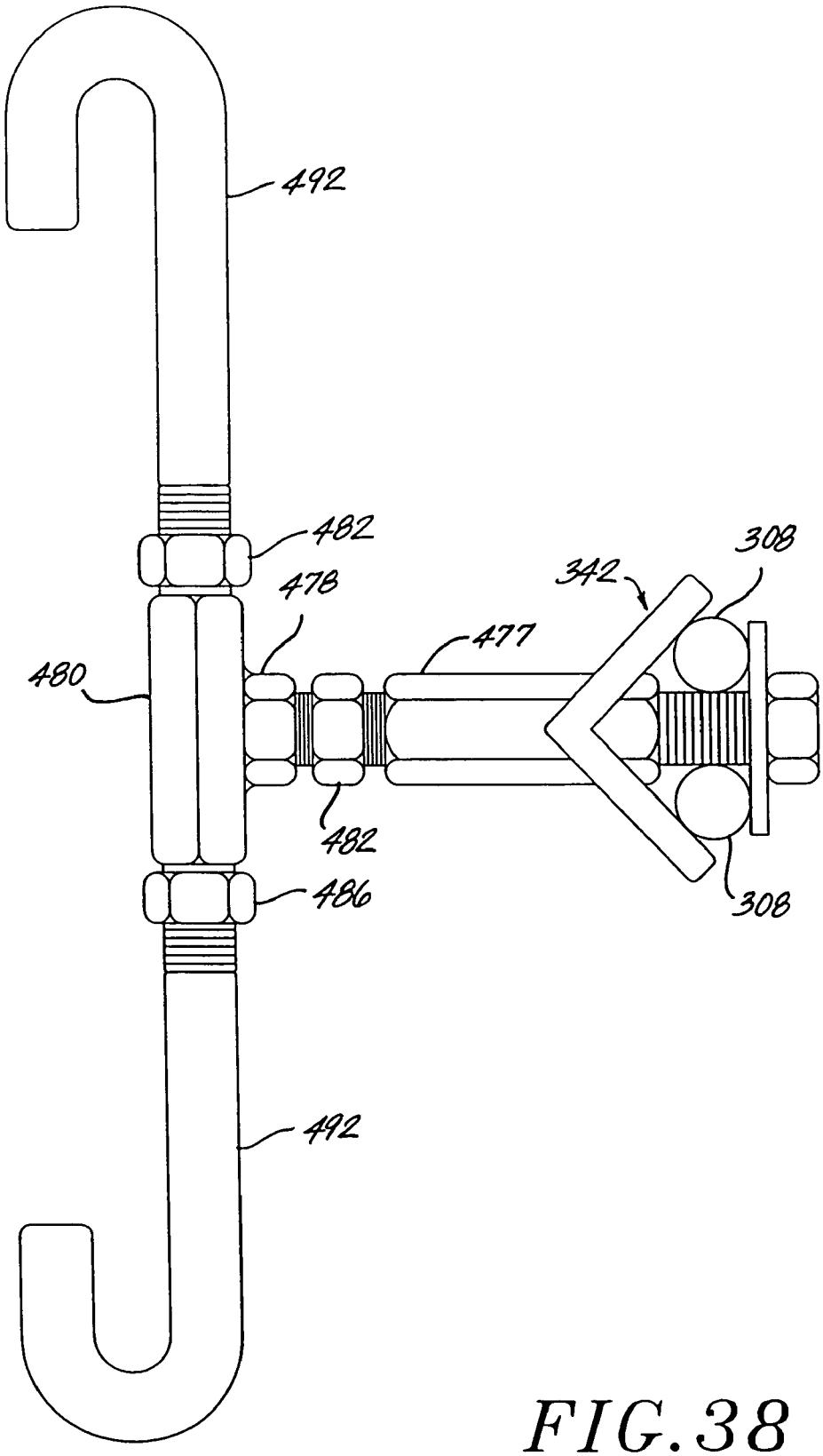
Figure 39:
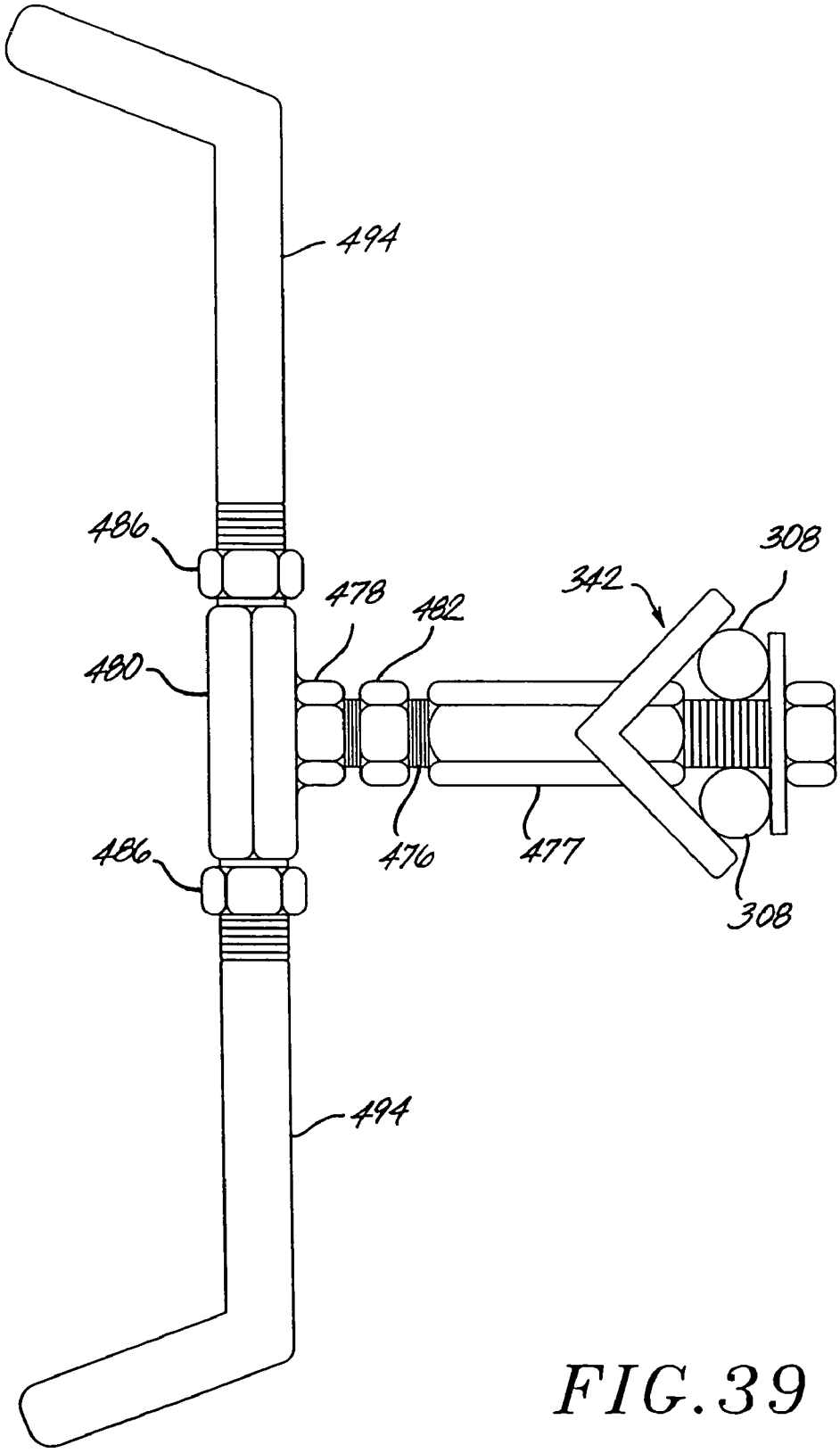

FIGS. 37, 38 and 39 show propping fixtures identical with that of FIGS. 35 and 36, except for the exact shape of the rods. For example, in FIG. 37, the outer ends of propping rods 490 are bent into an acute V-shape. The propping rods 492 in the fixture shown in FIG. 38 are bent to provide a U-shaped support. The propping rods 494 shown in FIG. 39 are bent at their outer ends to provide a less acute V-shape support than that of FIG. 37.

Figure 40:
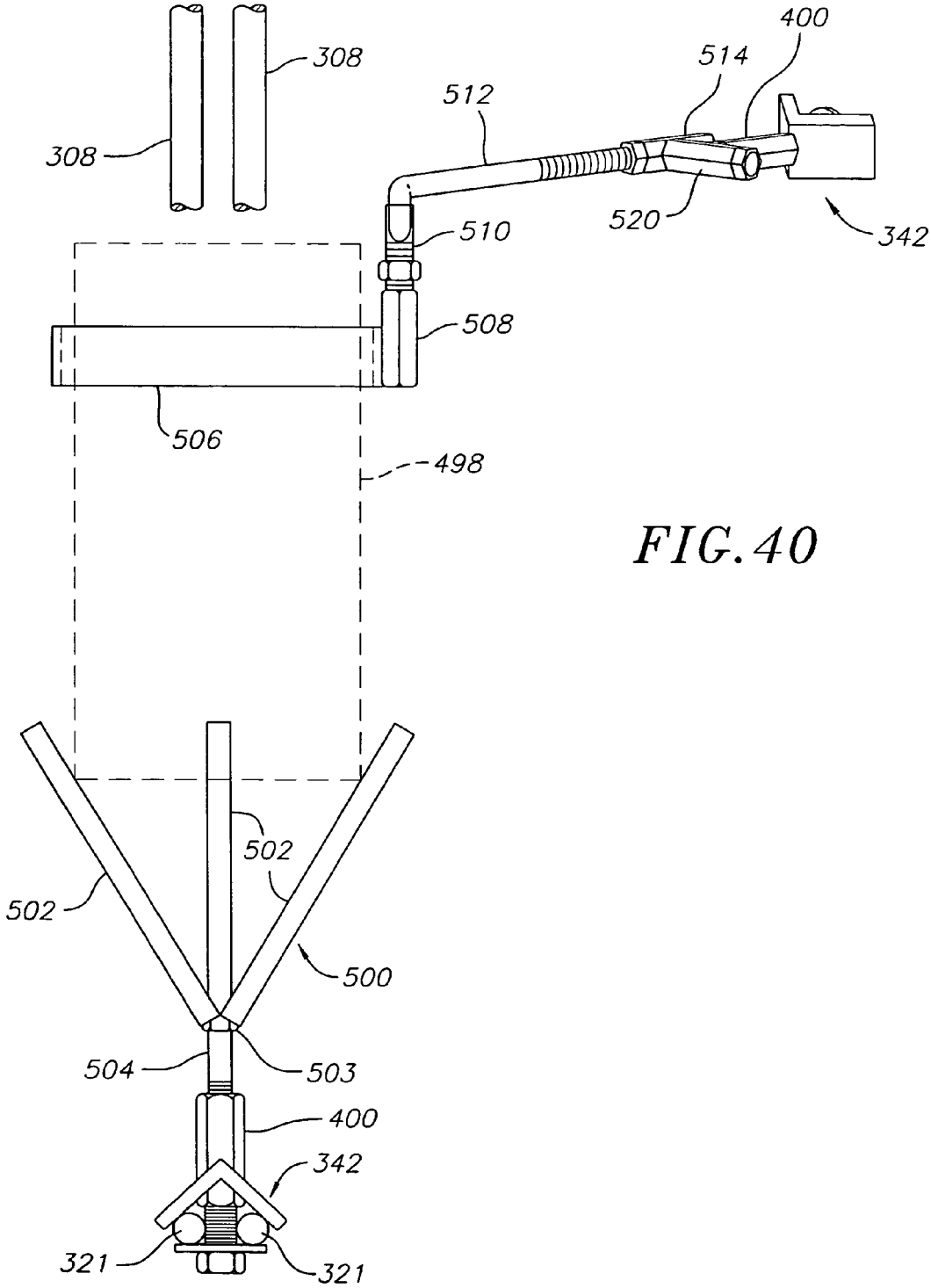
FIG. 40 is a perspective view of an adjustable swing arm fixture and a tripod fixture, which can be used together or separately to hold parts to be washed.
Figure 41:
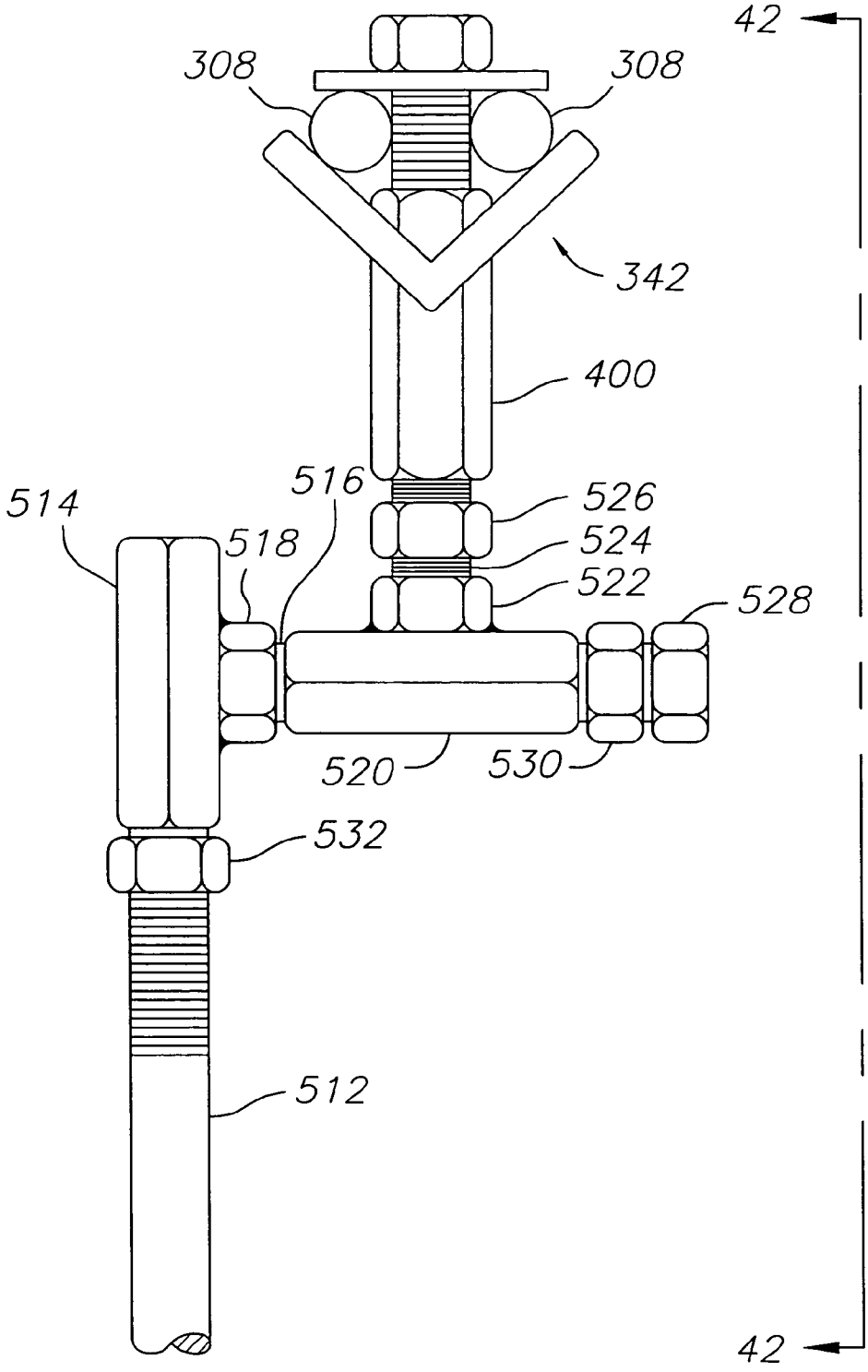
FIG. 41 is a fragmentary plan view of the fixture shown in FIG. 40.
Figure 42:
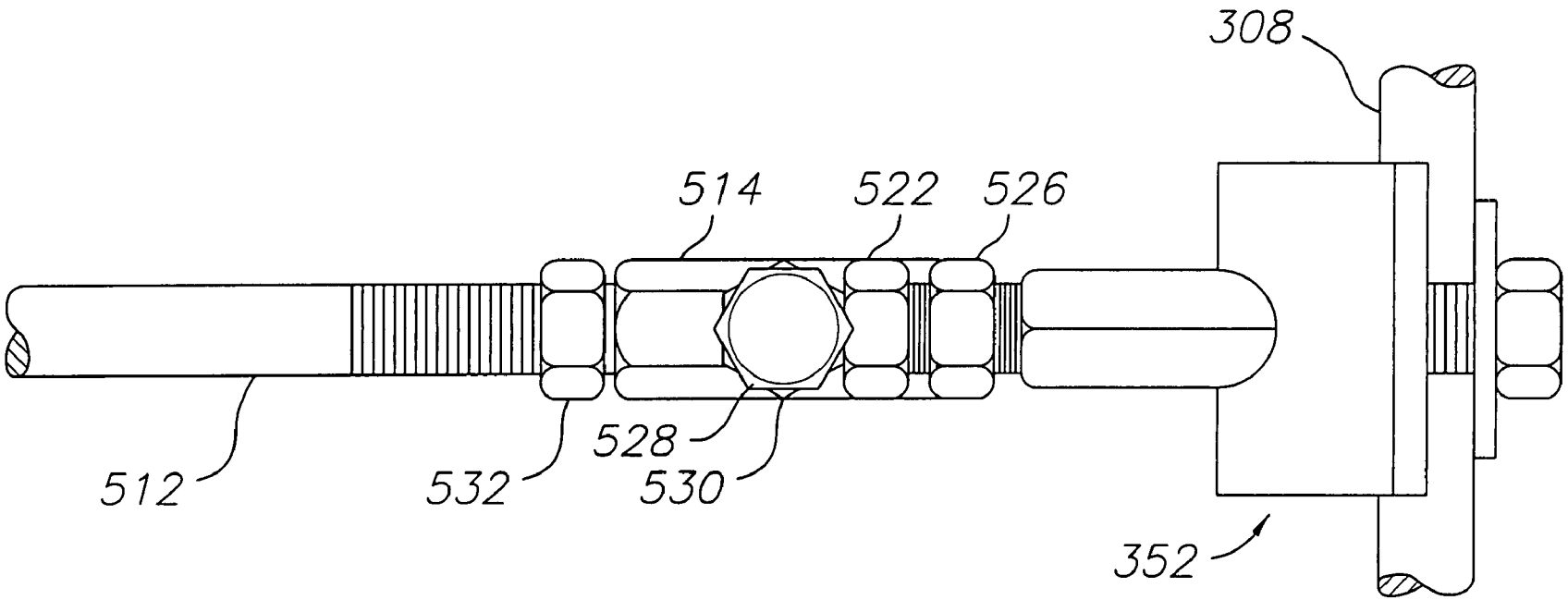
FIG. 42 is a view taken on line 42-42 of FIG. 41.

Referring to FIGS. 40, 41 and 42, an elongated and upwardly extending dirty part 498 (shown only in phantom line) rests in an inverted tripod fixture 500, which has three upwardly and outwardly disengaging fingers 502. The fingers converge at their respective lower ends, and are each welded to the head 503 of a vertical bolt 504 screwed into a coupling nut 400 of a first clamp 342 (described above with reference to FIGS. 19 and 20) secured to horizontal lower crossbars 321 of the rotor 268 shown in FIG. 8 so the clamp can be adjusted horizontally to various positions along the crossbars. A cylindrical hoop or ring 506 encircles an upper portion of the part and is welded to the exterior of a vertical coupling nut 508 screwed onto a vertical threaded rod 510 secured to the outer end of a horizontal swing arm 512. The inner end of swing arm 512 is threaded into one end of a first horizontal coupling nut 514.

A horizontal pivot bolt 516 has a hexagonal head 518 welded to the exterior and midpoint of first coupling nut 514 so the pivot bolt and first coupling nut 514 are mutually perpendicular. Pivot bolt 516 screws into a second horizontal coupling nut 520, which is welded at its midpoint to the head 522 of a bolt 524 screwed into the coupling nut 400 of a second clamp 342 secured to the vertical rods 308 (FIG. 41) of the rotor 268 shown in FIG. 8. (For clarity of illustration, the vertical rods 308 are shown only in fragments in FIG. 40, and the swing arm is offset to the right (as viewed in FIG. 40) about 900 from the position required to secure the second clamp 342 to the vertical rods 308.) A lock nut 526 on bolt 524 permits the coupling nut 520 to be set and locked in any position between vertical and horizontal. A stop bolt 528 is screwed into the end of coupling nut 520 opposite from pivot bolt 516 so that the inner end of stop bolt 528 acts as a stop to limit the travel of pivot bolt 516 into coupling nut 520. A lock nut 530 on stop bolt 528 locks the stop bolt in any desired position within coupling nut 520. Thus, swing arm 512 can easily be lifted from the horizontal position shown in FIG. 40, and then be dropped back to the horizontal position where it is held by engagement of the inner end of pivot bolt 516 against the inner end of stop bolt 528 in coupling nut 520. The arm 512 can also be rotated about a horizontal axis, and locked in any desired position by a lock nut 532 on the threaded inner end of rod 512 adjacent coupling nut 514.

The hoop or ring at the outer end of swing arm 512 can be replaced by a downwardly extending pin (not shown), which fits into a cavity on a dirty part (not shown). The tripod can also be replaced with a single pin to work with the pin mounted on the outer end of the swing arm. In that case, the two opposed pins work together, with one located at the top of a part being washed, and the other at the bottom of the part being washed. For example, the upper pin can be two inches long and the lower pin one inch long, the vertical space between the adjacent ends of the pins being less than the length of the part being washed, which could be a dirty tube. In that case, the tube is first inserted over the lower end of the upper two inch pin, and then dropped down over the upper end of the lower one inch pin, thereby holding the part in place. In another embodiment, a single pin may be used at the top of the part being washed, which rests on a turntable shelf at the bottom. Another alternative is to use a long single pin at the bottom, with short parts (say tubes) dropped over the pin. Ordinarily, the pin or pins are used inside available cavities of the parts being washed, and the hoop or hoops hold dirty parts by encircling them.

Figure 43:
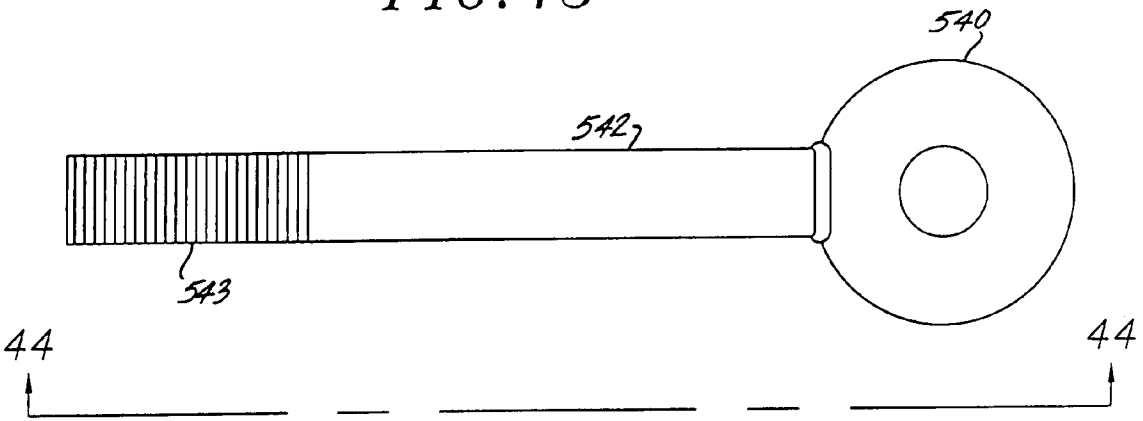
FIG. 43 is a plan view of a bolt-through fixture for holding parts in the washer.
Figure 44:
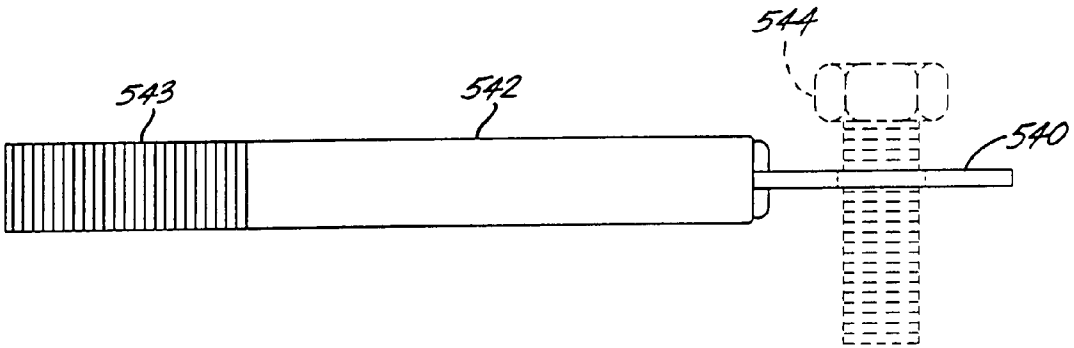
FIG. 44 is a view taken on line 44-44 of FIG. 43.

FIGS. 43 and 44 show a bolt-through arrangement which can replace the hoop 506 shown in FIG. 40. The bolt-through arrangement includes a large flat washer 540 welded to one end of a rod 542, the other end of which includes a threaded section 543 to permit rod 542 to be connected to the outer end of the swing arm 512 with a fitting such as that shown in FIGS. 27 and 28. As shown in FIG. 44, a mounting bolt 544 can be dropped through the washer and screwed into any available threaded hole in a dirty part to be washed. In an alternate embodiment of the rod and washer arrangement show in FIGS. 43 and 44, the washer 540 is omitted, and the unthreaded end of the rod is given a hemispherical finish so it can serve as a mounting pin, such as that described above with respect to FIG. 40.

Figure 45:
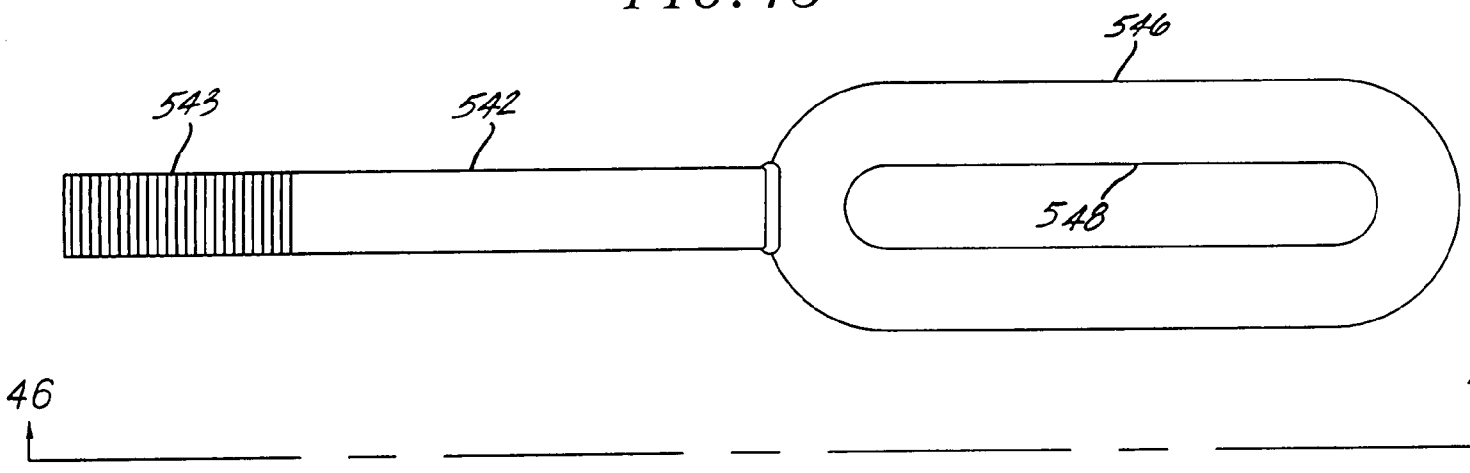
FIG. 45 is a plan view of an alternate embodiment of a bolt-through fixture for holding parts in the washer.
Figure 46:
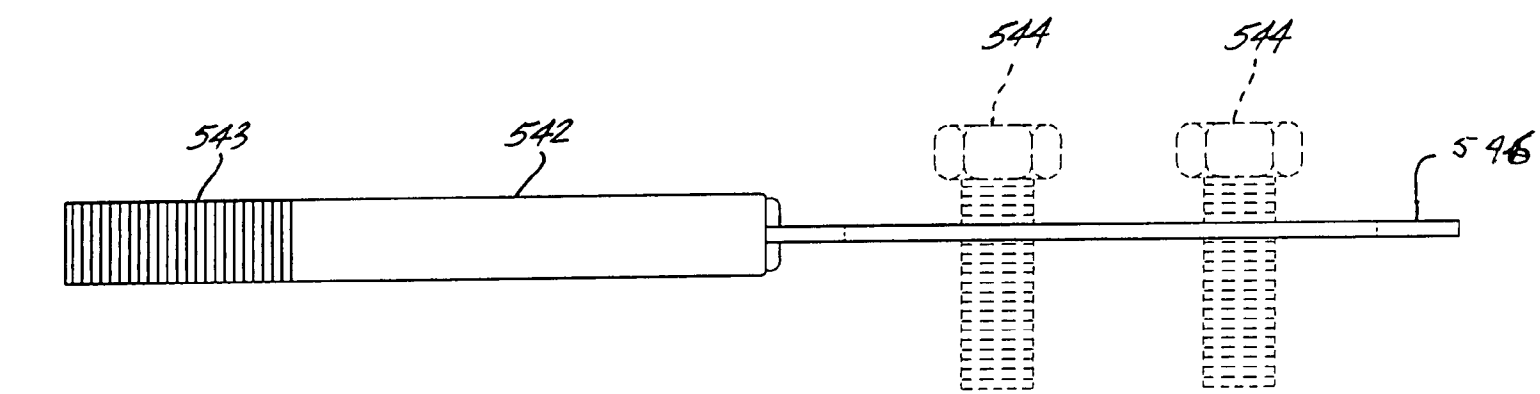
FIG. 46 is a view taken on line 46-46 of FIG. 45.
Figure 47:
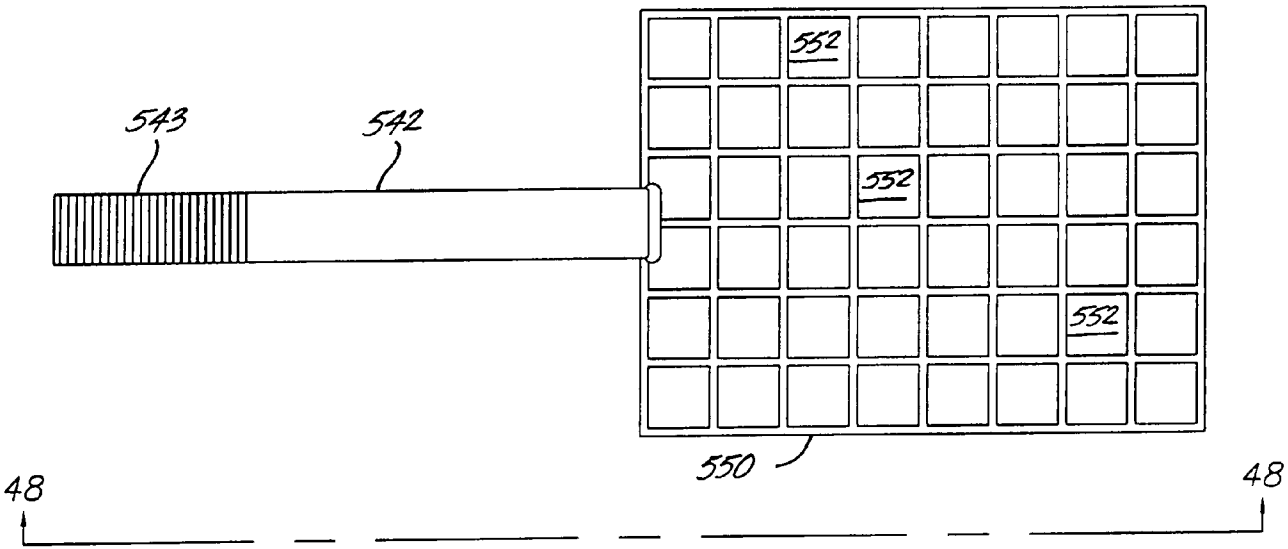
FIG. 47 is a plan view of a grid fixture for holding parts in the washer.
Figure 48:
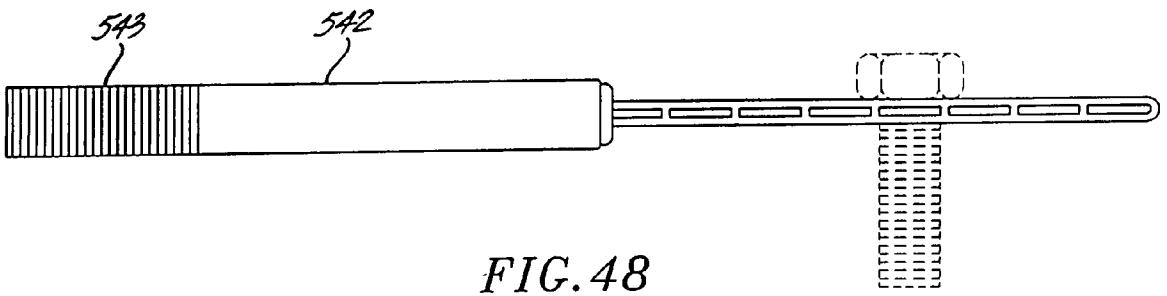
FIG. 48 is a view taken on line 48-48 of FIG. 47.

FIGS. 45 and 46 show a similar arrangement in which the washer is an elongated flat piece 546 having an elongated slot 548 so that a plurality of mounting bolts 544 can be suspended from elongated washer 546. FIGS. 47 and 48 show a further modification in which a horizontal grid 550 replaces the washers shown in FIGS. 43-46. Openings 552 in the grid permit mounting bolts to be located over a wide area to accommodate various types of dirty parts with threaded holes located in different positions. Alternatively, parts to be washed, such as bolts, can be suspended from the grid.

Figure 49:
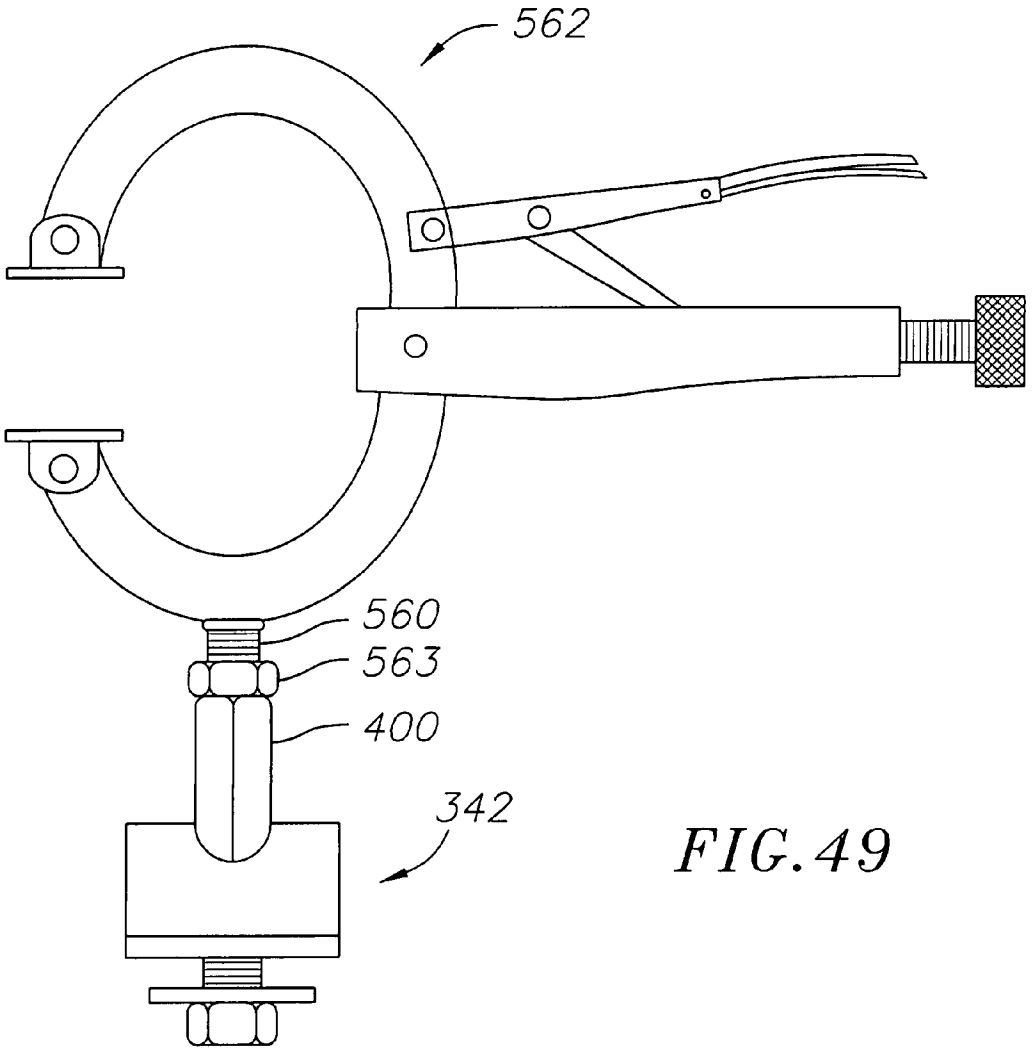
FIG. 49 is a plan view of a C-clamp secured to a rotor clamp for mounting parts to be washed.

Referring to FIG. 49, a threaded shaft 560 is welded at one end to a conventional C-clamp 562, and is screwed at its other end into the coupling nut 400 of a clamp 342 (described above with reference to FIGS. 19 and 20). A lock nut 563 on threaded shaft 560 secure the C-clamp in the desired position for holding the part(s) to be washed. The C-clamp can also be a conventional toggle clamp, or locking pliers (Vise Grip). Thus, many dirty parts of almost any shape can be held by the C-clamp or other tool on the rotor for washing.

Referring to FIGS. 50, 51, 52, 52A and 53, a pair of horizontal and vertically spaced swing platforms 571 are each secured by respective vertical hinges 572 to clamps 428 (of the type shown in FIGS. 22 & 23) secured to the vertical rods 306 and 308 on each side of the rotor 268 to swing in a horizontal plane from a washing position within the cabinet out to a loading position outside the cabinet. The two swing platforms are identical. For brevity, only the lower swing platform is described in detail.

Figure 52:
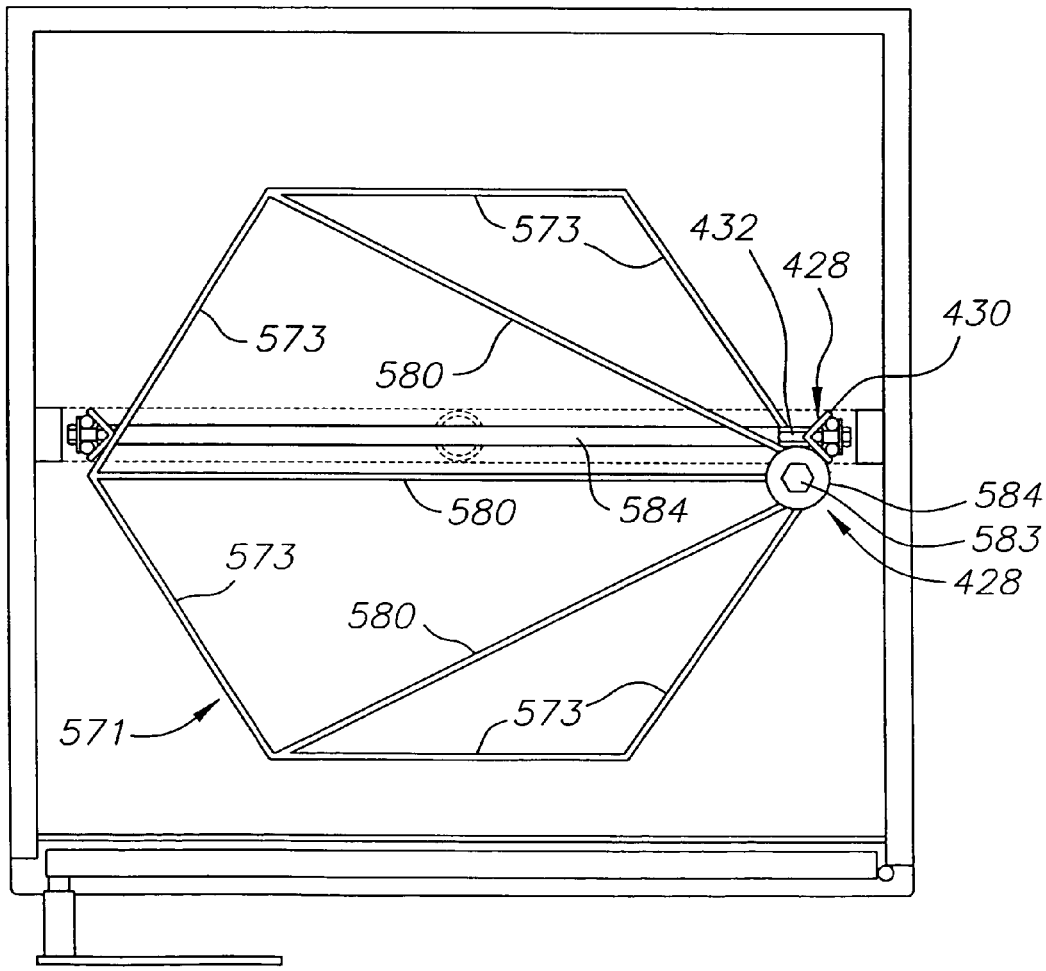
FIG. 52 is a plan view taken on line 52-52 of FIG. 50 showing the lower swing platform positioned within the parts washer.
Figure 52A:
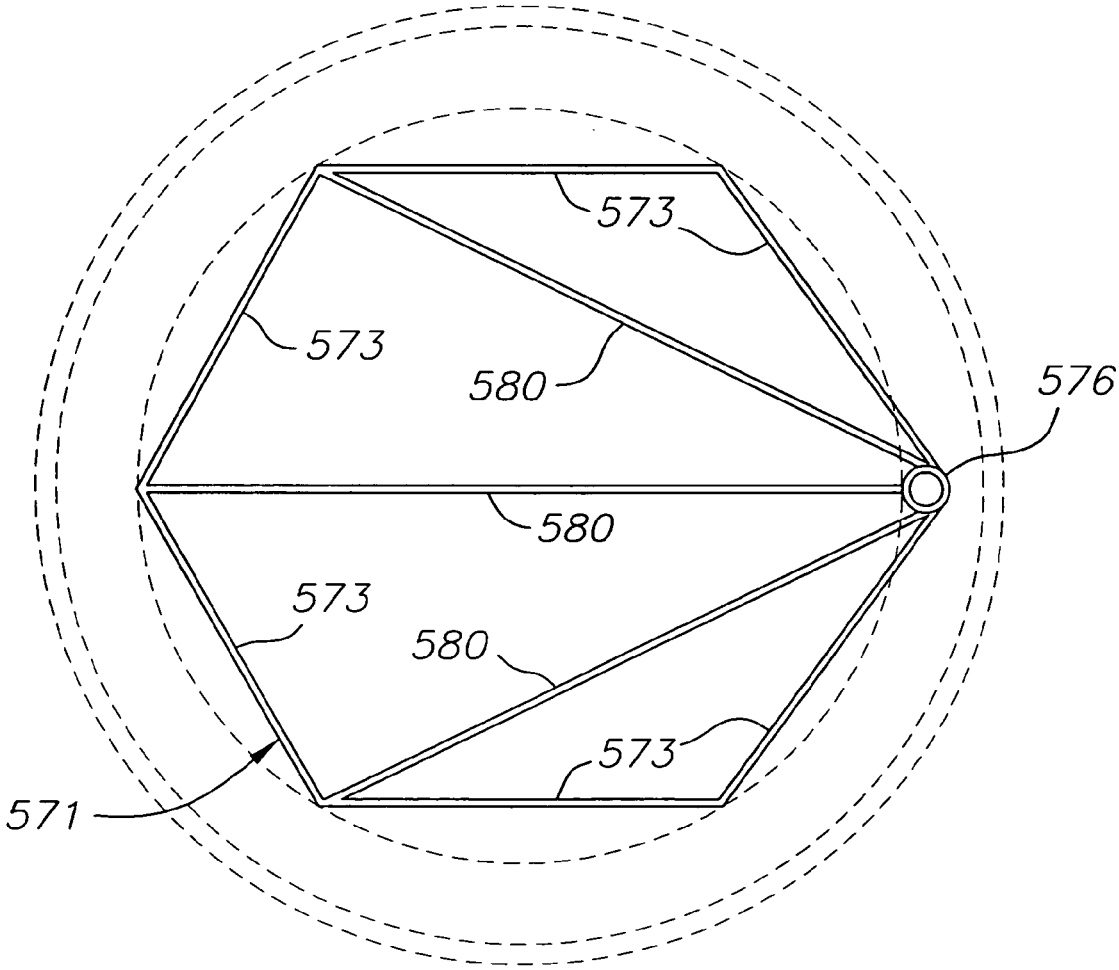
Figure 53:
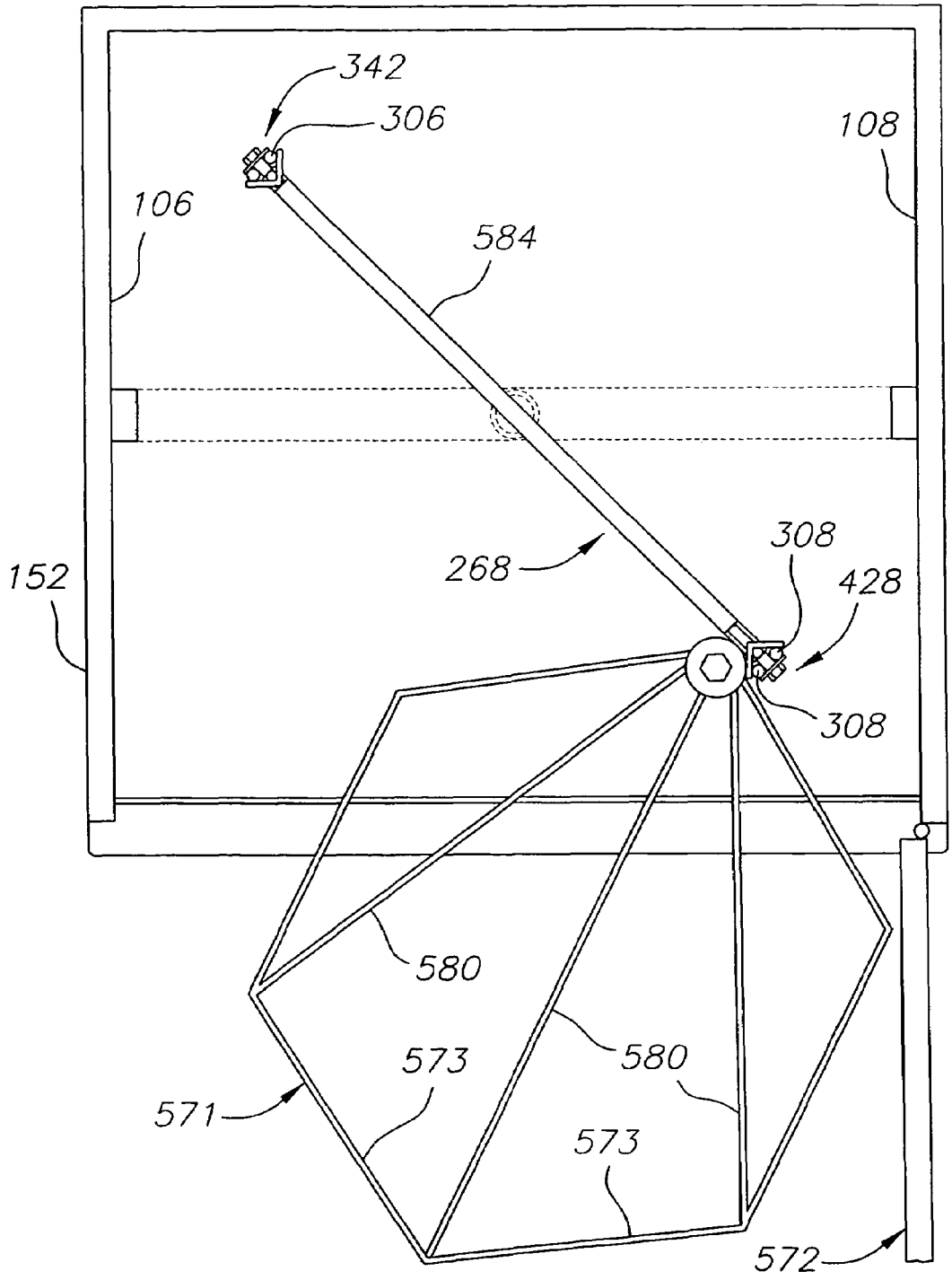
FIG. 53 is a view similar to FIG. 52 showing the rotor turned about 45 degrees from that in FIG. 52, and with the platform swung to a position outside the parts washer cabinet.

As shown in FIG. 52, the swing platform 571 is in the shape of a hexagon having six outside members 573 of about equal length. Each outside member 573 is in the shape of an elongated rectangular strip with the major plane of each strip lying in a vertical plane. Adjacent ends of the outside members 573 are bonded together, say by welding. The vertical hinge 572 includes a cylindrical sleeve 576 (FIG. 50) disposed around a vertical hinge pin 578. Adjacent ends of a pair of outer members 573 of the platform 571 are welded to the hinge sleeve 576. Adjacent ends of three interior swing platform members 580 are each also welded to the hinge sleeve. The other ends of each interior member 580 extend out to a respective junction of adjacent outer members 573, and are welded to the outer members at that point. A separate gusset 582 is welded to the underside of the end of each member welded to the hinge sleeve, and is also welded to the hinge sleeve. FIG. 52A shows the swing platform members welded to the sleeve 576 before it is assembled on the hinge pin 578 of the hinge 572.

Figure 50:
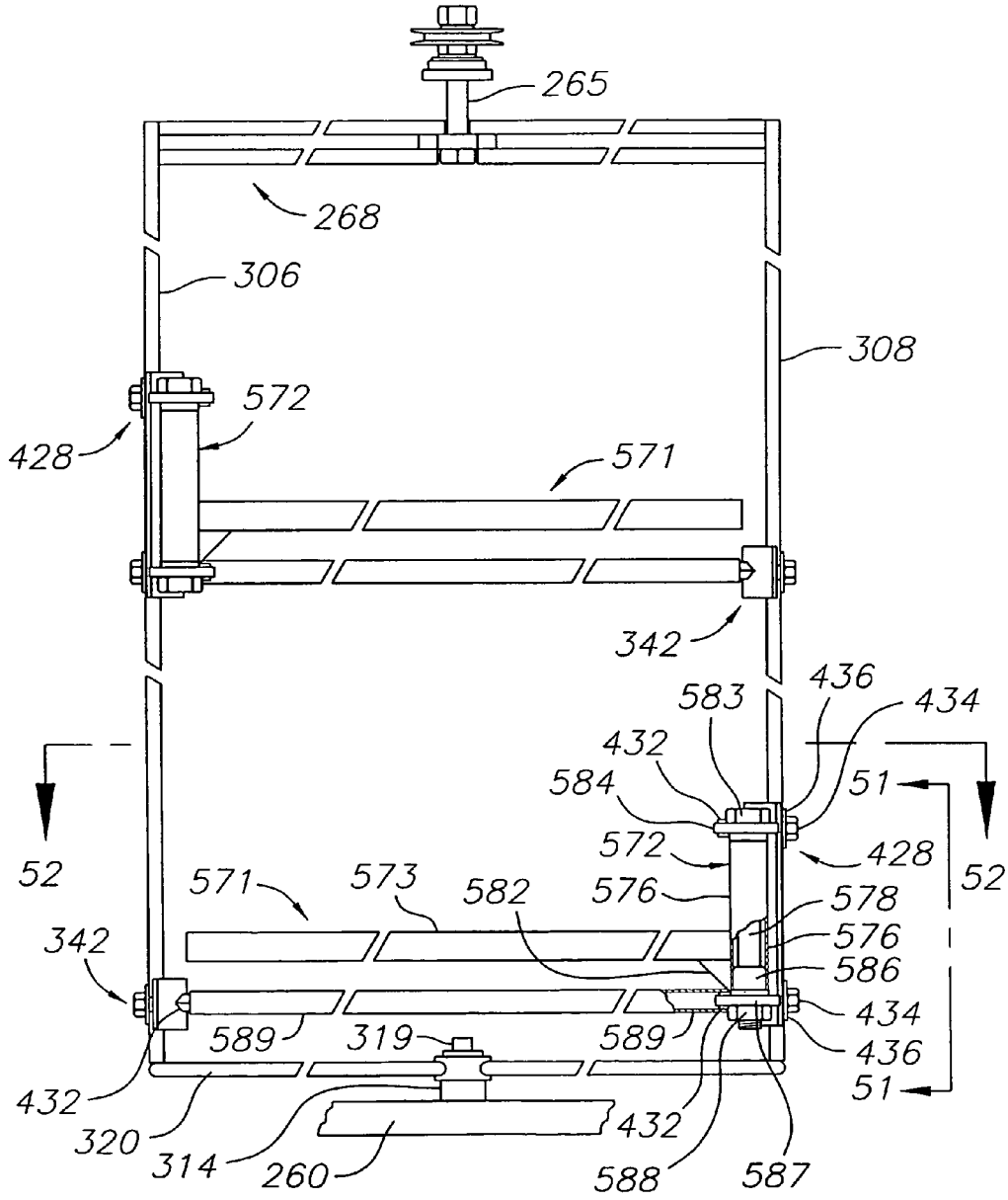
FIG. 50 is a fragmentary elevational view of a rotor with a pair of vertically spaced swing platforms mounted on it for moving parts into and out of the washer.
Figure 50A:
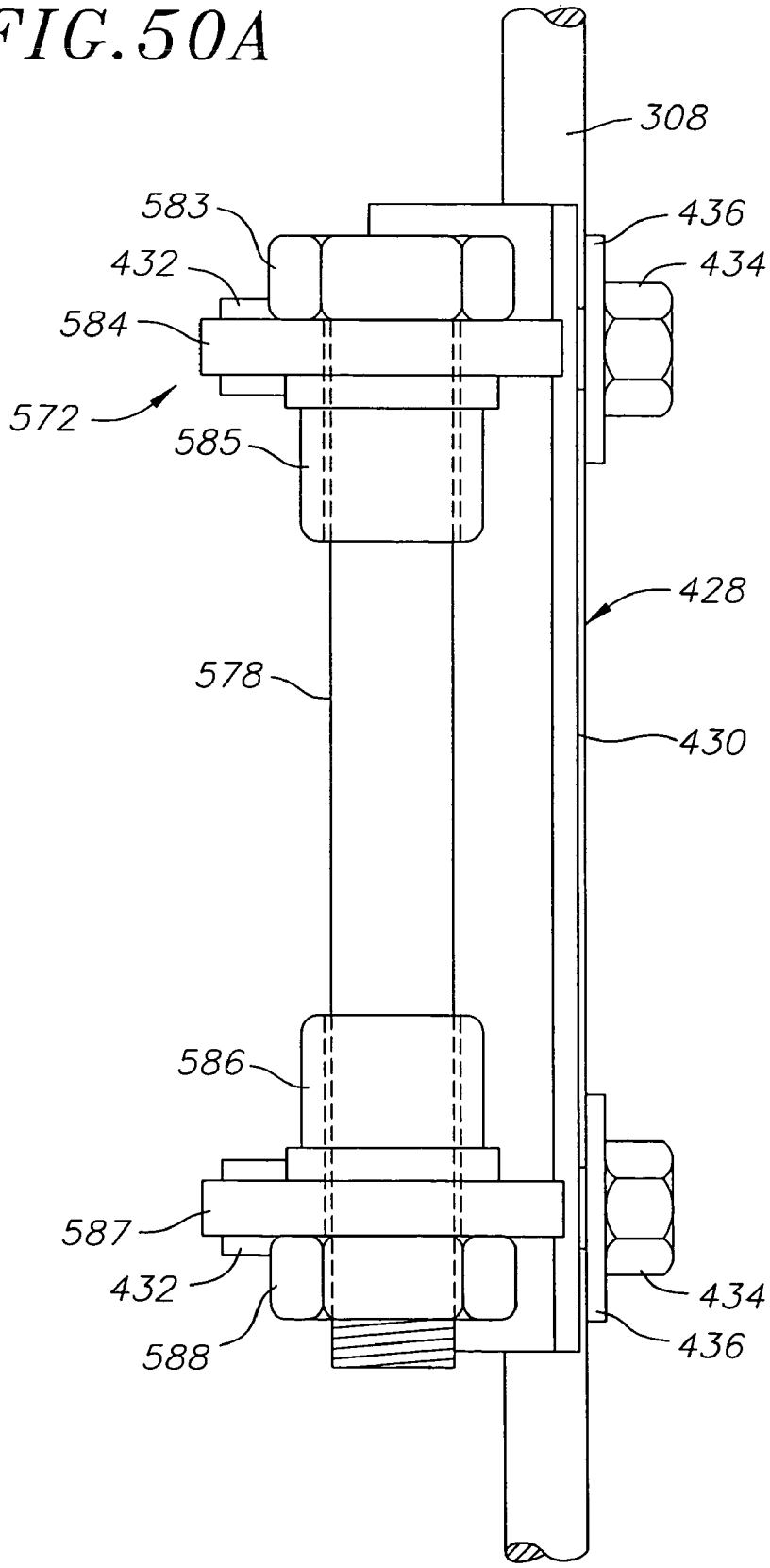
FIG. 50A is an enlarged elevation of a hinge (partially assembled) in the lower right-hand part of FIG. 50 which supports a swing platform.
Figure 51:
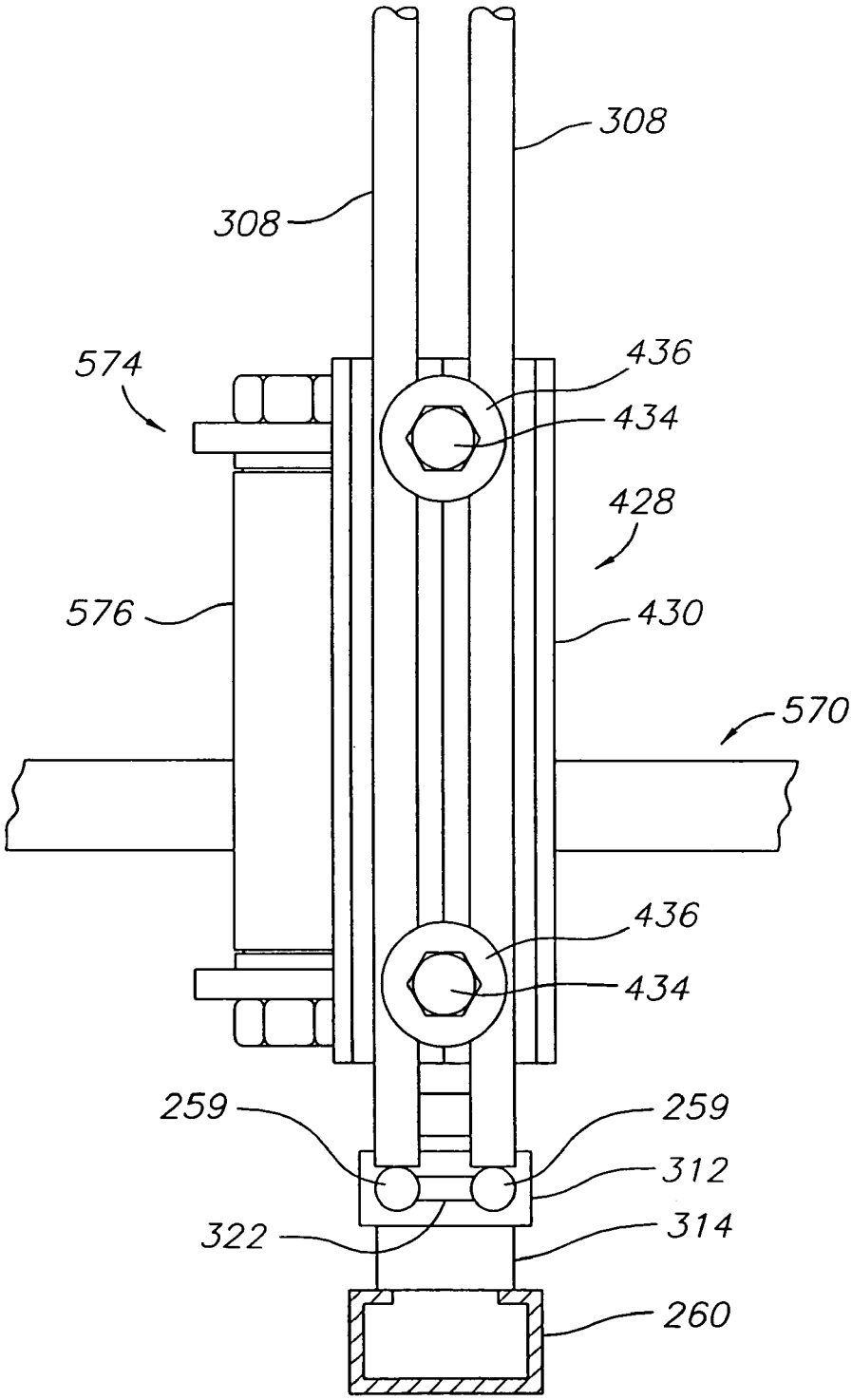
FIG. 51 is an elevational view taken on line 51-51 of FIG. 50, with the upper one of the two platforms removed.

FIG. 50A shows the hinge 572 before the sleeve 576 and swing platform 571 are assembled on it. The vertical hinge pin 578 includes a hexagonal bolt head 583 which rests on an upper horizontal washer 584 welded to the L-shaped bracket 430 and the coupling nut 432 of the upper part of clamp 428 as shown in FIG. 52. (The clamp 428 is of the type shown in FIG. 22 described above.) The hinge pin 578 extends down through upper washer 584, an upper bushing 585, and a lower bushing 586, which rests on the upper surface of a lower horizontal washer 587 welded to the lower part of L-shaped bracket 430 and the lower coupling nut 432 of clamp 428. The lower end of hinge pin 578 is externally threaded, and carries a hex nut 588, which locks the hinge pin to the upper and lower washers. A horizontal stabilizing bar 589 is mounted at one end to a coupling nut 432 on the lower part of clamp 428 to which the hinge is attached. The other end of the horizontal stabilizing bar is welded to a coupling nut 400 on a clamp 342 secured to the vertical rods 306 of the rotor. The hinge permits the platform to be moved from the washing position shown in FIG. 52 out to the loading position shown in FIG. 53. This facilitates use of a crane (not shown) for rapid loading and unloading of parts which are heavy or awkward to handle.

Figure 64:
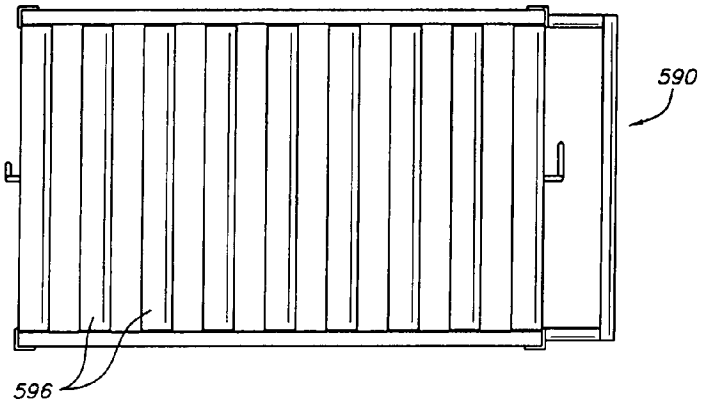
FIGS. 62, 63 and 64 are side, end, and plan views, respectively, of a cart with rollers for transporting parts to be washed to and from the parts washing machine.
Figure 62:
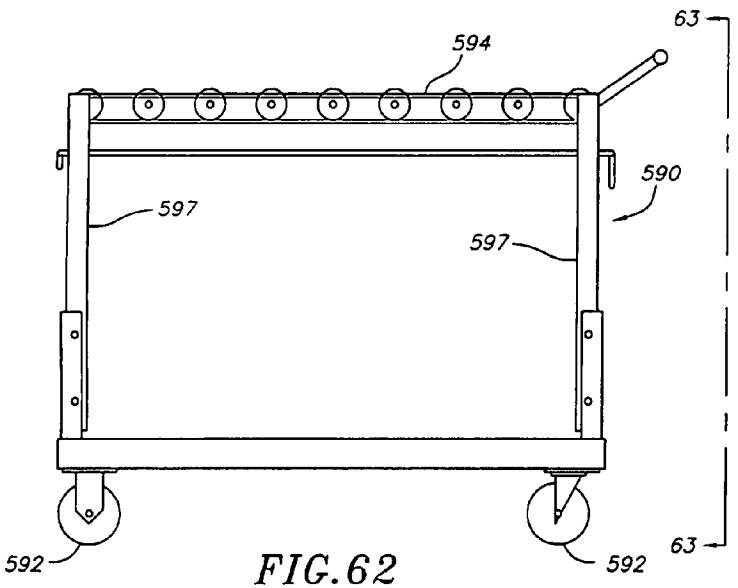
Figure 63:
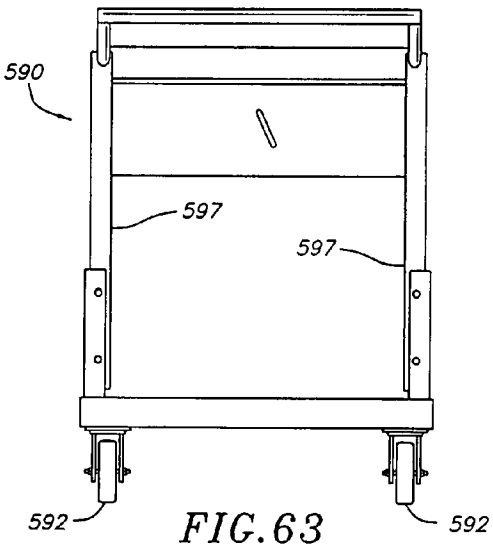

FIGS. 62, 63 and 64 show a cart 590 with four wheels 592 and a table top 594 provided with parallel rollers 596 to facilitate transporting heavy parts, and loading them on and off the roller table 440 on platform 340 (FIG. 24). The cart includes four legs 597 which are vertically adjustable so the cart rollers 596 can be set at a height most convenient for efficient handling of parts to be washed. An important advantage of this invention is that the height of platform 340 can easily be set so rollers 442 on the roller table on the platform matches that of the cart rollers to facilitate transfer of parts into an out of the cabinet of the washer.

Figure 54:
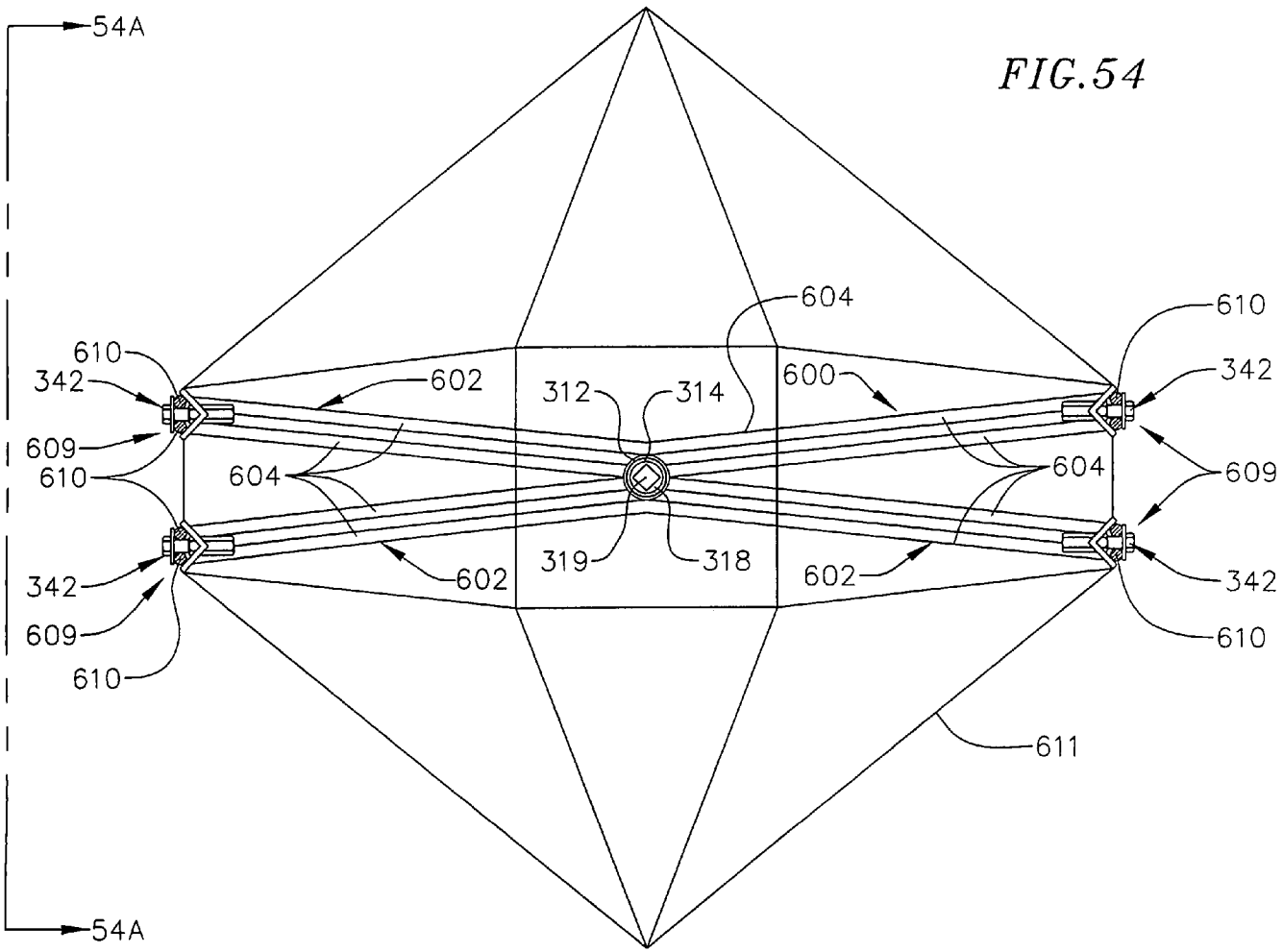
FIG. 54 is a cross-sectional plan view of the bottom of a rotor which includes a pair of rotors journaled around the lateral conduit in the lower section of the manifold.
Figure 54A:
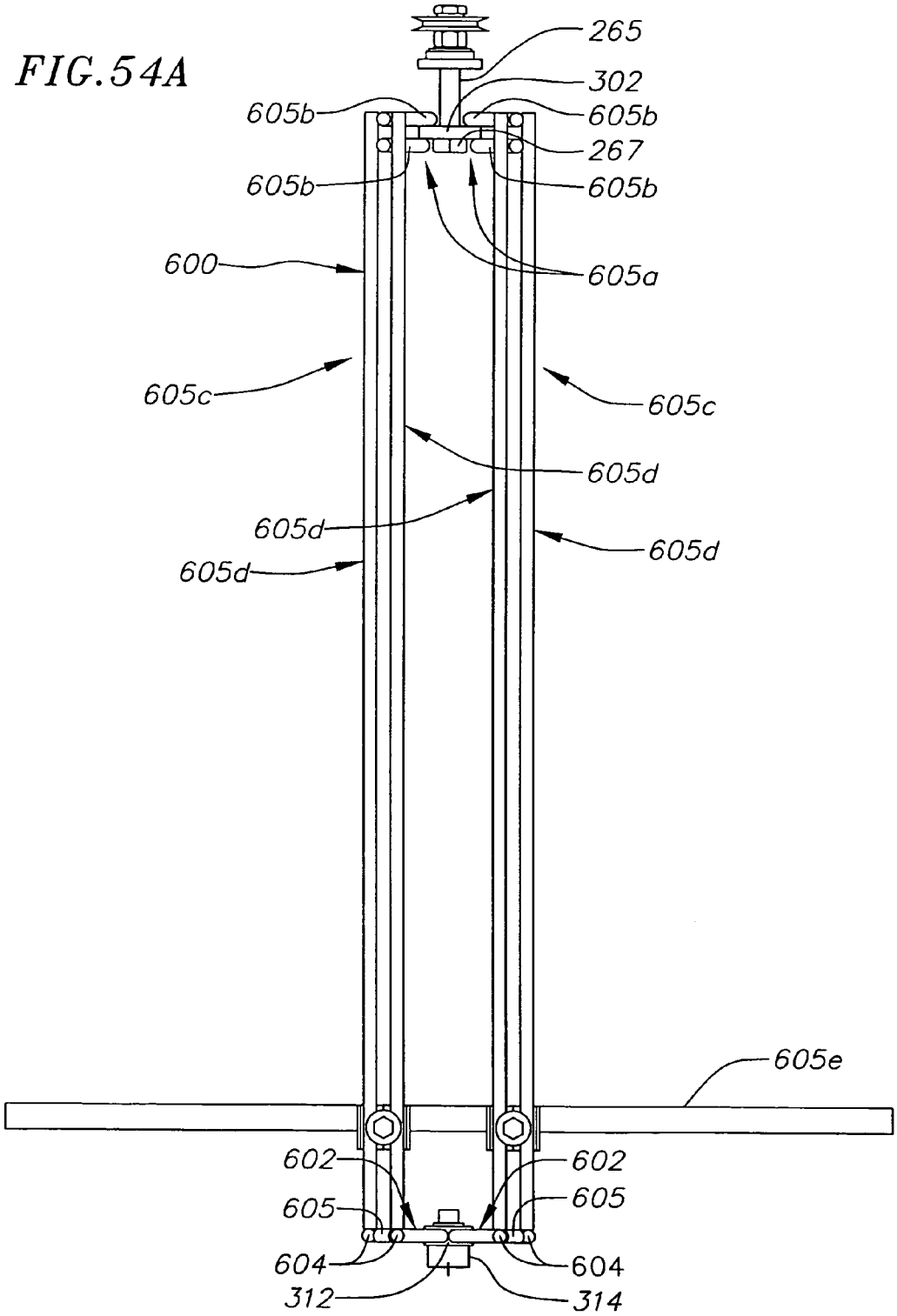
FIG. 54A is a view taken on line 54A-54A of FIG. 54.

FIGS. 54 and 54A show a more robust and larger version of a rotor 600 in a cabinet (not shown). Rotor 600 includes four pairs 602 of horizontal and parallel lower cross bars 604 each of which is of circular cross section. The lower cross bars lie in a common horizontal plane, and the cross bars in each pair are spaced apart by a distance about equal to the diameter of the bars. The inner end of each cross bar 604 is welded to the collar 312 surrounding the vertical lateral conduit 314 attached to the manifold. Two of the pairs of lower cross bars extend outwardly in generally the same direction but diverge from each other at an angle of about 15°. A second pair 602 of lower cross bars extend outwardly in an opposite direction and also diverge from each other at an angle of about 15°.

The outer end of each pair of lower cross bars is welded to a respective horizontal stub 605.

Figures 9, 9A:
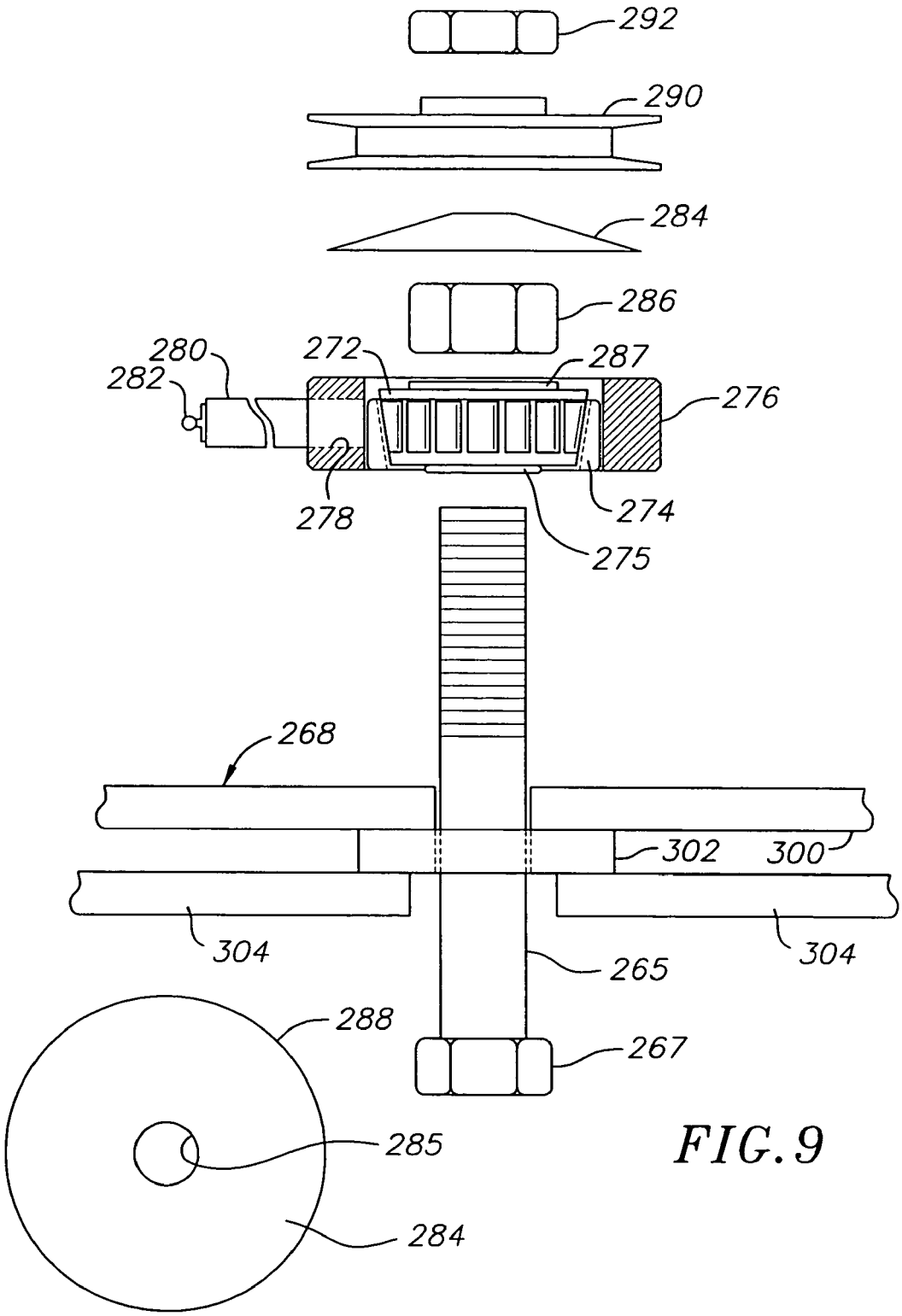
FIG. 9 is an enlarged fragmentary exploded view of the drive for rotating the drive shaft and rotor shown in FIG. 8.
FIG. 9A is a plan view of a dust seal for the bearing shown in FIG. 8.

Four pairs 605*a* of horizontal and parallel upper cross bars 605*b* (FIG. 54A) of the rotor 600 are constructed substantially identical of those shown in FIGS. 8-10, but include two diverging pairs of parallel bars on each side of the support bolt 265. The upper bars are also of circular cross-section, and the upper bars in each pair 605*a* are vertically spaced by a distance about equal to the diameter of the bars. The inner ends of each pair of upper bars are welded to the plate 302 disposed around bolt 265 as shown in FIG. 54A. The rotor 600 includes four pairs 605*c* of vertical rods 605*d*. As shown best in FIG. 54A, the lower end of each vertical rod is welded to the outer end and upper surface of a respective lower bar 604. The upper end of each vertical rod 605*d* is welded to the outer end and outer surface of each upper rod 605*b* in a respective upper pair 605*a*. A horizontal platform 605*e* is secured by four clamps 342 to the four pairs 600 of vertical rods 605*d*, in the same manner previously described with respect to FIG. 8. In effect, the more robust rotor of FIG. 54 is the equivalent of using two rotors of the type shown in FIG. 8.

Figure 55:
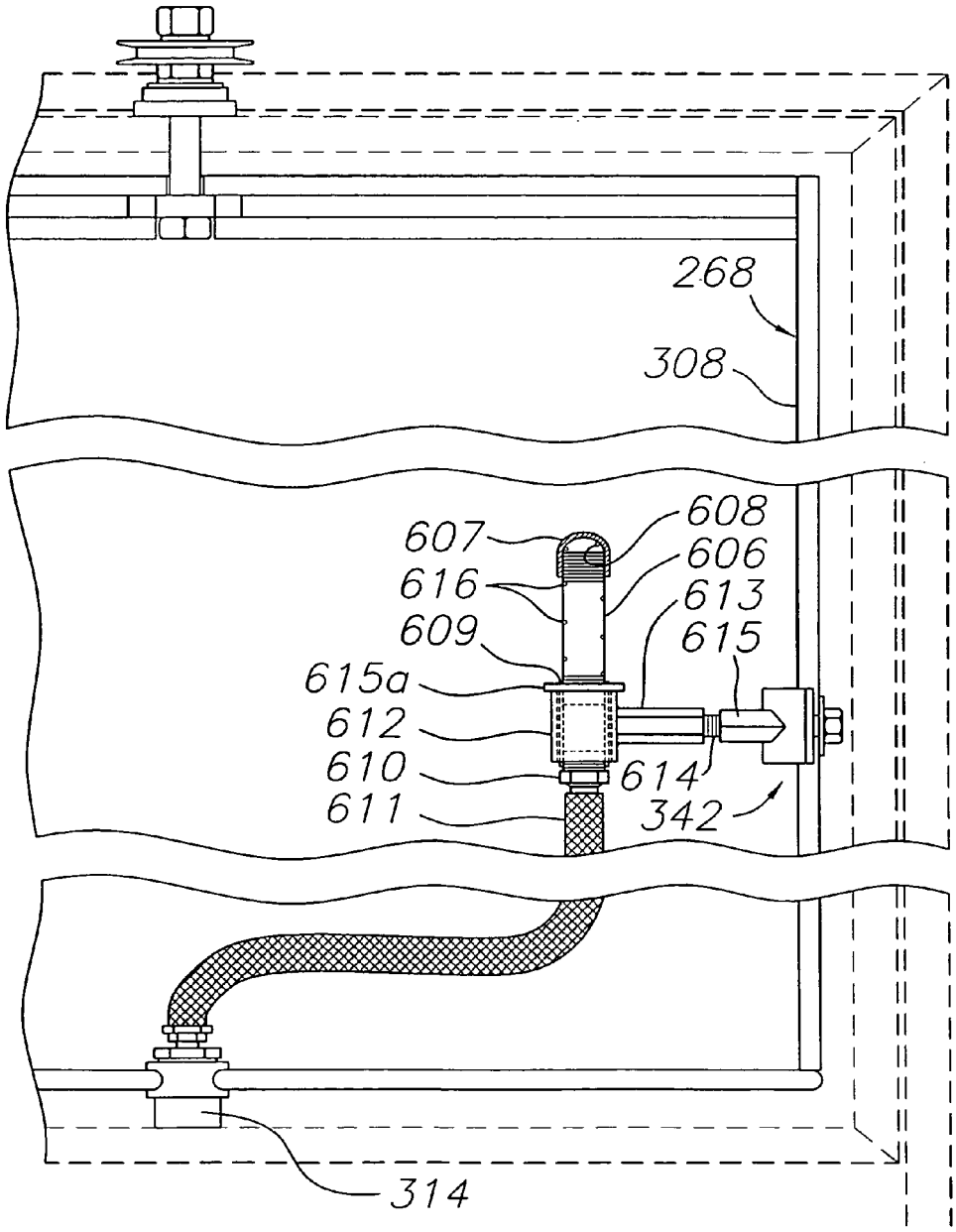
FIG. 55 is an elevation of a spray head connected to the lateral conduit of the manifold, and attached by a clamp and sleeve arrangement to a rotor.

Referring to FIG. 55, an elongated vertical spray head 606 is externally threaded at its upper end, which is closed by an internally threaded hemispherical cap 607 with apertures 608. The lower end of the spray head is threaded into the upper end of a pipe coupling 609, the lower end of which is threaded onto a hose fitting 610 connected to the upper end of a flexible hose 611 secured at its lower end to the outlet of lateral conduit 314 of the manifold. A vertical cylindrical guide sleeve 612 makes a close sliding fit around the pipe coupling. A horizontal coupling nut 613 is welded at its left (as viewed in FIG. 55) end to the exterior of the guide sleeve, and is connected by an externally threaded rod 614 to the left end of a horizontal, internally threaded coupling nut 615 welded to the exterior of a clamp 342 secured to vertical posts 308 of rotor 268 in the cabinet (not shown in FIG. 55). A horizontal washer 615*a* is welded around the upper end of pipe coupling 609, and rests on the upper end of the guide sleeve 612. The spray head 606 includes vertically and radially spaced apertures 616.

The arrangement shown in FIG. 55 is useful for many types of difficult washing jobs. For example, the spray head can fit up into the crankshaft cavity of an engine block (not shown) supported on a platform (not shown) secured to the rotor above clamp 342. As the rotor turns (usually at a relatively slow rate of about 1 rpm), powerful streams of washing liquid spray outwardly from apertures 608 and 616. Each stream of washing liquid from the apertures flows in substantially a fixed direction as the sleeve and spray head are carried around the axis of rotor rotation. The engine block crankshaft cavity, which is offset from the axis of rotation, rotates 360° with each revolution of the rotor so that the entire crank shaft cavity is thoroughly scrubbed by the streams of washing liquid from the apertures 608 and 616. When not in use, the spray head 606 can be unscrewed from the pipe coupling, which can be closed by a plug (not shown), or receive a spray head of different configuration from the one shown in FIG. 55.

Figure 56:
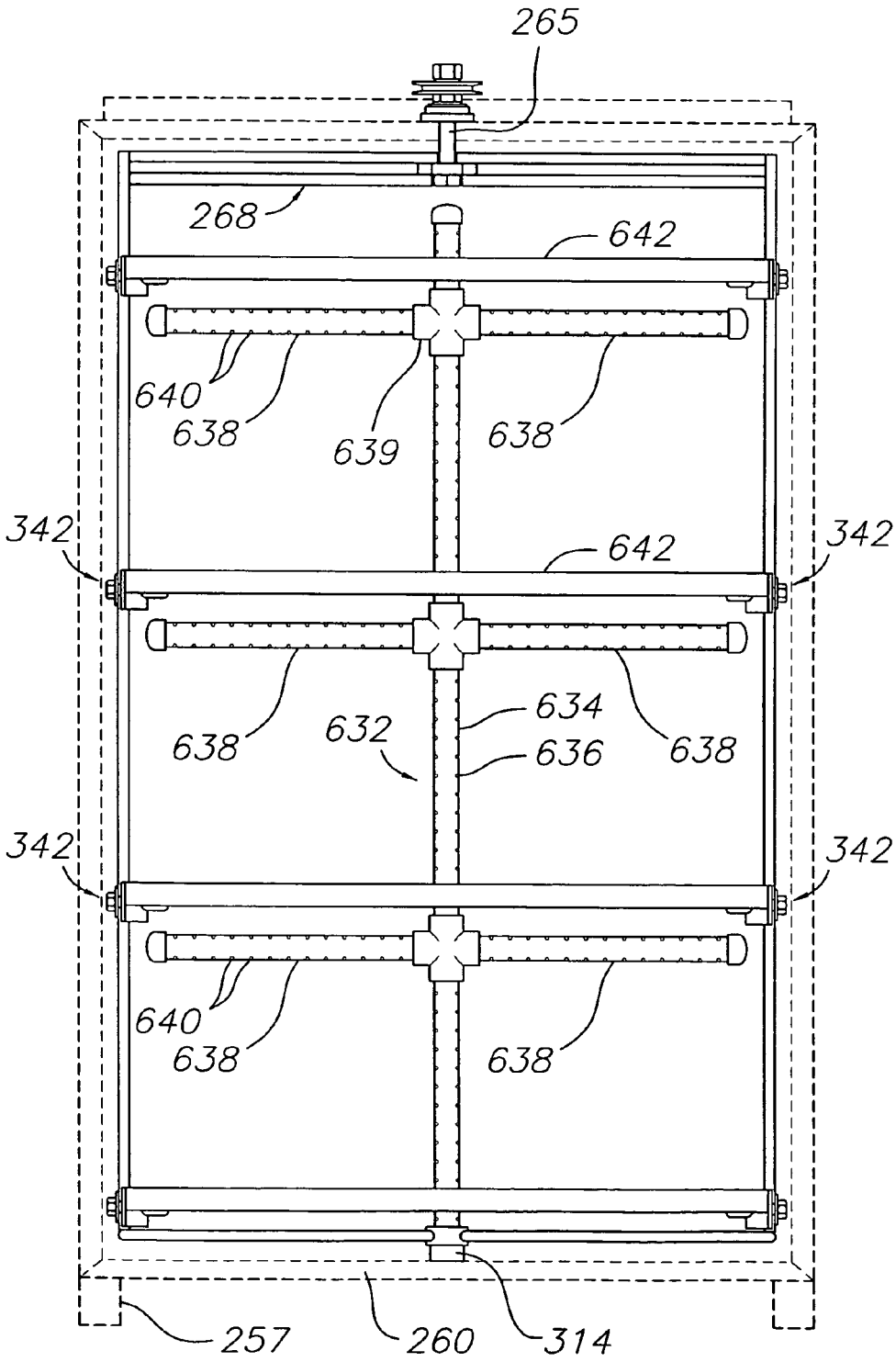
FIG. 56 is an elevation showing a spray distributor assembly connected to the lateral conduit in the lower section of the manifold.

FIG. 56 shows a spray distributor 632 with a central vertical pipe 634 connected at its lower end to the lateral conduit 314 of the manifold. A plurality of vertically and radially spaced apertures 636 in the pipe 634 direct streams of washing liquid in a generally horizontal direction from the center of the cabinet. Outwardly extending horizontal and vertically spaced pipes 638 are connected at their respective inner ends to respective cross fittings 639 to the vertical pipe 634. A plurality of longitudinally and radially spaced apertures 640 in the upper and lower portions of the horizontal pipes 638 direct strong streams of washing liquid upwardly and downwardly throughout the volume of the cabinet against dirty parts (not shown in FIG. 56) supported on horizontal platforms 642 mounted by clamps 342 on the rotor 268.

Figure 57:
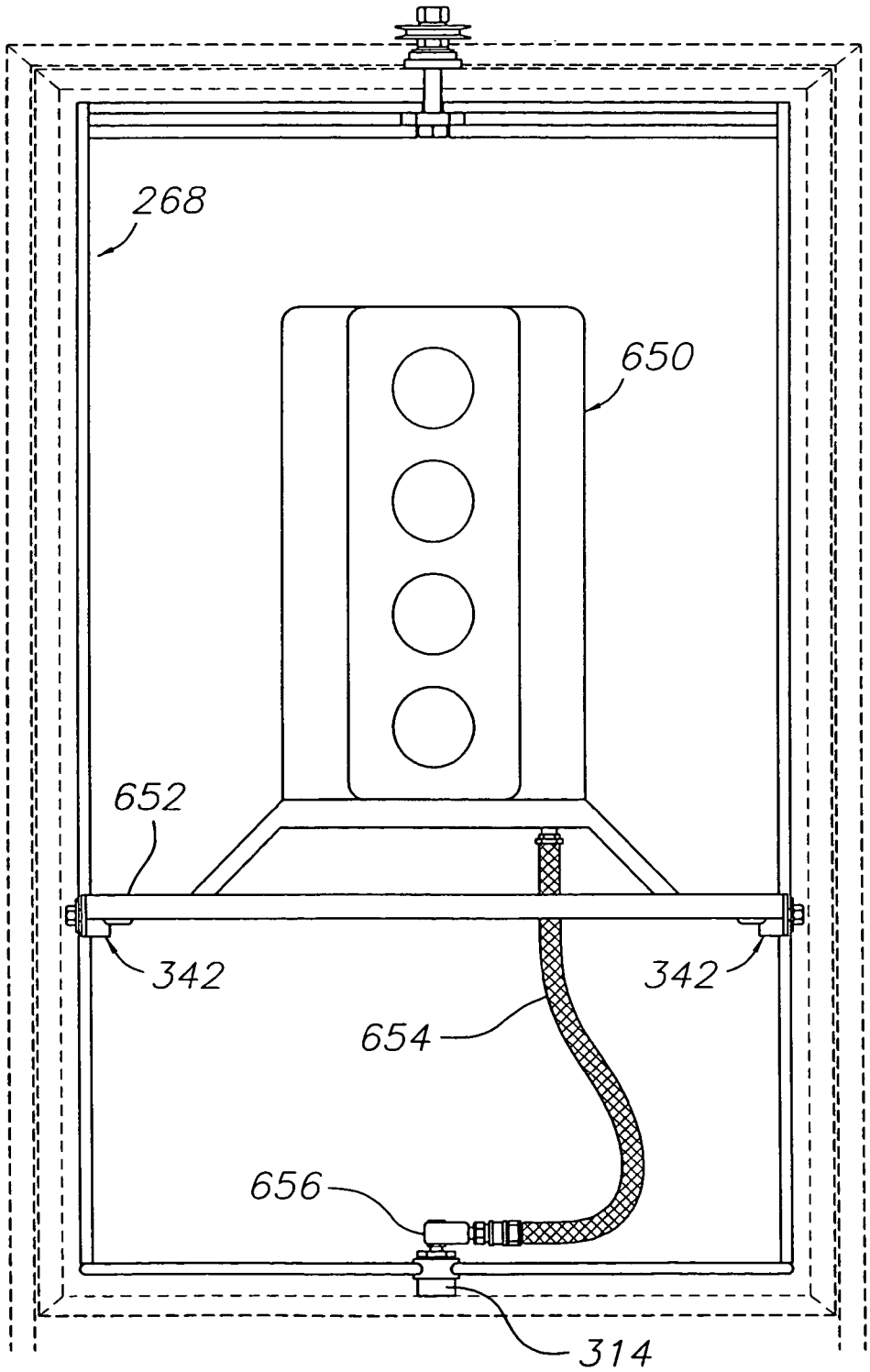
FIG. 57 is an elevation of an engine block disposed on a rotor with oil-feed galleries in the engine block connected through a swivel to the lateral conduit in the lower section of the manifold.

FIG. 57 shows an engine block 650 resting on a platform 652 secured by clamps 342 to the rotor 268 in the washer cabinet. A flexible hose 654 is connected at one end to the oil galleries (not shown) of the engine block, and at the other end through a swivel 656 to the lateral conduit 314 of the manifold. With the arrangement shown in FIG. 57, the exterior of the engine block is washed as the rotor turns, and simultaneously the oil galleries are also washed.

Figure 58:
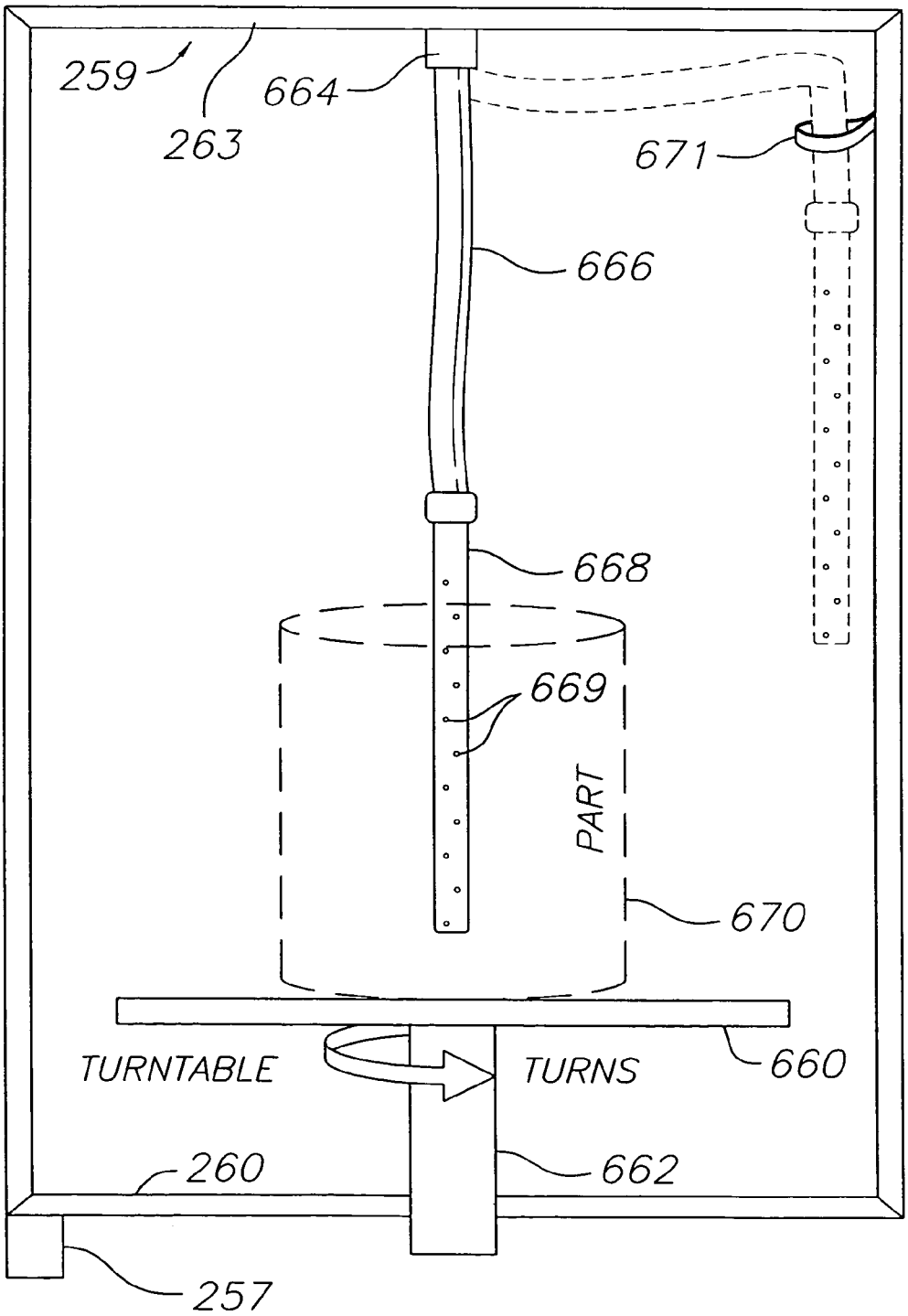
FIG. 58 is an elevation showing an alternate embodiment of the invention in which the lateral conduit is connected to open downwardly from the upper section of the manifold, and supply washing liquid to a spray distributor disposed within a part which rests on a rotatable turntable in the lower portion of the parts washer.

In the embodiment shown in FIG. 58, a turntable 660 is secured to the upper end of a vertical rotatable shaft 662 which extends down through the bottom of the cabinet (not shown) through a suitable rotatable seal (not shown). An external drive (not shown) rotates the shaft and turntable. The washer manifold 259 is mounted in the cabinet (not shown) as previously described, except that the lower horizontal section of the manifold jogs around the rotatable shaft 662, which is journaled through a watertight connection in the bottom of the cabinet. A downwardly extending lateral conduit 664 is connected to the center of the upper horizontal section 263 of the manifold to supply washing liquid to the upper end of a downwardly extending pipe (not shown) or flexible hose 666, the lower end of which is connected to the upper end of a vertical spray head 668 with longitudinally and radially spaced apertures 669 to direct streams of washing liquid outwardly against the interior of a part 670 resting on the turntable. Thus, as the turntable rotates, the interior of the part is thoroughly washed. When not used, the hose and spray head are secured by a releasable strap against the side of the cabinet to the position shown in phantom line. Alternatively, if a pipe (not shown) is used instead of flexible hose 666, the upper end of the pipe is threaded so it can be screwed into and out of lateral conduit 664 for storage when not in use. The lateral conduit is then closed with a threaded plug (not shown).

Figure 59:
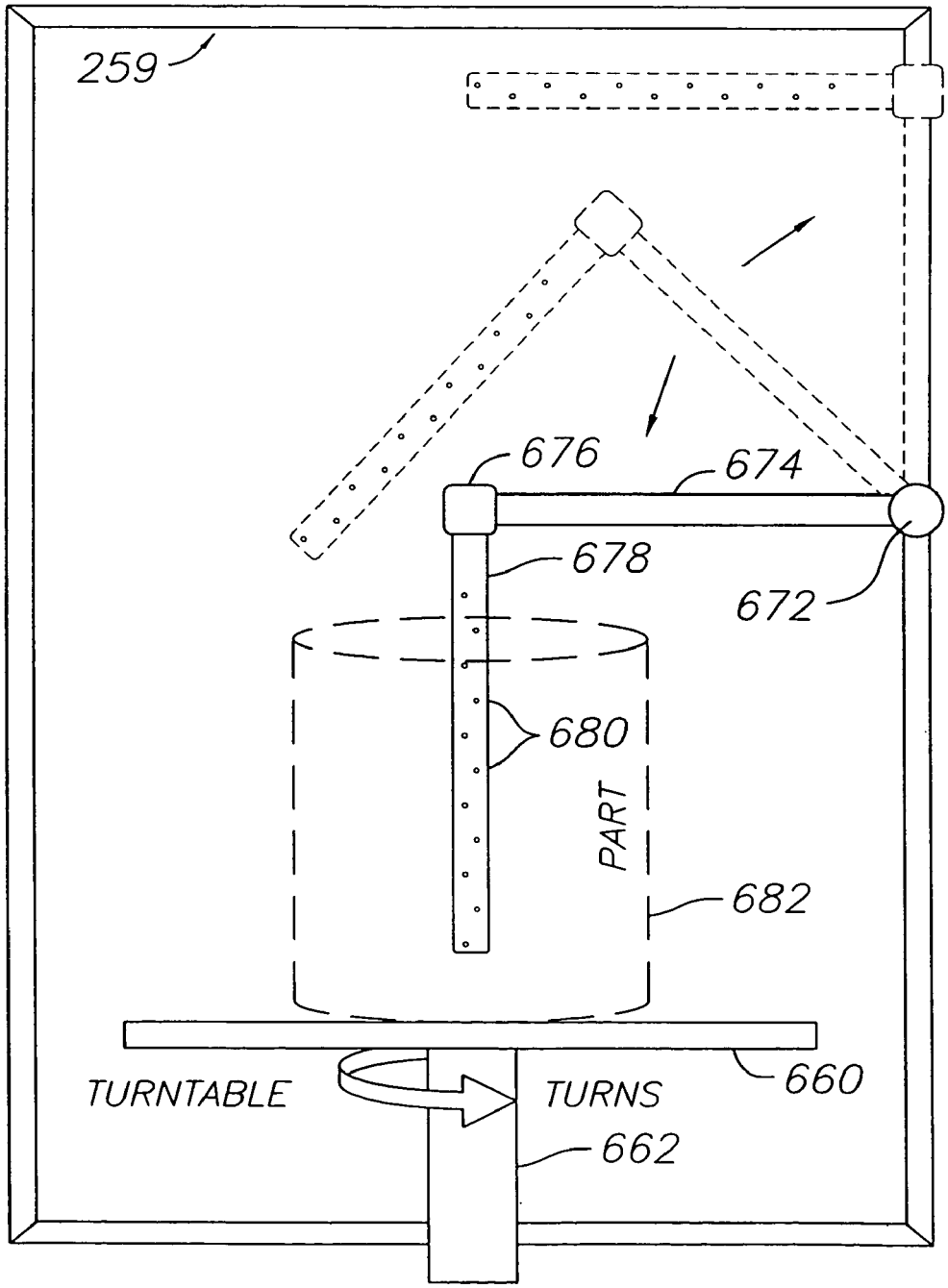
FIG. 59 is a view similar to FIG. 58 showing the lateral conduit opening out of one of the side sections of the manifold.

FIG. 59 shows an arrangement similar to that of FIG. 58. In FIG. 59, a horizontally extending lateral conduit (not shown) extends out of the right (as viewed in FIG. 59) vertical section of the manifold 259, and is connected by a swivel 672 to a horizontal pipe 674 which can pivot about the swivel in a vertical plane from the horizontal position shown in FIG. 59 to the intermediate and vertical positions shown in phantom line. Pipe 674 includes an elbow or a swivel connection 676 at its outer end to receive the upper end of a vertical spray pipe 678, which has longitudinally and radially distributed apertures 680 for directing streams of washing liquid against the interior of a part 682 resting on rotatable turntable 660.

Figure 60:
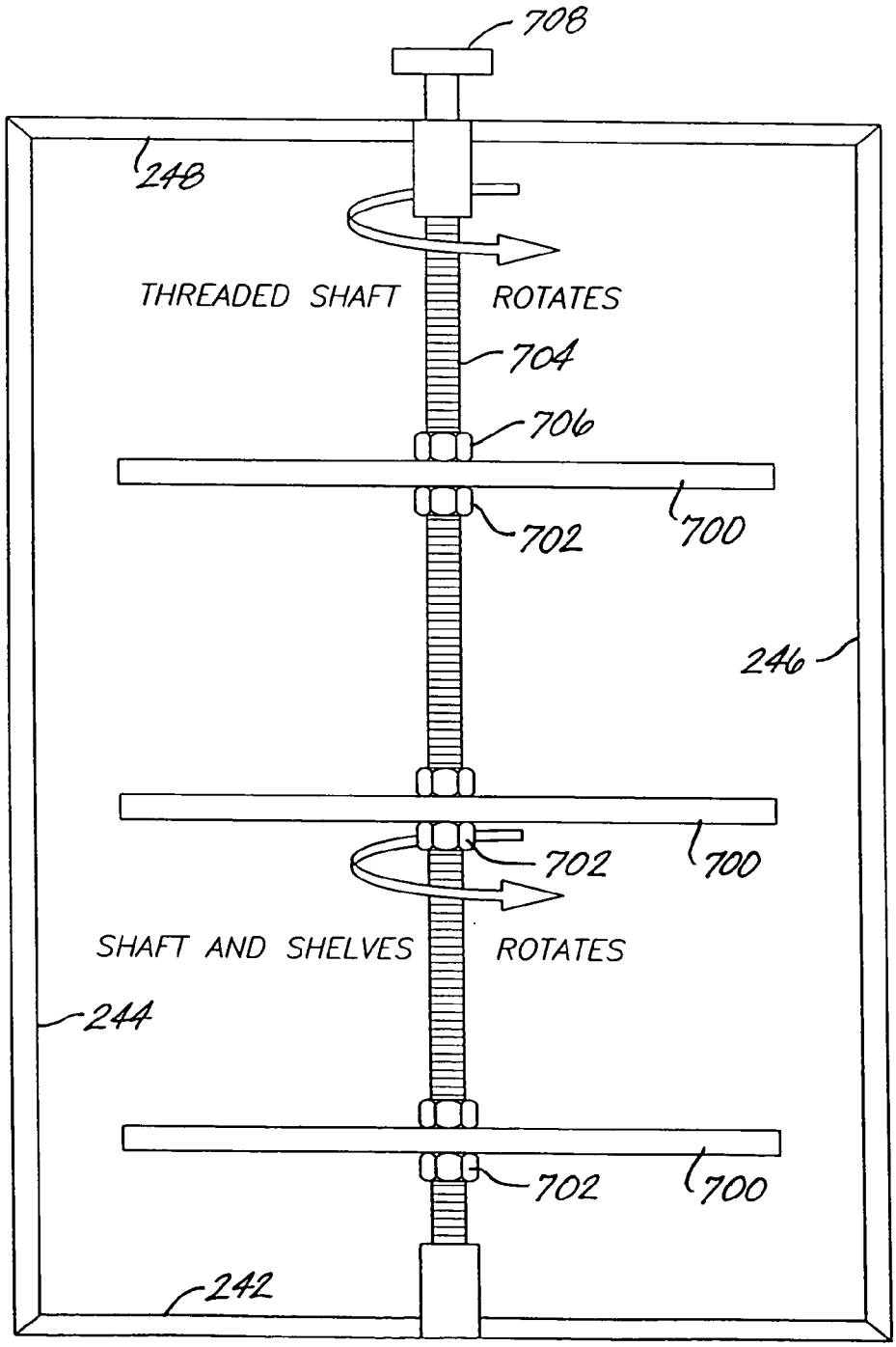
FIG. 60 is an elevation of an alternate embodiment of the invention in which the support for the parts to be washed is a vertical threaded shaft constructed to rotate with respect to the manifold, and platforms at different levels for holding parts to be washed.

With the embodiment shown in FIG. 60, three horizontal and vertically spaced platforms 700 in the washer cabinet (not shown in FIG. 60) each rest on a separate respective stop nut 702 on a vertical threaded support shaft 704 journaled at its upper and lower ends in the upper and lower horizontal sections, respectively, of the manifold. A separate lock nut 706 is threaded around the shaft above each platform, and is tightened so that each platform rotates with the shaft 704, which extends upwardly through the washer to a driven pulley 708 used to rotate the platforms during the washing operation. Each platform is easily and quickly adjusted vertically to different heights to accommodate various types of parts to be washed. If desired, the shaft 704 can be driven from below, as described above with respect to the embodiment shown in FIG. 58.

Figure 61:
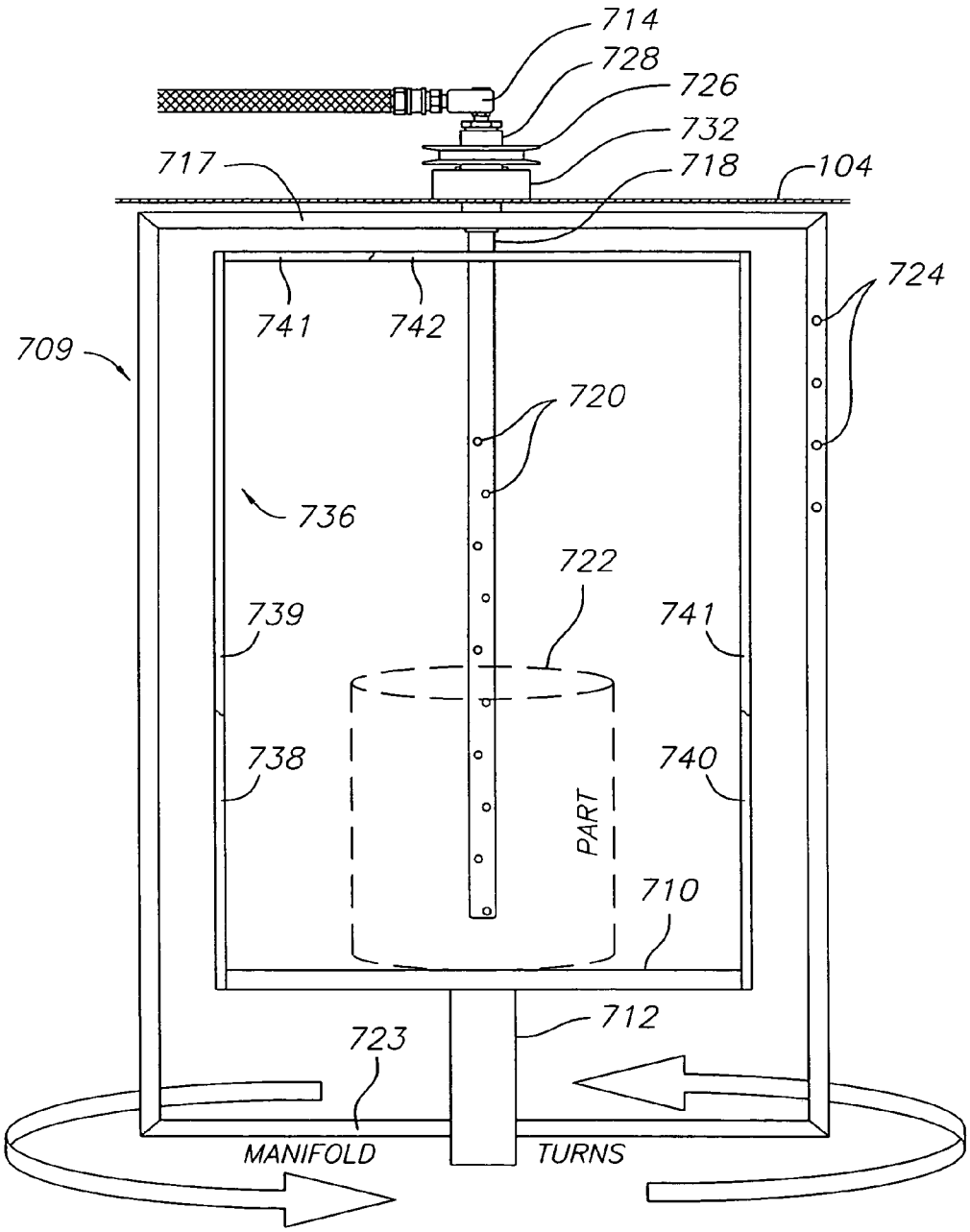
FIG. 61 is an elevation of an alternate embodiment of the invention in which the manifold rotates relative to a fixed platform which holds a part to be washed with a spray delivered by a vertical distributor pipe connected at its upper end to a lateral conduit in the upper section of the manifold, which is supplied washing liquid through a swivel.
Figure 61A:
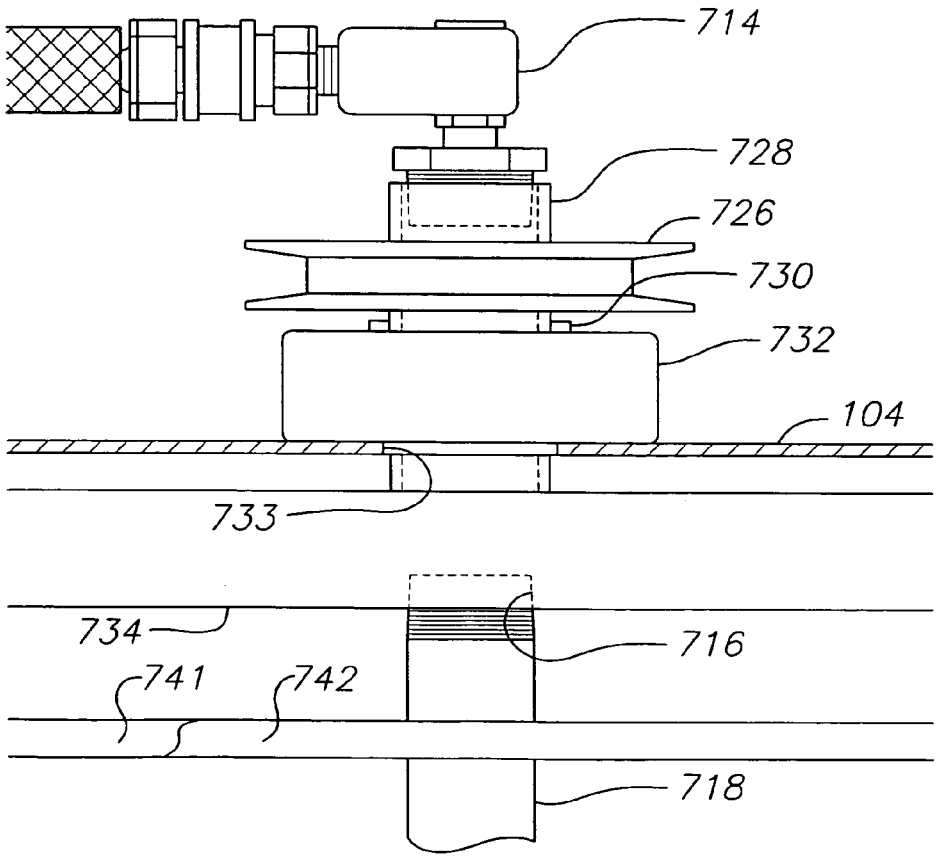
FIG. 61A is an enlarged view of the upper part of FIG. 61.

In the embodiment shown in FIGS. 61 and 61A, a manifold 709 rotates about a vertical axis around a circular platform 710, which can be adjusted to different heights on a supporting vertical column 712. A swivel 714 at the center of the upper horizontal section of the manifold supplies washing liquid to the manifold. A downwardly opening lateral conduit 716 through the lower face of an upper horizontal section 717 of the manifold supplies washing liquid to a vertical distributor pipe 718 which has vertically and radially spaced apertures 720 for directing streams of washing liquid outwardly from the center of the cabinet (not shown in FIG. 61) to wash the interior of a cylindrical part 722 resting on the fixed platform. The manifold 709 is similar to that shown in FIG. 8, except that a lower horizontal section 723 of manifold 790 is offset at its center to pass around the vertical column 712, which is supported at its lower end by conventional means (not shown, but arranged as described above and shown in FIGS. 8 and 14). The manifold includes inwardly opening apertures (not shown) for spraying streams of washing liquid on the exterior of the part to be washed, and vertically spaced and tangentially opening apertures 724 in the side sections to emit horizontal streams of washing liquid to rotate the manifold about a vertical axis in the central part of the cabinet of the washing machine, and which is coaxial with the longitudinal axis of the distributor pipe 718. Alternatively, the manifold and distributor pipe 718 are rotated by a driven pulley 726 secured to an internally threaded pipe 728 on the swivel joint 714. An annular stop 730 welded to the pipe 728 below the pulley supports the pipe 728 by resting on a thrust bearing 732 of the same type shown in FIGS. 9 and 10. The bearing 732 includes an outer race (not shown in detail in FIGS. 61 and 61A) which rests on the top wall 104 of the cabinet. An O-ring (not shown in FIGS. 61 or 61A) makes a static seal between the outer race of the bearing and the top wall 104, and a sliding seal against the exterior of pipe 728, where the pipe passes through an opening 733 in the top wall. The lower end of pipe 728 is connected to the center of an upper horizontal section 734 of the manifold 709.

A vertical support 736 (similar to rotor 268 shown in FIG. 8) is secured at its lower end to the circular platform 710. The support includes left (as viewed in FIG. 61) front and rear parallel vertical rods 738 and 739, respectively. The lower end of each rod 738 and 739 to the periphery of the platform 710. The rods are spaced from each other in a manner similar to vertical rods 306 of the rotor shown in FIG. 8. Right (as viewed in FIG. 61) front and rear parallel vertical rods 740 and 741, respectively, are each secured at their lower ends to the periphery of the circular platform 710 to be diametrically opposed to the left vertical rods 738 and 739. A pair of parallel, horizontal, front and rear rods 742 and 741 are each secured to the upper ends of the left and right front and rear rods 738, 739, 740 and 741, respectively. The upper rods 741 and 742 are spaced apart by a sufficient distance to provide clearance for the distributor pipe 718. Thus, clamps 342 of the type shown in FIG. 8 can be secured to the vertical rods of the support 736, so that various fixtures and platforms can be positioned at desired locations within the embodiment shown in FIGS. 61 and 61A. A drive belt (not shown) disposed around pulley 726 is connected to a drive pulley (not shown) on an electric motor (not shown) mounted on top of the washing machine.

Figure 61B:
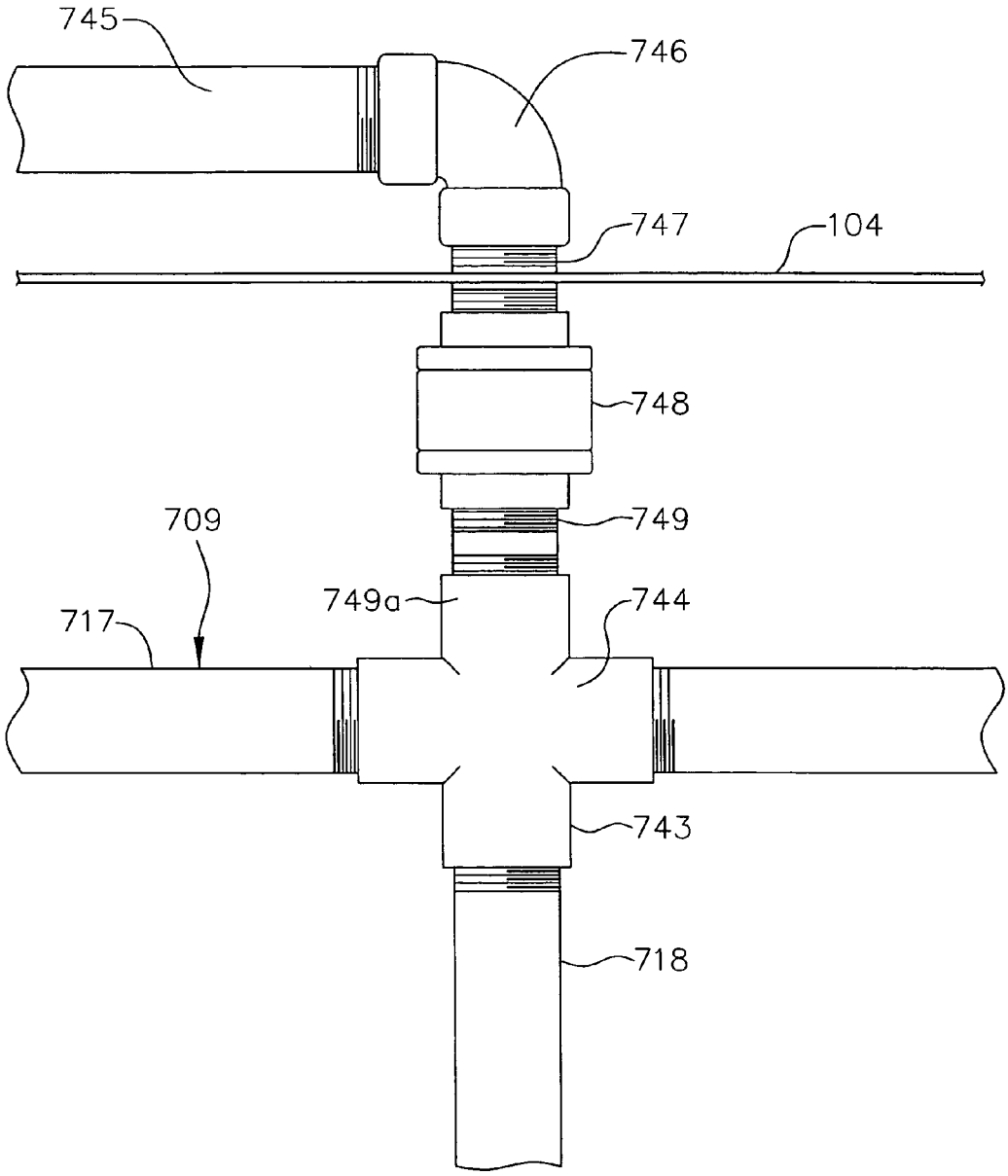
FIG. 61B is an enlarged elevation of an alternate embodiment for supplying washing liquid to the vertical distributor pipe shown in FIG. 61.

In the alternate embodiment shown in FIG. 61B, the upper end of the distributor pipe 718 shown in FIG. 61 is threaded into the lower leg 743 of a pipe cross 744, which is connected in the center of the horizontal section 717 of the manifold 709. The lower leg 743 forms a lateral conduit to supply a flow of washing liquid in a direction substantially collinear with the axis of rotation of the manifold. A pump (not shown) supplies washing liquid to the pipecross, manifold, and distributor pipe 718 through a horizontal supply pipe 745 connected to a pipe elbow 746, a first threaded pipe nipple 747, a swivel joint 748 and a second externally threaded pipe nipple 749 to the upper leg 749*a* of the pipe cross 744. The first pipe nipple 747 is sealed through the top wall 104 of the cabinet (not shown FIG. 61B) of the washing machine. The spray manifold is rotated about a vertical axis by streams of washing liquid expelled from the tangentially opening apertures 724 of the manifold (shown in FIG. 61).

Figure 65:
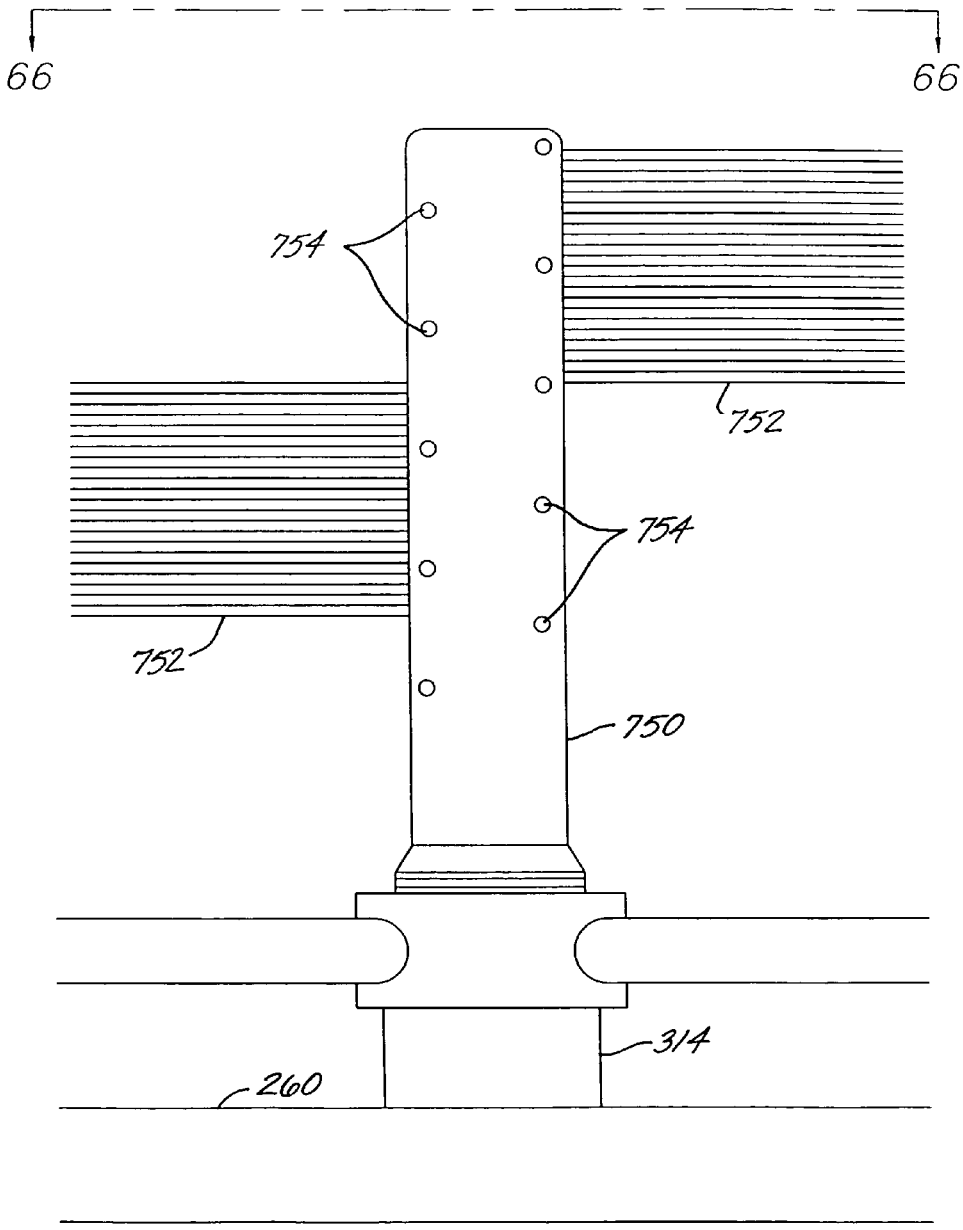
FIG. 65 is a fragmentary elevation of a stand pipe and brush connected to the lateral conduit in the manifold.
Figure 66:
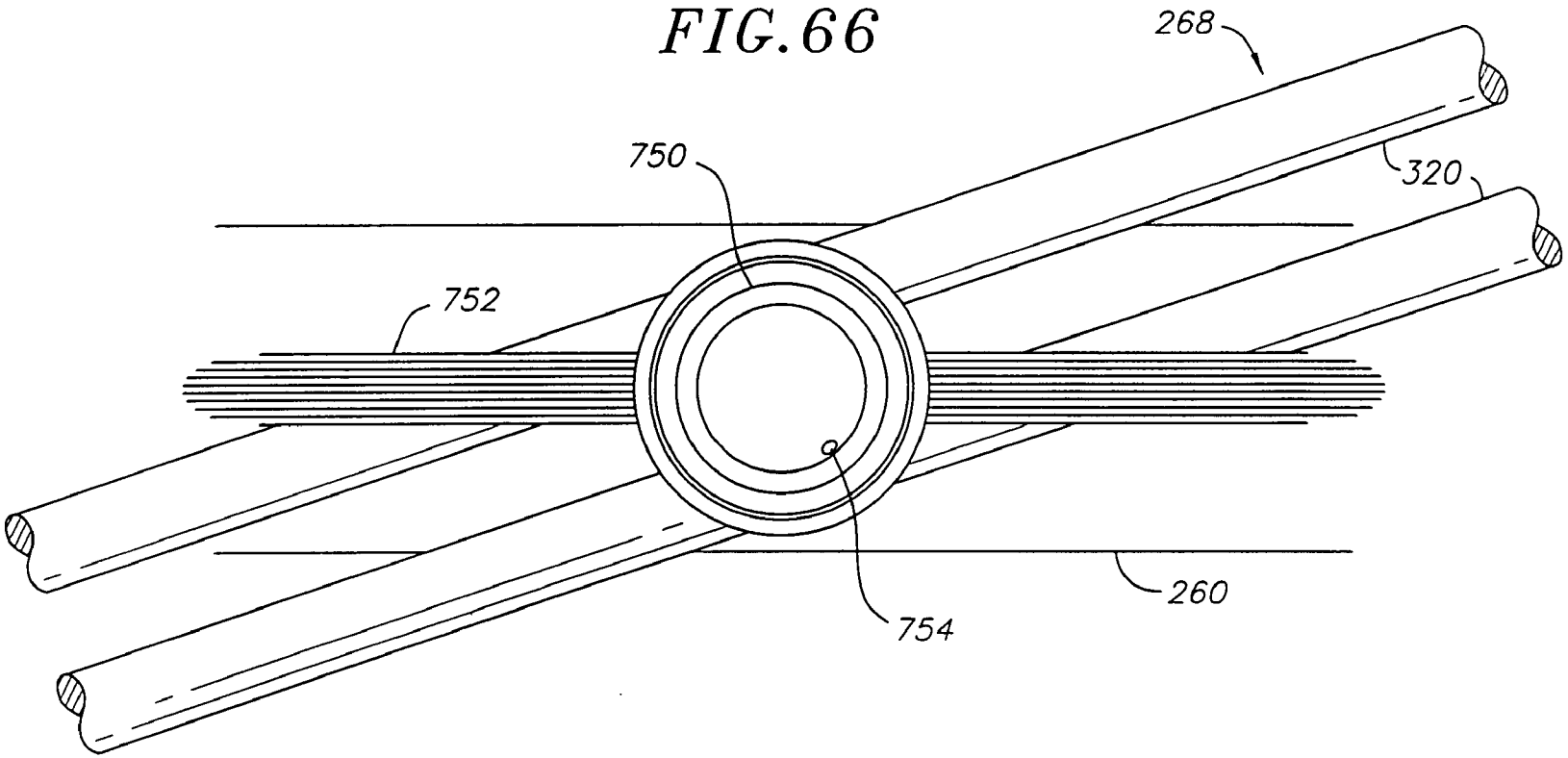
FIG. 66 is a view taken on line 66-66 of FIG. 65.

FIGS. 65 and 66 show a vertical distributor pipe 750 threaded at its lower end into the upper end of the lateral conduit 314 in the center of the lower horizontal section 260 of the manifold. Outwardly extending bristles 752 mounted on the exterior of the distributor pipe 750 engage the interior surfaces of a part (not shown) to be washed, and which rests on a platform (not shown) in the cabinet. Vertically and radially spaced apertures 754 in the distributor pipe direct outwardly flowing horizontal streams of washing liquid against the interior of the part, which rests on a platform (not shown) and rotates around the bristles on the stationary distributor pipe 750.

Figure 67:
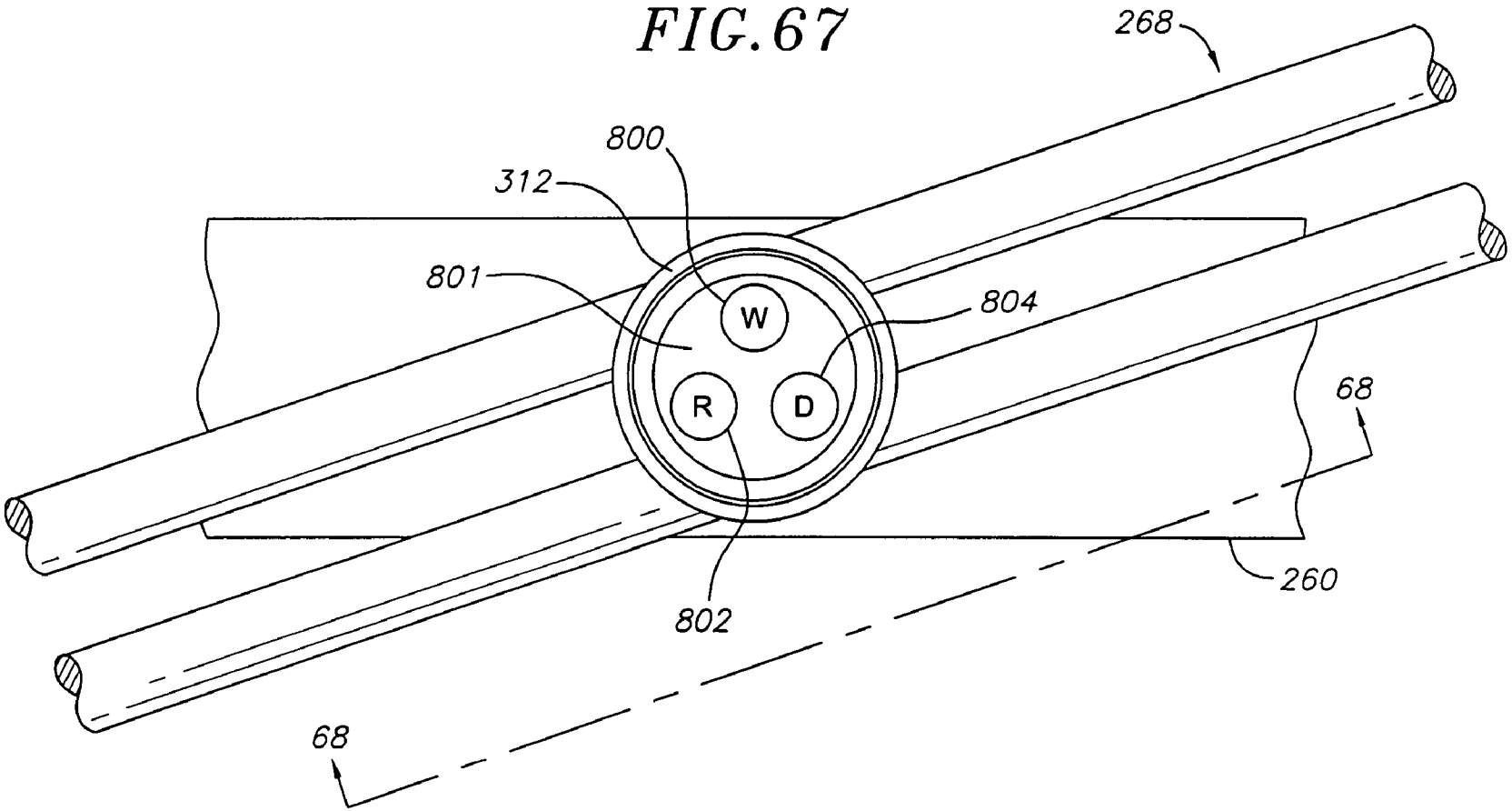
FIG. 67 is a fragmentary plan view of the manifold lateral conduit equipped for operating the machine with cycles for washing, rinsing, and drying parts.
Figure 68:
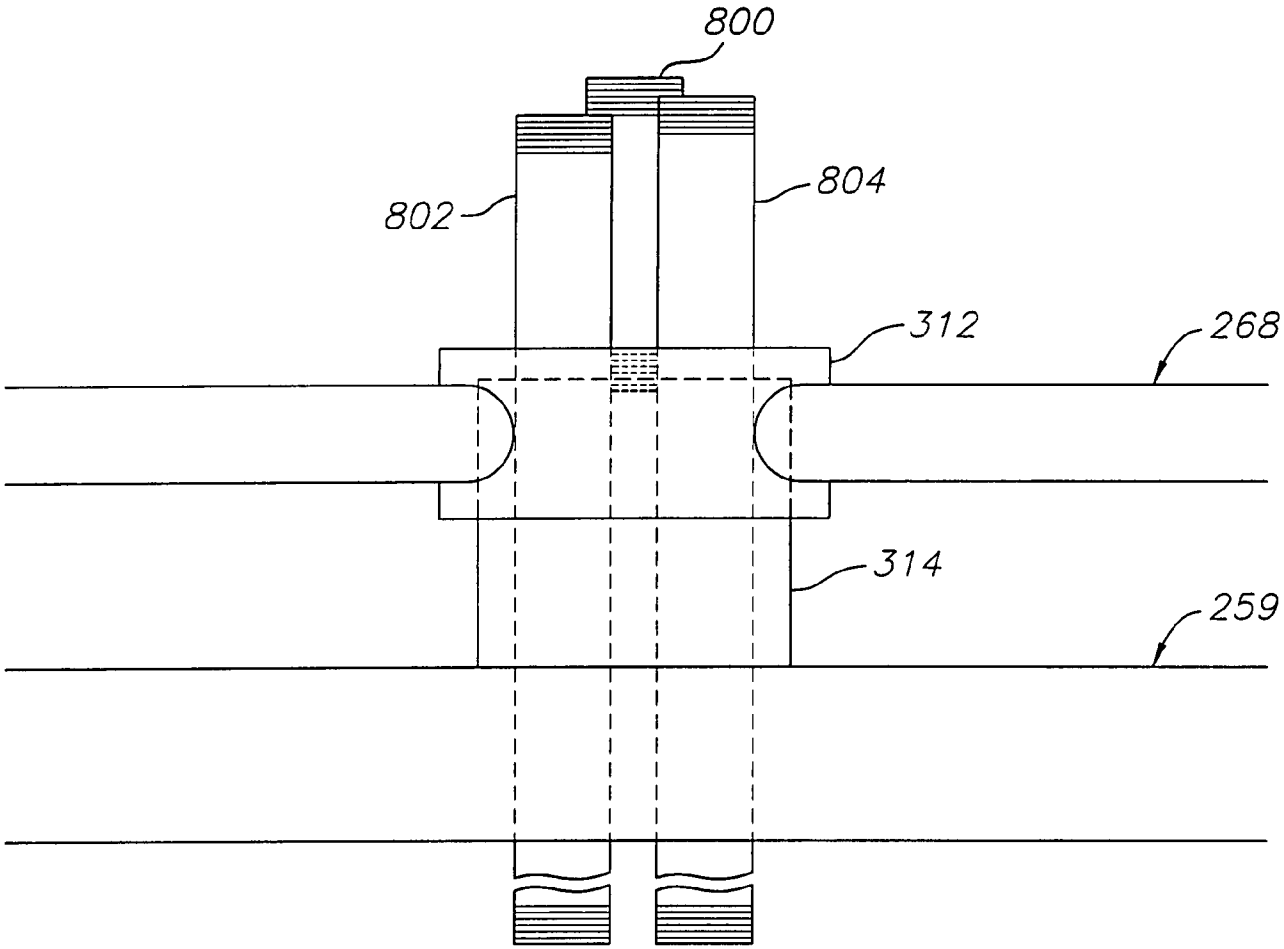
FIG. 68 is a schematic view taken on line 68-68 of FIG. 67.

Referring to FIGS. 67 and 68, a first vertical wash pipe 800 is threaded into a fitting 801 at the upper end of lateral conduit 314 connected to the manifold 259. The upper end of wash pipe 800 is externally threaded, and can be connected to various pieces of apparatus previously described for supplying washing liquid from the manifold to the interior of the cabinet (not shown in FIG. 67 or 68). When washing liquid is not required, pump 256 is turned off. A vertical rinse pipe 802 is sealed through the fitting 801, and extends down through the lateral conduit 314 and out through a sealed connection (not shown) through the bottom of the manifold. The lower end of rinse pipe 802 is also sealed through the bottom of the cabinet (not shown in FIG. 68), and connected to conventional plumbing and timer for supplying rinse liquid to the cabinet interior when required. A vertical drying pipe 804 is sealed through the fitting 801, and extends down through the lateral conduit 314, and out through a sealed connection (not shown) through the bottom of the manifold 259. The lower end of the drying pipe extends out through a sealed connection (not shown) in the bottom of the cabinet, and is connected to suitable plumbing to receive hot drying air to provide a drying cycle for parts which have been washed in the machine. With the arrangement shown in FIGS. 67 and 68, during the washing cycle hot washing liquid is distributed through the manifold and wash pipe 800 to wash parts in the cabinet as previously described. After washing is completed, a rinse liquid from rinse pipe 802 rinses washed parts. Thereafter, warm drying air is circulated through the drying pipe 804 to dry washed parts in the cabinet.

Figure 69:
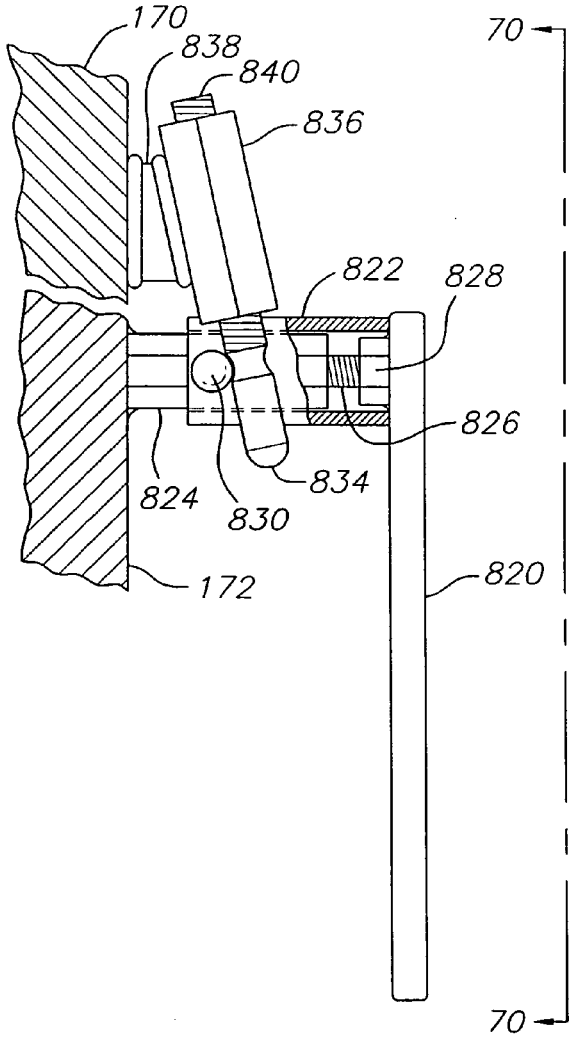
FIG. 69 is a view similar to that of FIG. 6 showing a preferred embodiment of a door latch handle.
Figure 70:
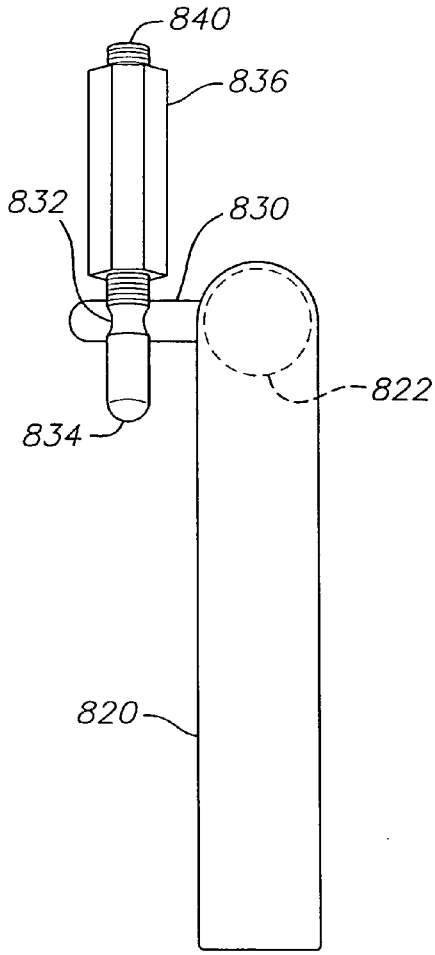
FIG. 70 is a view taken on line 70-70 of FIG. 69.

Referring to FIGS. 69 and 70, a preferred embodiment of the door handle and latch assembly for the cabinet door includes a flat handle 820 which lies in a substantially vertical plane, and carries a horizontal collar 822 at one end. The free end of the collar makes a close sliding fit over the right (as viewed in FIG. 69) end of a horizontal coupling nut 824 welded at its left end to the front face of the cabinet door 172. A horizontal bolt 826 has a bolt head 828 welded to the door handle 820 within collar 822. The threaded portion of the bolt is collinear with the collar and fits into the right end of coupling nut 824. A laterally extending cylindrical locking pin 830 is welded at one end to the left end of the collar 822. The locking pin 830 makes a snug fit in an annular external groove 832 in a retaining screw 834, which extends upwardly into an internally threaded coupling nut 836 welded to a mounting bracket 838 on the front face of the cabinet adjacent doorway 170. With the door in the latched position shown in FIG. 69 and 70, the inner face of the door makes a snug fit against the annular bulb 196 (FIG. 5) of the gasket, and compresses the gasket into a sealing position so that no liquid can flow from the cabinet when the door is in the closed and latched position. The amount of compression exerted by the door latch is easily adjustable by unlatching the door, swinging it partially open, and then rotating the handle and bolt 826 to adjust the position of the laterally extending latching pin 830 to the desired distance from the front of the door. The exact position of the annular detent groove 832 on the retaining screw 834 is precisely set by rotating the retaining screw 834 in or out of the coupling nut 836. An alien set screw 840 in the upper end of coupling nut 836 locks the retaining screw in the desired position.

From the preceding description, it will be apparent that this invention provides an improved industrial parts washer which is easier to manufacture, and more economical and convenient to operate. Moreover, the provision of vertically adjustable platforms for supporting parts of various shapes and sizes increases the utility of the washer, and eliminates the need for dedicated washer for parts of certain sizes and shapes.

I claim:

1. A parts washer comprising:

a) a cabinet having top, bottom, and side walls;

b) a frame secured to and disposed around the exterior of the cabinet, a major part of the frame being spaced from and out of contact with the cabinet;

c) a shell secured to the frame to be disposed around and spaced from the cabinet;

d) a layer of thermal insulation disposed between the cabinet and the shell;

e) an upright support in the cabinet;

f) vertically adjustable clamps secured to the support to hold a load of parts to be washed at different vertically spaced locations in the cabinet;

g) a manifold in the cabinet for spraying a washing liquid on the parts;

h) a drive for rotating the support and manifold relative to each other about a substantially vertical axis in the cabinet;

i) the manifold including substantially horizontal upper and lower sections which pass through the axis of rotation, a pair of horizontally spaced side sections each having a respective upper end connected to a respective end of the upper section, and each side section having a respective lower end connected to a respective end of the lower section, each side section being attached to a respective adjacent side wall;

j) a thrust bearing supported by the upper section of the manifold, the support being suspended from the thrust bearing so the load of parts is substantially carried by the manifold;

k) a lateral conduit substantially on the axis in the lower section of the manifold for supplying a flow of washing liquid in a direction substantially collinear with the axis;

l) a vent in the upper part of the cabinet for releasing expanding gas from within the cabinet;

m) a coalescing and condensing chamber having an outlet connected to the vent, and having an inlet located a substantial distance below the outlet;

n) a pressure relief valve in the vent to permit gas to flow from the cabinet when the pressure in the cabinet is at one value, and which impedes flow of gas from the cabinet when the pressure in the cabinet is at a lower value;

o) a door opening in a side wall of the cabinet, the door opening including a gasket flange disposed around the door opening and extending into the door opening in a plane substantially parallel with the side wall, the interior periphery of the flange being free of sharp angles;

p) an elastomeric gasket mounted on the flange to be free of wrinkles and kinks;

q) a door secured by hinges to one edge of the door opening, and adapted to contact the gasket to open and close the door opening;

r) an adjustable latch on the door and cabinet to permit the door to be sealed against the gasket with an adjustable pressure;

s) a filter tray sealed across a lower part of the cabinet and above the cabinet bottom wall;

t) a reservoir for holding washing liquid at a normal operating level in the bottom of the cabinet and below the filter tray;

u) at least one filter bag sealed in an opening through the filter tray and extending down below the filter tray;

v) a pump connected to circulate washing liquid from the reservoir through the manifold so washing liquid is sprayed on parts in the cabinet and is returned through at least one filter to the reservoir;

w) an overflow conduit having an inlet above the filter plate and an outlet below the filter plate to carry accumulated washing liquid from the top of the filter plate to the reservoir; and x) a return drain having an inlet to collect washing liquid exterior of the cabinet and an outlet to deliver collected liquid to the reservoir below the normal operating level of the washing liquid.

2. A parts washer comprising:

a) a cabinet having a substantially vertical axis;

b) a manifold in the cabinet, the manifold including a section spaced from the axis and having ports for spraying a washing liquid toward the axis;

c) a support in the cabinet adapted to hold a work load, which includes at least one part to be washed wherein the support is suspected from a horizontal section of the manifold such that the manifold substantially bears the load of the at least one part held by the support;

d) the manifold and the support being rotatable relative to each other about the axis; and e) a conduit connected to the manifold to supply a flow of washing liquid in a direction substantially collinear with the axis.

3. Apparatus according to claim 2 in which the support rotates within the cabinet about the substantially vertical axis.

4. Apparatus according to claim 3 in which the manifold includes upper and lower substantially horizontal sections which pass through the vertical axis, and side sections which connect the upper and lower manifold sections together, the upper, lower and side sections of the manifold substantially lying in a common vertical plane, the side sections of the manifold each having vertically spaced apertures for directing streams of washing liquid inwardly toward the vertical axis.

5. A parts washer comprising:

a) a cabinet having top, bottom and substantially upright sidewalls;

b) a manifold in the cabinet, the manifold having a pair of elongated, upwardly extending side sections, and a transverse upper section connected to an upper part of each side section, the manifold having openings for spraying a washing liquid on parts to be washed;

c) a downwardly extending support suspended from the upper section of the manifold for supporting a load of parts to be washed in the cabinet; and d) the manifold side sections being secured to the cabinet sidewalls so the weight of the load of parts is substantially carried by the manifold and the side walls.

6. Apparatus according to claim 5 in which the support includes a rotatable shaft suspended from a thrust bearing, the rotatable shaft extending through a water-tight vertical sleeve sealed through the upper section of the manifold.

7. Apparatus according to claim 6 in which the manifold includes a substantially horizontal lower section connected to a lower part of each side section and extending through the vertical axis about which the rotatable shaft rotates, and an upwardly extending projection in the vicinity of the midpoint of the lower section to receive a collar secured to a lower portion of the support to stabilize the support as it rotates within the cabinet.

8. Apparatus according to claim 6 in which the upwardly extending projection is a lateral conduit connected to communicate with the interior of the manifold, and a removable closure for the lateral conduit.

9. Apparatus according to claim 5, 6, 7, or 8 in which the support includes a substantially vertical drive shaft journaled through the top wall of the cabinet, at least one downwardly extending leg secured to the shaft, and a releasable clamp fastened to the leg.

10. Apparatus according to claim 9 in which the leg includes a pair of substantially parallel elongated rods, and the clamp includes a pair of diverging walls secured together at an apex, a first threaded connector secured to at least one of the walls in the vicinity of the apex and having a longitudinal axis extending in the direction which the walls diverge, a second threaded connector which mates with the first, one of the connectors being disposed between the parallel rods, and a transverse retainer carried by one of the threaded connectors to engage the parallel rods, and urge them into contact with the walls when the two threaded connectors are screwed together.

11. Apparatus according to claim 5, in which the support includes a rotatable shaft suspended from a thrust bearing resting on the upper section of the manifold, the shaft including a threaded section extending above the thrust bearing, a load nut on the threaded section of the shaft to rest on the thrust bearing, and a removable pulley on the shaft above the load nut so the pulley can be removed from the shaft which the load nut rests on the thread bearing.

12. Apparatus according to claim 11 which includes a lock nut on the shaft above the pulley to lock the pulley on the shaft.

* * * * *